US009620137B2

(12) United States Patent
Kim et al.

(10) Patent No.: US 9,620,137 B2
(45) Date of Patent: Apr. 11, 2017

(54) DETERMINING BETWEEN SCALAR AND VECTOR QUANTIZATION IN HIGHER ORDER AMBISONIC COEFFICIENTS

(71) Applicant: QUALCOMM Incorporated, San Diego, CA (US)

(72) Inventors: Moo Young Kim, San Diego, CA (US); Nils Günther Peters, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 15 days.

(21) Appl. No.: 14/712,843

(22) Filed: May 14, 2015

(65) Prior Publication Data

US 2015/0332691 A1 Nov. 19, 2015

Related U.S. Application Data

(60) Provisional application No. 61/994,794, filed on May 16, 2014, provisional application No. 62/004,128, filed on May 28, 2014, provisional application No. 62/019,663, filed on Jul. 1, 2014, provisional application No. 62/027,702, filed on Jul. 22, 2014, provisional application No. 62/028,282, filed on Jul.

(Continued)

(51) Int. Cl.
*G10L 19/038* (2013.01)
*G10L 19/008* (2013.01)

(52) U.S. Cl.
CPC ..... *G10L 19/038* (2013.01); *G10L 19/008* (2013.01)

(58) Field of Classification Search
CPC .... G10L 19/038; G10L 19/008; G10L 19/032
See application file for complete search history.

(56) References Cited

U.S. PATENT DOCUMENTS 4,709,340 A 11/1987 Capizzi et al.
5,012,518 A 4/1991 Liu et al.

(Continued)

FOREIGN PATENT DOCUMENTS

CN 102823277 A 12/2012
EP 2234104 A1 9/2010

(Continued)

OTHER PUBLICATIONS

Audio, "Call for Proposals for 3D Audio," International Organisation for Standardisation Organisation Internationale DE Normalisation ISO/IEC JTC1/SC29/WG11 Coding of Moving Jictures and Audio, ISO/IEC JTC1/SC29/WG11/N13411, Geneva, Jan. 2013, 20 pp.

(Continued)

*Primary Examiner* — Tammy Paige Goddard
*Assistant Examiner* — Walter Yehl
(74) *Attorney, Agent, or Firm* — Shumaker & Sieffert, P.A.

(57) ABSTRACT

In general, techniques are described for coding of vectors decomposed from higher-order ambisonic coefficients. A device comprising a memory and a processor may perform the techniques. The memory may be configured to store audio data. The processor may be configured to determine whether to perform vector dequantization or scalar dequantization with respect to a decomposed version of the plurality of HOA coefficients.

20 Claims, 25 Drawing Sheets

Related U.S. Application Data

23, 2014, provisional application No. 62/032,440, filed on Aug. 1, 2014.

(56) References Cited

U.S. PATENT DOCUMENTS

| | | | | |
|---|---|---|---|---|
| 5,757,927 | A | 5/1998 | Gerzon et al. | |
| 5,790,759 | A | 8/1998 | Chen | |
| 5,819,215 | A | 10/1998 | Dobson et al. | |
| 5,821,887 | A | 10/1998 | Zhu | |
| 5,970,443 | A | 10/1999 | Fujii | |
| 6,167,375 | A * | 12/2000 | Miseki | G10L 19/02 704/224 |
| 6,263,312 | B1 | 7/2001 | Kolesnik et al. | |
| 6,370,502 | B1 * | 4/2002 | Wu | G10L 19/0212 704/222 |
| 7,271,747 | B2 | 9/2007 | Baraniuk et al. | |
| 7,822,601 | B2 * | 10/2010 | Mehrotra | G10L 19/032 341/51 |
| 7,920,709 | B1 | 4/2011 | Hickling | |
| 8,160,269 | B2 | 4/2012 | Mao | |
| 8,374,358 | B2 | 2/2013 | Buck et al. | |
| 8,379,868 | B2 | 2/2013 | Goodwin et al. | |
| 8,391,500 | B2 | 3/2013 | Hannemann et al. | |
| 8,570,291 | B2 | 10/2013 | Motomura et al. | |
| 8,817,991 | B2 | 8/2014 | Jaillet et al. | |
| 9,053,697 | B2 | 6/2015 | Park et al. | |
| 9,084,049 | B2 | 7/2015 | Fielder et al. | |
| 9,100,768 | B2 | 8/2015 | Batke et al. | |
| 9,129,597 | B2 | 9/2015 | Bayer et al. | |
| 9,338,574 | B2 | 5/2016 | Jax et al. | |
| 2001/0036286 | A1 | 11/2001 | Layton et al. | |
| 2002/0044605 | A1 | 4/2002 | Nakamura | |
| 2002/0049586 | A1 | 4/2002 | Nishio et al. | |
| 2002/0169735 | A1 | 11/2002 | Kil et al. | |
| 2003/0147539 | A1 | 8/2003 | Elko et al. | |
| 2004/0131196 | A1 | 7/2004 | Malham | |
| 2004/0158461 | A1 | 8/2004 | Ramabadran et al. | |
| 2005/0053130 | A1 | 3/2005 | Jabri et al. | |
| 2005/0074135 | A1 | 4/2005 | Kushibe | |
| 2006/0126852 | A1 | 6/2006 | Bruno et al. | |
| 2006/0282874 | A1 | 12/2006 | Ito et al. | |
| 2007/0094019 | A1 | 4/2007 | Nurminen | |
| 2007/0172071 | A1 | 7/2007 | Mehrotra et al. | |
| 2008/0004729 | A1 | 1/2008 | Hiipakka | |
| 2008/0137870 | A1 | 6/2008 | Nicol et al. | |
| 2008/0306720 | A1 | 12/2008 | Nicol et al. | |
| 2009/0006103 | A1 | 1/2009 | Koishida et al. | |
| 2009/0092259 | A1 | 4/2009 | Jot et al. | |
| 2009/0248425 | A1 | 10/2009 | Vetterli et al. | |
| 2010/0085247 | A1 | 4/2010 | Venkatraman et al. | |
| 2010/0092014 | A1 | 4/2010 | Strauss et al. | |
| 2010/0198585 | A1 | 8/2010 | Mouhssine et al. | |
| 2010/0329466 | A1 | 12/2010 | Berge | |
| 2011/0224995 | A1 | 9/2011 | Kovesi et al. | |
| 2011/0249738 | A1 | 10/2011 | Suzuki et al. | |
| 2011/0249821 | A1 | 10/2011 | Jaillet et al. | |
| 2011/0261973 | A1 | 10/2011 | Nelson et al. | |
| 2011/0305344 | A1 | 12/2011 | Sole et al. | |
| 2012/0014527 | A1 | 1/2012 | Furse | |
| 2012/0093344 | A1 | 4/2012 | Sun et al. | |
| 2012/0128160 | A1 | 5/2012 | Kim et al. | |
| 2012/0155653 | A1 | 6/2012 | Jax et al. | |
| 2012/0163622 | A1 | 6/2012 | Karthik et al. | |
| 2012/0174737 | A1 | 7/2012 | Risan | |
| 2012/0177234 | A1 * | 7/2012 | Rank | G10L 19/04 381/314 |
| 2012/0243692 | A1 | 9/2012 | Ramamoorthy | |
| 2012/0257579 | A1 * | 10/2012 | Li | H04B 7/0626 370/328 |
| 2012/0259442 | A1 | 10/2012 | Jin et al. | |
| 2012/0314878 | A1 | 12/2012 | Daniel et al. | |
| 2013/0028427 | A1 | 1/2013 | Yamamoto et al. | |
| 2013/0041658 | A1 | 2/2013 | Bradley et al. | |
| 2013/0148812 | A1 | 6/2013 | Corteel et al. | |
| 2013/0216070 | A1 * | 8/2013 | Keiler | G10L 19/008 381/300 |
| 2013/0223658 | A1 | 8/2013 | Betlehem et al. | |
| 2013/0320804 | A1 | 12/2013 | Symko et al. | |
| 2014/0016786 | A1 | 1/2014 | Sen | |
| 2014/0023197 | A1 | 1/2014 | Xiang et al. | |
| 2014/0025386 | A1 | 1/2014 | Xiang et al. | |
| 2014/0029758 | A1 | 1/2014 | Nakadai et al. | |
| 2014/0133660 | A1 | 5/2014 | Jax et al. | |
| 2014/0219455 | A1 | 8/2014 | Peters et al. | |
| 2014/0226823 | A1 | 8/2014 | Sen et al. | |
| 2014/0233762 | A1 | 8/2014 | Vilkamo et al. | |
| 2014/0233917 | A1 | 8/2014 | Xiang | |
| 2014/0247946 | A1 | 9/2014 | Sen et al. | |
| 2014/0270245 | A1 | 9/2014 | Elko et al. | |
| 2014/0286493 | A1 | 9/2014 | Kordon et al. | |
| 2014/0307894 | A1 | 10/2014 | Kordon et al. | |
| 2014/0355766 | A1 | 12/2014 | Morrell et al. | |
| 2014/0355769 | A1 | 12/2014 | Peters et al. | |
| 2014/0355770 | A1 | 12/2014 | Peters et al. | |
| 2014/0355771 | A1 | 12/2014 | Peters et al. | |
| 2014/0358266 | A1 | 12/2014 | Peters et al. | |
| 2014/0358557 | A1 | 12/2014 | Sen et al. | |
| 2014/0358558 | A1 | 12/2014 | Sen et al. | |
| 2014/0358559 | A1 | 12/2014 | Sen et al. | |
| 2014/0358560 | A1 | 12/2014 | Sen et al. | |
| 2014/0358561 | A1 | 12/2014 | Sen et al. | |
| 2014/0358562 | A1 | 12/2014 | Sen et al. | |
| 2014/0358563 | A1 | 12/2014 | Sen et al. | |
| 2014/0358564 | A1 | 12/2014 | Sen et al. | |
| 2014/0358565 | A1 | 12/2014 | Peters et al. | |
| 2014/0358567 | A1 | 12/2014 | Koppens et al. | |
| 2015/0098572 | A1 * | 4/2015 | Krueger | G10L 19/008 381/22 |
| 2015/0127354 | A1 | 5/2015 | Peters et al. | |
| 2015/0154965 | A1 | 6/2015 | Wuebbolt et al. | |
| 2015/0154971 | A1 | 6/2015 | Boehm et al. | |
| 2015/0163615 | A1 | 6/2015 | Boehm et al. | |
| 2015/0213803 | A1 | 7/2015 | Peters et al. | |
| 2015/0213805 | A1 | 7/2015 | Peters et al. | |
| 2015/0213809 | A1 | 7/2015 | Peters et al. | |
| 2015/0264483 | A1 | 9/2015 | Morrell et al. | |
| 2015/0264484 | A1 | 9/2015 | Peters et al. | |
| 2015/0287418 | A1 | 10/2015 | Vasilache et al. | |
| 2015/0332679 | A1 | 11/2015 | Kruger et al. | |
| 2015/0332690 | A1 | 11/2015 | Kim | |
| 2015/0332692 | A1 | 11/2015 | Kim | |
| 2015/0341736 | A1 | 11/2015 | Peters et al. | |
| 2015/0358631 | A1 | 12/2015 | Zhang et al. | |
| 2015/0371633 | A1 * | 12/2015 | Chelba | G10L 15/063 704/240 |
| 2015/0380002 | A1 | 12/2015 | Uhle et al. | |
| 2016/0093308 | A1 | 3/2016 | Kim | |
| 2016/0093311 | A1 | 3/2016 | Kim | |
| 2016/0155448 | A1 | 6/2016 | Purnhagen et al. | |
| 2016/0174008 | A1 | 6/2016 | Boehm | |

FOREIGN PATENT DOCUMENTS

| | | | |
|---|---|---|---|
| EP | 2450880 | A1 | 5/2012 |
| EP | 2469741 | A1 | 6/2012 |
| EP | 2665208 | A1 | 11/2013 |
| EP | 2765791 | A1 | 8/2014 |
| EP | 2954700 | A1 | 12/2015 |
| TW | 201514455 | A | 4/2015 |
| WO | 2009046223 | A2 | 4/2009 |
| WO | 2012059385 | A1 | 5/2012 |
| WO | 2014013070 | A1 | 1/2014 |
| WO | 2014122287 | A1 | 8/2014 |
| WO | 2014177445 | A | 11/2014 |
| WO | 2014194099 | A1 | 12/2014 |
| WO | 2015007889 | A2 | 1/2015 |

OTHER PUBLICATIONS

Audio-Subgroup: "WD1-HOA Text of MPEG-H 3D Audio," MPEG Meeting; Jan. 2014; San Jose; (Motion Picture Expert Group or ISO/IEC JTC1/SC29/WG11), No. N14264, XP030021001, 84 pp.

(56) References Cited

OTHER PUBLICATIONS

Boehm, et al., "Scalable Decoding Mode for MPEG-H 3D Audio HOA," MPEG Meeting; Mar. 2014; Valencia; (Motion Picture Expert Group or ISO/IEC JTC1/SC29/WG11), No. m33195, XP030061647, 12 pp.
Boehm, et al., "Detailed Technical Description of 3D Audio Phase 2 Reference Model 0 for HOA technologies", MPEG Meeting; Oct. 2014; Strasbourg; (Motion Picture Expert Group or ISO/IEC JTC1/SC29/WG11), No. m35857, XP030063429, 130 pp.
Boehm, et al., "HOA Decoder—changes and proposed modification," Technicolor, MPEG Meeting; Mar. 2014; Valencia; (Motion Picture Expert Group or ISO/IEC JTC1/SC29/WG11), No. m33196, XP030061648, 16 pp.
Daniel, et al., "Spatial Auditory Blurring and Applications to Multichannel Audio Coding", Jun. 2011, XP055104301, Retrieved from the Internet: URL:http://tel.archives-ouvertes.fr/tel-00623670/en/Chapter 5. "Multichannel audio coding eased on spatial blurring", p. 121-p. 139.
Daniel, et al., "Ambisonics Encoding of Other Audio Formats for Multiple Listening Conditions," Audio Engineering Society Convention 105, Sep. 1998, San Francisco, CA, Paper No. 4795, 29 pp.
Davis, et al., "A Simple and Efficient Method for Real-Time Computation and Transformation of Spherical Harmonic-Based Sound Fields", Proceedings of the AES 133rd Convention, Oct. 2012, 10 pp.
"Information technology—High efficiency coding and media delivery in heterogeneous environments—Part 3: 3D audio," DVB Organization: "ISO-IEC_23008-3_(E)_(DIS of 3DA).docx", DVB, Digital Video Broadcasting, C/0 EBU-17A Ancienne Route-CH-1218 Grand Saconnex, Geneva-Switzerland, Jul. 25, 2014, XP017845569, 431 pp.
Hellerud, et al., "Lossless Compression of Spherical Microphone Array Recordings," AES Convention 126, May 2009, AES, 60 East 42nd Street, Room 2520 New York 10165-2520, USA, May 2009; XP040508950, Section 2, Higher Order Ambisonics; 9 pp.
Gauthier, et al., "Beamforming Regularization,Scaling Matrices and Inverse Problems for Sound Field Extrapolation and Characterization: Part I Theory," Oct. 20-23, 2011, in Audio Engineering Society 131st Convention, New York, USA, 2011, 32 pp.
Gauthier, et al., "Derivation of Ambisonics Signals and Plane Wave Description of Measured Sound Field Using Irregular Microphone Arrays and Inverse Problem Theory," Jun. 2-3, 2011, In Ambisonics Symposium 2011, Lexington, Jun. 2011, 17 pp.
Gerzon, "Ambisonics in Multichannel Broadcasting and Video", Journal of the Audio Engineering Society, Nov. 1985, vol. 33(11), pp. 859-871.
Hagai, et al., "Acoustic centering of sources measured by surrounding spherical microphone arrays", Oct. 2011, In the Journal of the Acoustical Society of America, vol. 130, No. 4, pp. 2003-2015.
Hellerud, et al., "Encoding higher order ambisonics with AAC," Audio Engineering Society—124th Audio Engineering Society Convention 2008, XP040508582, May 2008, 9 pp.
Hellerud, et al., "Spatial redundancy in Higher Order Ambisonics and its use for lowdelay lossless compression", Acoustics, Speech and Signal Processing, 2009, ICASSP 2009, IEEE International Conference On, IEEE, Piscataway, NJ, USA, Apr. 2009, XP031459218, pp. 269-272.
Herre, et al., "MPEG-H 30 Audio—The New Standard for Coding of Immersive Spatial Audio," IEEE Journal of Selected Topics in Signal Processing, vol. 9, No. 5, Aug. 2015, 10 pp.
"Information technology—High efficiency coding and media delivery in heterogeneous environments—Part 3: 3D Audio," ISO/IEC JTC 1/SC 29N, Apr. 4, 2014, 337 pp.
"Information technology—High efficiency coding and media delivery in heterogeneous environments—Part 3: 3D Audio," ISO/IEC JTC 1/SC 29N, Jul. 25, 2005, 311 pp.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.
"Information technology—MPEG audio technologies—Part 3: Unified speech and audio coding," ISO/IEC JTC 1/SC 26/WG 11, Sep. 20, 2011, 291 pp.
International Search Report and Written Opinion from PCT/US2015/031187, dated Jul. 20, 2015, 9 pp.
Malham, "Higher order ambisonic systems for the spatialization of sound", in Proceedings of the International Computer Music Conference, 1999, Beijing, China, pp. 484-487. (Applicant points out that, in accordance with MPEP 609.04(a), the 1999 year of publication is sufficiently earlier than the effective U.S. filing date and any foreign priority date of May 16, 2014 so that the particular month of publication is not in issue.).
Mathews, et al., "Multiplication-Free Vector Quantization Using L1 Distortion Measure and its Variants", Multidimensional Signal Processing, Audio and Electroacoustics, Glasgow, May 23-26, 1989, [International Conference on Acoustics, Speech & Signal Processing, ICASSP], New York, IEEE, US, vol. 3, pp. 1747-1750, XP000089211.
Menzies, "Nearfield synthesis of complex sources with high-order ambisonics, and binaural rendering," Proceedings of the 13th International Conference on Auditory Display, Montreal, Canada, Jun. 26-29, 2007, 8 pp.
Moreau, et al., "3D Sound Field Recording with Higher Order Ambisonics—Objective Measurements and Validation of Spherical Microphone", May 20-23, 2006, Audio Engineering Society Convention Paper 6857, 24 pp.
Painter, et al., "Perceptual Coding of Digital Audio, Proceedings of the IEEE," vol. 88, No. 4, Apr. 2000, pp. 451-513.
Poletti M., "Three-Dimensional Surround Sound Systems Based on Spherical Harmonics," The Journal of the Audio Engineenng Society, Nov. 2005, pp. 1004-1025, vol. 53 (11).
Poletti M., "Unified Description of Ambisonics Using Real and Complex Spherical Harmonics," Ambisonics Symposium, Jun. 25-27, 2009, 10 pp.
Pulkki V., "Spatial Sound Reproduction with Directional Audio Coding," Journal of the Audio Engineering Society, Jun. 2007, vol. 55 (6), pp. 503-516.
Rafaely, "Spatial alignment of acoustic sources based on spherical harmonics radiation analysis," in Communications, Control and Signal Processing (ISCCSP), 2010 4th International Symposium on , vol. No., Mar. 3-5, 2010, 5 pp.
Wabnitz, et al., "Upscaling ambisonic Sound Scenes Using Compressed Sensing Techniques," 2011 IEEE Workshop on Applications of Signal Processing to Audio and Acoustics, Oct. 16-19, 2011, 4 pp.
Sen, et al., "Differences and Similarities in Formats for Scene Based Audio," ISO/IEC JTC1/SC29/WG11 MPEG2012/M26704, Oct. 2012, Shanghai, China, 7 pp.
Sen, et al., "RM1-HOA Working Draft Text", MPEG Meeting; Jan. 13-17, 2014; San Jose; (Motion Picture Expert Group or ISO/IEC JTC1/SC29/WG11), No. m31827, XP030060280, 83 pp.
Wabnitz, et al., "A frequency-domain algorithm to upscale ambisonic sound scenes", 2012 IEEE International Conference on Acoustics, Speech and Signal Processing (ICASSP 2012) : Kyoto, Japan, [Proceedings], IEEE, Piscataway, NJ, Mar. 25, 2012, XP032227141, pp. 385-388.
Wabnitz et al., "Time domain reconstruction of spatial sound fields using compressed sensing ", Acoustics, Speech and Signal Processing (ICASSP), 2011 IEEE International Conference on, IEEE, May 22, 2011, XP032000775, pp. 465-468.
Zotter, F., et al., "Comparison of energy-preserving and all-round Ambisonic decoders," Mar. 18-21 2013, 4 pages.
Masgrau, et al., "Predictive SVD-Transform Coding of Speech with Adaptive Vector Quantization," Apr. 1991, IEEE, pp. 3681-3684.
Conlin, "Interpolation of Data Points on a Sphere: Spherical Harmonics as Basis Functions," Feb. 28, 2012, 6 pp.
Daniel, et al., "Multichannel Audio Coding Based on Minimum Audible Angles", Proceedings of 40th International Conference: Spatial Audio: Sense the Sound of Space, Jan. 2010, 10 pp.
Rockway, et al., "Interpolating Spherical Harmonics for Computing Antenna Patterns," Systems Center Pacific, Technical Report 1999, Jul. 2011, 40 pp.

(56) References Cited

OTHER PUBLICATIONS

Ruffini, et al., "Spherical Harmonics Interpolation, Computation of Laplacians and Gauge Theory," Starlab Research Knowledge, Oct. 25, 2001, 16 pp.
Nishimura., "Audio Information Hiding Based on Spatial Masking", Intelligent Information Hiding and Multimedia Signal Processing (IIH-MSP), 2010 Sixth International Conference on, IEEE, Piscataway, NJ, USA, Oct. 15, 2010, pp. 522-525 XP031801765.
Sayood, et al., "Application to Image Compression—JPEG," Introduction to Data Compression, Third Edition, Dec. 15, 2005, Chapter 13.6, 11 pp.
Solvang, et al., "Quantization of 2D Higher Order Ambisoncs Wave Fields," In the 124th AES Conv, May 17-20, 2008, 9 pp.
Stohl, et al., "An Intercomparison of Results from Three Trajectory Models," Meteorological Applications, Jun. 2001, pp. 127-135.
Nelson et al., "Spherical Harmonics, Singular-Value Decomposition and the Head-Related Transfer Function," Aug. 29, 2000, ISVR University of Southampton, pp. 607-637.
Bosi et al, "ISO/IEC MPEG-2 Advanced Audio Coding", 1996, In 101st AES Convention, Los Angeles, Nov. 1996, 43 pp.
Geiser, et al., "Steganographic Packet Loss Concealment for Wireless VoIP", ITG Conference on Voice communication (SprachKommunikation), Oct. 8, 2008, 4 pp.
Huang, et al., "Interpolation of head-related transfer functions using spherical Fourier expansion", Journal of Electronics (China), Jul. 2009, vol. 26, Issue 4, pp. 571-576.
ISO/IEC/JTC: "ISO/IEC JTC 1/SC 29 N ISO/IEC CD 23008-3 Information technology—High efficiency coding and media delivery in heterogeneous environments—Part 3: 3D audio," Apr. 4, 2014 (Apr. 4, 2014), XP055206371, Retrieved from the Internet: URL:http://www.iso.org/iso/iso_catalogue/catalogue_tc/catalogue_tc_browse.htm?commid=45316 [retrieved on Aug. 5, 2015].
Johnston et al, "AT&T perceptual Audio Coding (PAC)," 1996, In Collected Papers on Digital Audio Bit-Rate Reduction pp. 73-82, Feb. 13, 1996.
Lincoln: "An experimental high fidelity perceptual audio coder", In Project in MUS420 Win97, Mar. 1998, 19 pp.
"Information technology—High efficiency coding and media delivery in heterogeneous environments—Part 3: 3D Audio," ISO/IEC JTC 1/SC 29, Jul. 25, 2014, 433 pp.
U.S. Appl. No. 15/247,244, filed by Nils Gunther Peters, filed Aug. 25, 2016.
U.S. Appl. No. 15/247,364, filed by Nils Gunther Peters, filed Aug. 25, 2016.
U.S. Appl. No. 15/290,181, filed by Nils Gunther Peters, filed Oct. 11, 2016.
U.S. Appl. No. 15/290,206, filed by Nils Gunther Peters, filed Oct. 11, 2016.
U.S. Appl. No. 15/290,214, filed by Nils Gunther Peters, filed Oct. 11, 2016.

* cited by examiner

5th order model $\sum_{j=1}^{5} \hat{\omega}_j \Omega_j$ $H = USV^T$

| Test Item # | Test Items | Bits/frame | Bit rate (kbps) | Other method |
|---|---|---|---|---|
| 1 | H_01_SynthBumbleBee | (6 bit - HOA selection + 8 bit - weighting Quant)* 2 vectors = 28 | 1.40 | 30.46 |
| 2 | H_02_Drums1 | (5 + 8) * 5 = 65 | 3.25 | 21.89 |
| 3 | H_03_Modern | (5 + 8) * 2 = 26 | 1.30 | 19.35 |
| 4 | H_04_Stadium2 | (5 + 8) * 5 = 65 | 3.25 | 14.70 |
| 5 | H_05_Water | (5 + 8) * 5 = 65 | 3.25 | 14.73 |
| 6 | H_06_Helicopter | (5 + 8) * 5 = 65 | 3.25 | 14.76 |
| 7 | H_07_Vocal1 | (5 + 8) * 5 = 65 | 3.25 | 14.86 |
| 8 | H_08_BeginningOfAConcert | (5 + 8) * 2 = 26 | 1.30 | 14.71 |
| 9 | H_09_ModernElectronicMusic | (5 + 8) * 5 = 65 | 1.30 | 10.83 |
| 10 | H_10_Orchestra2 | (5 + 8) * 5 = 65 | 3.25 | 14.82 |
| 11 | H_11_ShoutingAudience | (5 + 8) * 5 = 65 | 3.25 | 14.78 |
| 12 | H_12_Radio2 | (4 + 8) * 5 = 60 | 3.00 | 9.15 |
| | Average | **55** | **2.75 kbps** | 16.25 kbps |

FIG. 15

DETERMINING BETWEEN SCALAR AND VECTOR QUANTIZATION IN HIGHER ORDER AMBISONIC COEFFICIENTS

This application claims the benefit of the following U.S. Provisional applications:

U.S. Provisional Application No. 61/994,794, filed May 16, 2014, entitled "CODING V-VECTORS OF A DECOMPOSED HIGHER ORDER AMBISONICS (HOA) AUDIO SIGNAL;"

U.S. Provisional Application No. 62/004,128, filed May 28, 2014, entitled "CODING V-VECTORS OF A DECOMPOSED HIGHER ORDER AMBISONICS (HOA) AUDIO SIGNAL;"

U.S. Provisional Application No. 62/019,663, filed Jul. 1, 2014, entitled "CODING V-VECTORS OF A DECOMPOSED HIGHER ORDER AMBISONICS (HOA) AUDIO SIGNAL;"

U.S. Provisional Application No. 62/027,702, filed Jul. 22, 2014, entitled "CODING V-VECTORS OF A DECOMPOSED HIGHER ORDER AMBISONICS (HOA) AUDIO SIGNAL;"

U.S. Provisional Application No. 62/028,282, filed Jul. 23, 2014, entitled "CODING V-VECTORS OF A DECOMPOSED HIGHER ORDER AMBISONICS (HOA) AUDIO SIGNAL;"

U.S. Provisional Application No. 62/032,440, filed Aug. 1, 2014, entitled "CODING V-VECTORS OF A DECOMPOSED HIGHER ORDER AMBISONICS (HOA) AUDIO SIGNAL;" each of foregoing listed U.S. Provisional applications is incorporated by reference as if set forth in their respective entirety herein.

TECHNICAL FIELD

This disclosure relates to audio data and, more specifically, coding of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for efficiently representing v-vectors (which may represent spatial information, such as width, shape, direction and location, of an associated audio object) of a decomposed higher order ambisonics (HOA) audio signal based on a set of code vectors. The techniques may involve decomposing the v-vector into a weighted sum of code vectors, selecting a subset of a plurality of weights and corresponding code vectors, quantizing the selected subset of the weights, and indexing the selected subset of code vectors. The techniques may provide improved bit-rates for coding HOA audio signals.

In one aspect, a method of obtaining a plurality of higher order ambisonic (HOA) coefficients, the method comprises obtaining from a bitstream data indicative of a plurality of weight values that represent a vector that is included in decomposed version of the plurality of HOA coefficients. Each of the weight values correspond to a respective one of a plurality of weights in a weighted sum of code vectors that represents the vector that includes a set of code vectors. The method further comprising reconstructing the vector based on the weight values and the code vectors.

In another aspect, a device configured to obtain a plurality of higher order ambisonic (HOA) coefficients, the device comprises one or more processors configured to obtain from a bitstream data indicative of a plurality of weight values that represent a vector that is included in a decomposed version of the plurality of HOA coefficients. Each of the weight values correspond to a respective one of a plurality of weights in a weighted sum of code vectors that represents the vector and that includes a set of code vectors. The one or more processors further configured to reconstruct the vector based on the weight values and the code vectors. The device also comprising a memory configured to store the reconstructed vector.

In another aspect, a device configured to obtain a plurality of higher order ambisonic (HOA) coefficients, the device comprises means for obtaining from a bitstream data indicative of a plurality of weight values that represent a vector that is included in decomposed version of the plurality of HOA coefficients, each of the weight values corresponding to a respective one of a plurality of weights in a weighted sum of code vectors that represents the vector that includes a set of code vectors, and means for reconstructing the vector based on the weight values and the code vectors.

In another aspect, a non-transitory computer-readable storage medium has stored thereon instructions that, when executed, cause one or more processors to obtaining from a bitstream data indicative of a plurality of weight values that represent a vector that is included in decomposed version of a plurality of higher order ambisonic (HOA) coefficients, each of the weight values corresponding to a respective one of a plurality of weights in a weighted sum of code vectors that represents the vector that includes a set of code vectors, and reconstruct the vector based on the weight values and the code vectors.

In another aspect, a method comprises determining, based on a set of code vectors, one or more weight values that represent a vector that is included in a decomposed version of a plurality of higher order ambisonic (HOA) coefficients, each of the weight values corresponding to a respective one of a plurality of weights included in a weighted sum of the code vectors that represents the vector.

In another aspect, a device comprises a memory configured to store a set of code vectors, and one or more processors configured to determine, based on the set of code vectors, one or more weight values that represent a vector that is included in a decomposed version of a plurality of higher order ambisonic (HOA) coefficients, each of the weight values corresponding to a respective one of a plurality of weights included in a weighted sum of the code vectors that represents the vector.

In another aspect, an apparatus comprises means for performing a decomposition with respect to a plurality of higher order ambisonic (HOA) coefficients to generate a decomposed version of the HOA coefficients. The apparatus further comprises means for determining, based on a set of code vectors, one or more weight values that represent a vector that is included in the decomposed version of the HOA coefficients, each of the weight values corresponding to a respective one of a plurality of weights included in a weighted sum of the code vectors that represents the vector.

In another aspect, a non-transitory computer-readable storage medium has stored thereon instructions that, when executed, cause one or more processors to determine, based on a set of code vectors, one or more weight values that represent a vector that is included in a decomposed version of a plurality of higher order ambisonic (HOA) coefficients, each of the weight values corresponding to a respective one of a plurality of weights included in a weighted sum of the code vectors that represents the vector.

In another aspect, a method of decoding audio data indicative of a plurality of higher-order ambisonic (HOA) coefficients, the method comprises determining whether to perform vector dequantization or scalar dequantization with respect to a decomposed version of the plurality of HOA coefficients.

In another aspect, a device configured to decode audio data indicative of a plurality of higher-order ambisonic (HOA) coefficients, the device comprises a memory configured to store the audio data, and one or more processors configured to determine whether to perform vector dequantization or scalar dequantization with respect to a decomposed version of the plurality of HOA coefficients.

In another aspect, a method of encoding audio data, the method comprises determining whether to perform vector quantization or scalar quantization with respect to a decomposed version of a plurality of higher order ambisonic (HOA) coefficients.

In another aspect, a method of decoding audio data, the method comprises selecting one of a plurality of codebooks to use when performing vector dequantization with respect to a vector quantized spatial component of a soundfield, the vector quantized spatial component obtained through application of a decomposition to a plurality of higher order ambisonic coefficients.

In another aspect, a device comprises a memory configured to store a plurality of codebooks to use when performing vector dequantization with respect to a vector quantized spatial component of a soundfield, the vector quantized spatial component obtained through application of a decomposition to a plurality of higher order ambisonic coefficients, and one or more processors configured to select one of the plurality of codebooks.

In another aspect, a device comprises means for storing a plurality of codebooks to use when performing vector dequantization with respect to a vector quantized spatial component of a soundfield, the vector quantized spatial component obtained through application of a decomposition to a plurality of higher order ambisonic coefficients, and means for selecting one of the plurality of codebooks.

In another aspect, a non-transitory computer-readable storage medium has stored thereon instructions that, when executed, cause one or more processors to select one of a plurality of codebooks to use when performing vector dequantization with respect to a vector quantized spatial component of a soundfield, the vector quantized spatial component obtained through application of a decomposition to a plurality of higher order ambisonic coefficients.

In another aspect, a method of encoding audio data, the method comprises selecting one of a plurality of codebooks to use when performing vector quantization with respect to a spatial component of a soundfield, the spatial component obtained through application of a decomposition to a plurality of higher order ambisonic coefficients.

In another aspect, a device comprises a memory configured to store a plurality of codebooks to use when performing vector quantization with respect to a spatial component of a soundfield, the spatial component obtained through application of a decomposition to a plurality of higher order ambisonic coefficients. The device also comprises one or more processors configured to select one of the plurality of codebooks.

In another aspect, a device comprises means for storing a plurality of codebooks to use when performing vector quantization with respect to a spatial component of a soundfield, the spatial component obtained through application of a vector-based synthesis to a plurality of higher order ambisonic coefficients, and means for selecting one of the plurality of codebooks.

In another aspect, a non-transitory computer-readable storage medium has stored thereon instructions that, when executed, cause one or more processors to select one of a plurality of codebooks to use when performing vector quantization with respect to a spatial component of a soundfield, the spatial component obtained through application of a vector-based synthesis to a plurality of higher order ambisonic coefficients.

The details of one or more aspects of the techniques are set forth in the accompanying drawings and the description below. Other features, objects, and advantages of the techniques will be apparent from the description and drawings, and from the claims.

BRIEF DESCRIPTION OF DRAWINGS

FIG. 15 is a chart illustrating example performance improvements that may be obtained by using the v-vector coding techniques of this disclosure.

DETAILED DESCRIPTION

Figure 1:
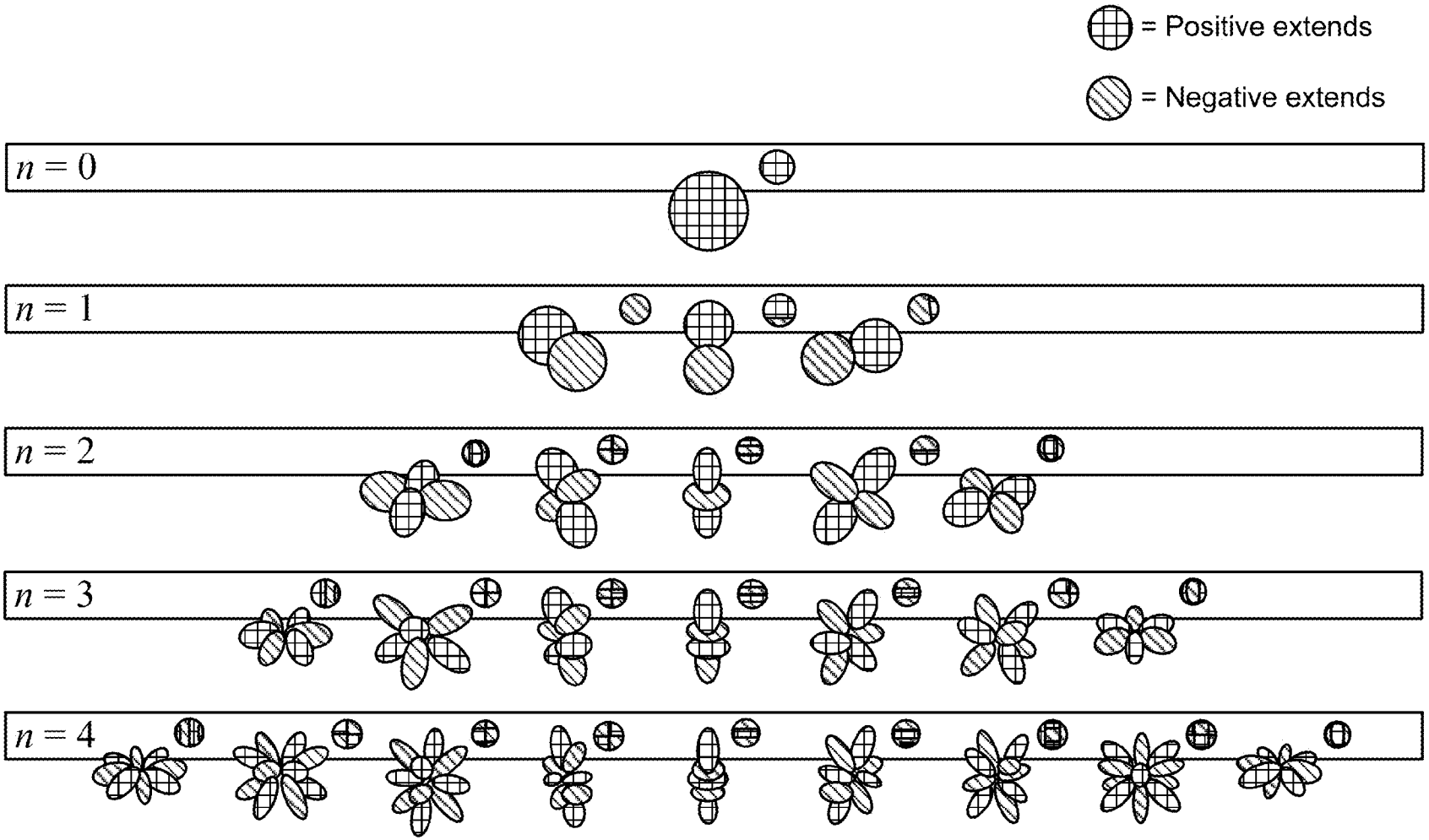
FIG. 1 is a diagram illustrating spherical harmonic basis functions of various orders and sub-orders.

In general, techniques are described for efficiently representing v-vectors (which may represent spatial information, such as width, shape, direction and location, of an associated audio object) of a decomposed higher order ambisonics (HOA) audio signal based on a set of code vectors. The techniques may involve decomposing the v-vector into a weighted sum of code vectors, selecting a subset of a plurality of weights and corresponding code vectors, quantizing the selected subset of the weights, and indexing the selected subset of code vectors. The techniques may provide improved bit-rates for coding HOA audio signals.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \phi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \phi p_r\}$ is a point of reference (or observation point), $j_n(\bullet)$ is the spherical Bessel function of order n, and $Y_n^m(\theta_r,\phi_r)$ are the spherical harmonic basis functions of order n and suborder m. It can be recognized that the term in square brackets is a frequency-domain representation of the signal (i.e., $S(\omega,r_r,\theta_r,\phi_r)$) which can be approximated by various time-frequency transformations, such as the discrete Fourier transform (DFT), the discrete cosine transform (DCT), or a wavelet transform.

Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\phi_s),$$

where i is $\sqrt{-1}$, $h_n^{(2)}(\bullet)$ is the spherical Hankel function (of the second kind) of order n, and $\{r_s, \theta_s, \phi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \phi_r\}$. The remaining figures are described below in the context of object-based and SHC-based audio coding.

Figure 2:
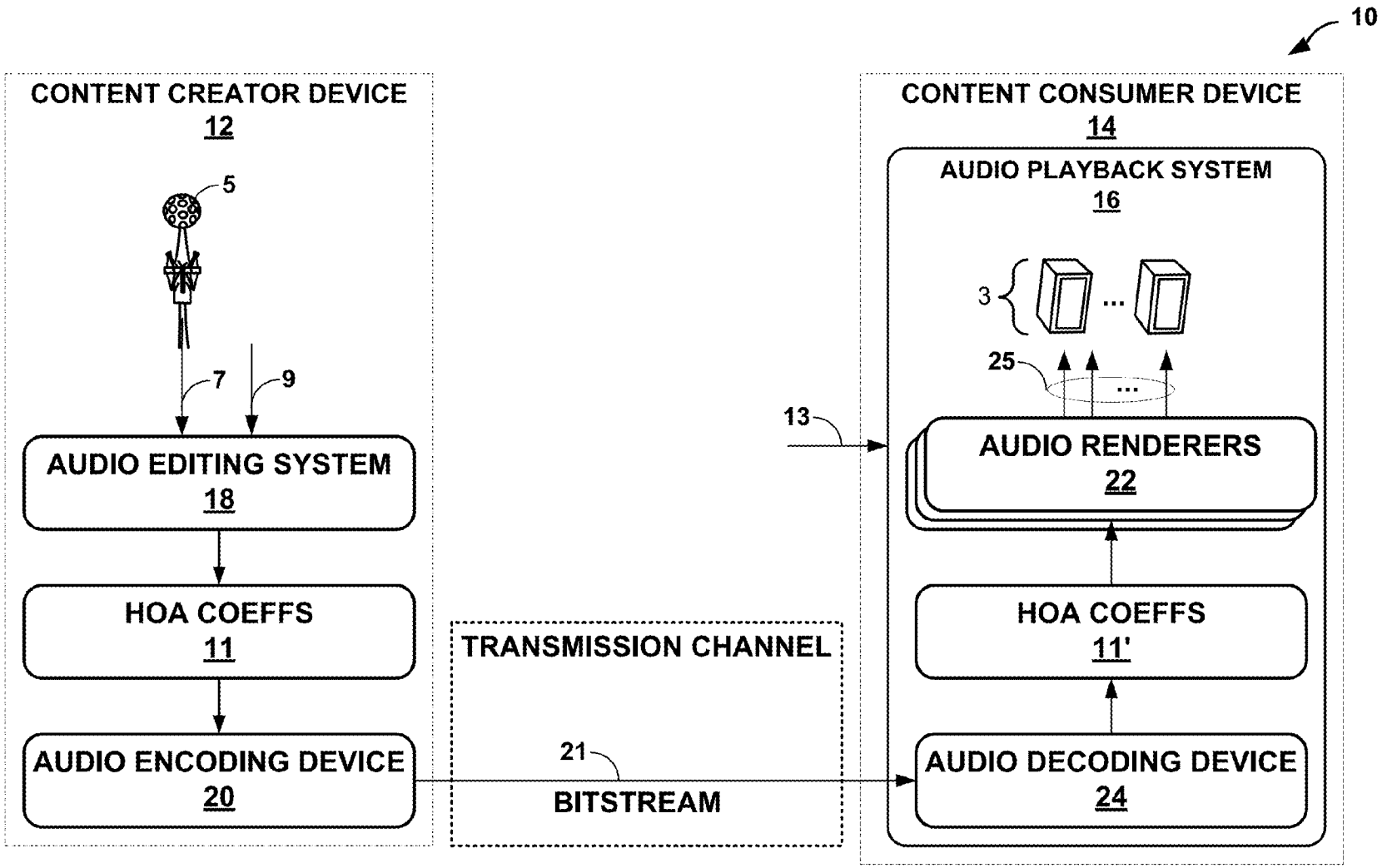
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of content consumer devices, such as the content consumer device 14. In some examples, the content creator device 12 may be operated by an individual user who would like to compress HOA coefficients 11. Often, the content creator generates audio content in conjunction with video content. The content consumer device 14 may be operated by an individual. The content consumer device 14 may include an audio playback system 16, which may refer to any form of audio playback system capable of rendering SHC for play back as multi-channel audio content.

The content creator device 12 includes an audio editing system 18. The content creator device 12 obtain live recordings 7 in various formats (including directly as HOA coefficients) and audio objects 9, which the content creator device 12 may edit using audio editing system 18. A microphone 5 may capture the live recordings 7. The content creator may, during the editing process, render HOA coefficients 11 from audio objects 9, listening to the rendered speaker feeds in an attempt to identify various aspects of the soundfield that require further editing. The content creator device 12 may then edit HOA coefficients 11 (potentially indirectly through manipulation of different ones of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers (which are not shown in the example of FIG. 2 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22. One or more speakers 3 may then playback the rendered loudspeaker feeds 25.

Figure 3A:
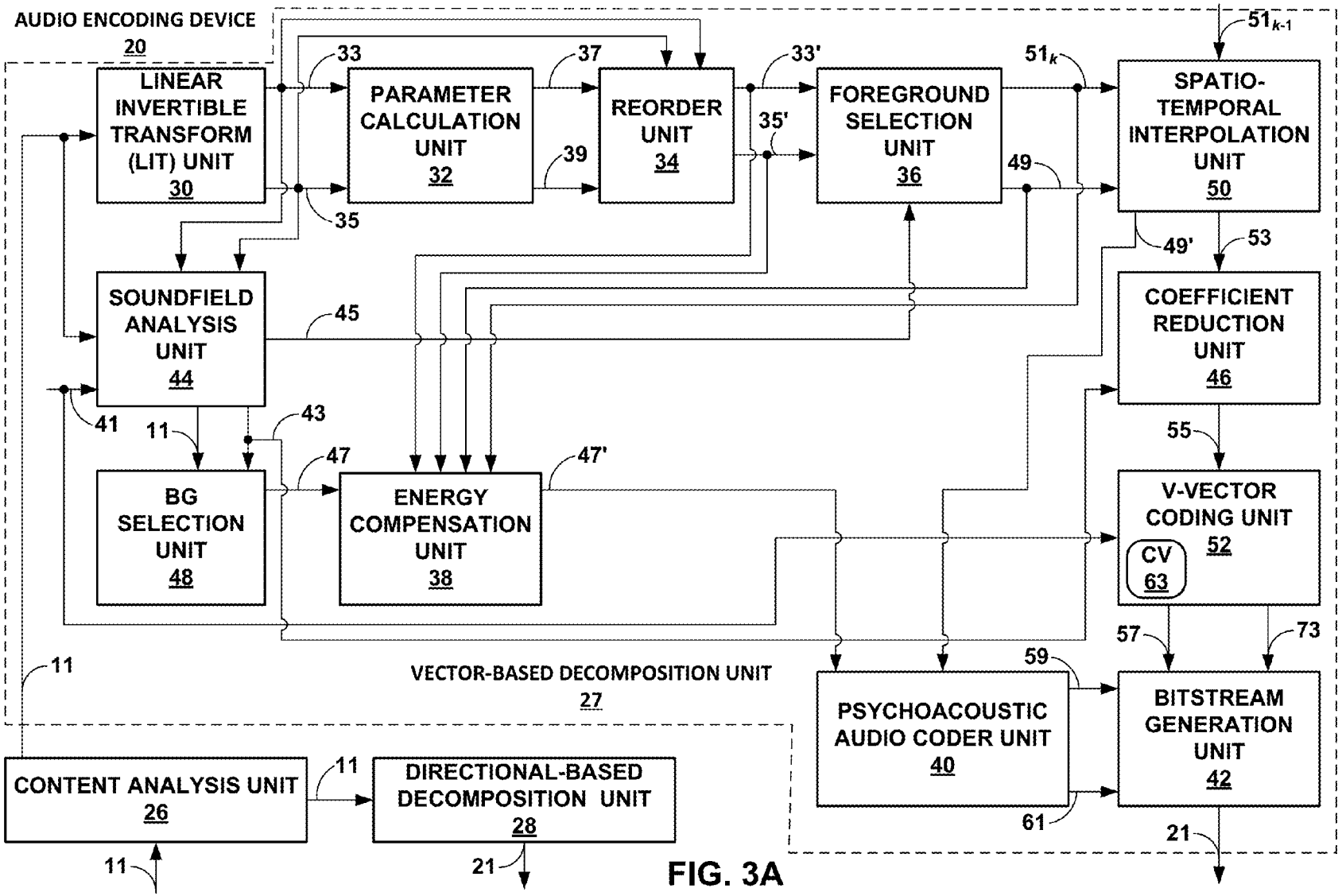
FIGS. 3A and 3B are block diagrams illustrating, in more detail, different examples of the audio encoding device shown in the example of FIG. 2 that may perform various aspects of the techniques described in this disclosure.

FIG. 3A is a block diagram illustrating, in more detail, one example of the audio encoding device 20 shown in the example of FIG. 2 that may perform various aspects of the techniques described in this disclosure. The audio encoding device 20 includes a content analysis unit 26, a vector-based decomposition unit 27 and a directional-based decomposition unit 28. Although described briefly below, more information regarding the audio encoding device 20 and the various aspects of compressing or otherwise encoding HOA coefficients is available in International Patent Application Publication No. WO 2014/194099, entitled "INTERPOLATION FOR DECOMPOSED REPRESENTATIONS OF A SOUND FIELD," filed 29 May 2014.

The content analysis unit 26 represents a unit configured to analyze the content of the HOA coefficients 11 to identify whether the HOA coefficients 11 represent content generated from a live recording or an audio object. The content analysis unit 26 may determine whether the HOA coefficients 11 were generated from a recording of an actual soundfield or from an artificial audio object. In some instances, when the framed HOA coefficients 11 were generated from a recording, the content analysis unit 26 passes the HOA coefficients 11 to the vector-based decomposition unit 27. In some instances, when the framed HOA coefficients 11 were generated from a synthetic audio object, the content analysis unit 26 passes the HOA coefficients 11 to the directional-based synthesis unit 28. The directional-based synthesis unit 28 may represent a unit configured to perform a directional-based synthesis of the HOA coefficients 11 to generate a directional-based bitstream 21.

As shown in the example of FIG. 3A, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40, a bitstream generation unit 42, a soundfield analysis unit 44, a coefficient reduction unit 46, a background (BG) selection unit 48, a spatio-temporal interpolation unit 50, and a V-vector coding unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

The LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set." An alternative transformation may comprise a principal component analysis, which is often referred to as "PCA." Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multichannel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3A, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed $v(k)$.

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$). The individual elements of each of $v^{(i)}(k)$ vectors may represent an HOA coefficient describing the shape (including width) and position of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients.

The parameter calculation unit 32 represents a unit configured to calculate various parameters, such as a correlation parameter (R), directional properties parameters ($\theta$, $\phi$, r), and an energy property (e). Each of the parameters for the current frame may be denoted as R[k], $\theta$[k], $\phi$[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], $\theta$[k−1], $\phi$[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield (nBGa=(MinAmbHOAorder+1)$^2$), and indices (i) of additional BG HOA channels to send (which may collectively be denoted as background channel information 43 in the example of FIG. 3A). The background channel information 42 may also be referred to as ambient channel information 43. Each of the channels that remains from numHOATransportChannels—nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by (MinAmbHOAorder+1)$^2$+the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of which of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1, hence the audio encoding device may only need to indicate one of the additional ambient HOA coefficient having an index of 5-25. The information could thus be sent using a 5 bits syntax element (for 4$^{th}$ order content), which may be denoted as "CodedAmbCoeffIdx." In any event, the soundfield analysis unit 44 outputs the background channel information 43 and the HOA coefficients 11 to the background (BG) selection unit 36, the background channel information 43 to coefficient reduction unit 46 and the bitstream generation unit 42, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIGS. 4A and 4B, to parse the background HOA coefficients 47 from the bitstream 21. The background selection unit 48 may then output the ambient HOA coefficients 47 to the energy compensation unit 38. The ambient HOA coefficients 47 may have dimensions D: M×[$(N_{BG}+1)^2$+nBGa]. The ambient HOA coefficients 47 may also be referred to as "ambient HOA coefficients 47," where each of the ambient HOA coefficients 47 corresponds to a separate ambient HOA channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2$× nFG.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the psychoacoustic audio coder unit 40.

The spatio-temporal interpolation unit 50 may represent a unit configured to receive the foreground V[k] vectors $\mathbf{51}_k$ for the k$^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $51_k$. The foreground V[k] vectors $51_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the psychoacoustic audio coder unit 46 and the interpolated foreground V[k] vectors $51_k$ to the coefficient reduction unit 46.

The coefficient reduction unit 46 may represent a unit configured to perform coefficient reduction with respect to the remaining foreground V[k] vectors 53 based on the background channel information 43 to output reduced foreground V[k] vectors 55 to the V-vector coding unit 52. The reduced foreground V[k] vectors 55 may have dimensions D: $[(N+1)^2-(N_{BG}+1)^2-BG_{TOT}]\times nFG$. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$.

The V-vector coding unit 52 may represent a unit configured to perform any form of quantization to compress the reduced foreground V[k] vectors 55 to generate coded foreground V[k] vectors 57, outputting the coded foreground V[k] vectors 57 to the bitstream generation unit 42. In operation, the V-vector coding unit 52 may represent a unit configured to compress a spatial component of the soundfield, i.e., one or more of the reduced foreground V[k] vectors 55 in this example. The V-vector coding unit 52 may perform any one of the following 12 quantization modes, as indicated by a quantization mode syntax element denoted "NbitsQ":

| NbitsQ value | Type of Quantization Mode |
|---|---|
| 0-3: | Reserved |
| 4: | Vector Quantization |
| 5: | Scalar Quantization without Huffman Coding |
| 6: | 6-bit Scalar Quantization with Huffman Coding |
| 7: | 7-bit Scalar Quantization with Huffman Coding |
| 8: | 8-bit Scalar Quantization with Huffman Coding |
| . . . | . . . |
| 16: | 16-bit Scalar Quantization with Huffman Coding |

The V-vector coding unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The V-vector coding unit 52 may then quantize the difference between the elements or weights of the current frame and previous frame rather than the value of the element of the V-vector of the current frame itself.

The V-vector coding unit 52 may perform multiple forms of quantization with respect to each of the reduced foreground V[k] vectors 55 to obtain multiple coded versions of the reduced foreground V[k] vectors 55. The V-vector coding unit 52 may select the one of the coded versions of the reduced foreground V[k] vectors 55 as the coded foreground V[k] vector 57. The V-vector coding unit 52 may, in other words, select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure.

In some examples, the V-vector coding unit 52 may select a quantization mode from a set of quantization modes that includes a vector quantization mode and one or more scalar quantization modes, and quantize an input V-vector based on (or according to) the selected mode. The V-vector coding unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the bitstream generation unit 52 as the coded foreground V[k] vectors 57. The V-vector coding unit 52 may also provide the syntax elements indicative of the quantization mode (e.g., the NbitsQ syntax element) and any other syntax elements used to dequantize or otherwise reconstruct the V-vector.

With regard to vector quantization, the v-vector coding unit 52 may code the reduced foreground V[k] vectors 55 based on the code vectors 63 to generate coded V[k] vectors. As shown in FIG. 3A, the v-vector coding unit 52 may in some examples, output coded weights 57 and indices 73. The coded weights 57 and the indices 73, in such examples, may together represent the coded V[k] vectors. The indices 73 may represent which code vectors in a weighted sum of coding vectors corresponds to each of the weights in the coded weights 57.

To code the reduced foreground V[k] vectors 55, the v-vector coding unit 52 may, in some examples, decompose each of the reduced foreground V[k] vectors 55 into a weighted sum of code vectors based on the code vectors 63. The weighted sum of code vectors may include a plurality of weights and a plurality of code vectors, and may represent the sum of the products of each of the weights may be multiplied by a respective one of the code vectors. The plurality of code vectors included in the weighted sum of the code vectors may correspond to the code vectors 63 received by the v-vector coding unit 52. Decomposing one of the reduced foreground V[k] vectors 55 into a weighted sum of code vectors may involve determining weight values for one or more of the weights included in the weighted sum of code vectors.

After determining the weight values that correspond to the weights included in the weighted sum of code vectors, the v-vector coding unit 52 may code one or more of the weight values to generate the coded weights 57. In some examples, coding the weight values may include quantizing the weight values. In further examples, coding the weight values may include quantizing the weight values and performing Huffman coding with respect to the quantized weight values. In additional examples, coding the weight values may include coding one or more of the weight values, data indicative of the weight values, the quantized weight values, data indicative of the quantized weight values using any coding technique.

In some examples, the code vectors 63 may be a set of orthonormal vectors. In further examples, the code vectors 63 may be a set of pseudo-orthonormal vectors. In additional examples, the code vectors 63 may be one or more of the following: a set of directional vectors, a set of orthogonal directional vectors, a set of orthonormal directional vectors, a set of pseudo-orthonormal directional vectors, a set of pseudo-orthogonal directional vectors, a set of directional basis vectors, a set of orthogonal vectors, a set of pseudo-orthogonal vectors, a set of spherical harmonic basis vectors, a set of normalized vectors, and a set of basis vectors. In examples where the code vectors 63 include directional vectors, each of the directional vectors may have a directionality that corresponds to a direction or directional radiation pattern in 2D or 3D space.

In some examples, the code vectors 63 may be a predefined and/or predetermined set of code vectors 63. In additional examples, the code vectors may be independent of the underlying HOA soundfield coefficients and/or not be generated based on the underlying HOA soundfield coefficients. In further examples, the code vectors 63 may be the same when coding different frames of HOA coefficients. In additional examples, the code vectors 63 may be different when coding different frames of HOA coefficients. In additional examples, the code vectors 63 may be alternatively referred to as codebook vectors and/or candidate code vectors.

In some examples, to determine the weight values corresponding to one of the reduced foreground V[k] vectors 55, the v-vector coding unit 52 may, for each of the weight values in the weighted sum of code vectors, multiply the reduced foreground V[k] vector by a respective one of the code vectors 63 to determine the respective weight value. In some cases, to multiply the reduced foreground V[k] vector by the code vector, the v-vector coding unit 52 may multiply the reduced foreground V[k] vector by a transpose of the respective one of the code vectors 63 to determine the respective weight value.

To quantize the weights, the v-vector coding unit 52 may perform any type of quantization. For example, the v-vector coding unit 52 may perform scalar quantization, vector quantization, or matrix quantization with respect to the weight values.

In some examples, instead of coding all of the weight values to generate the coded weights 57, the v-vector coding unit 52 may code a subset of the weight values included in the weighted sum of code vectors to generate the coded weights 57. For example, the v-vector coding unit 52 may quantize a set of the weight values included in the weighted sum of code vectors. A subset of the weight values included in the weighted sum of code vectors may refer to a set of weight values that has a number of weight values that is less than the number of weight values in the entire set of weight values included in the weighted sum of code vectors.

In some example, the v-vector coding unit 52 may select a subset of the weight values included in the weighted sum of code vectors to code and/or quantize based on various criteria. In one example, the integer N may represent the total number of weight values included in the weighted sum of code vectors, and the v-vector coding unit 52 may select the M greatest weight values (i.e., maxima weight values) from the set of N weight values to form the subset of the weight values where M is an integer less than N. In this way, the contributions of code vectors that contribute a relatively large amount to the decomposed v-vector may be preserved, while the contributions of code vectors that contribute a relatively small amount to the decomposed v-vector may be discarded to increase coding efficiency. Other criteria may also be used to select the subset of the weight values for coding and/or quantization.

In some examples, the M greatest weight values may be the M weight values from the set of N weight values that have the greatest value. In further examples, the M greatest weight values may be the M weight values from the set of N weight values that have the greatest absolute value.

In examples where the v-vector coding unit 52 codes and/or quantizes a subset of the weight values, the coded weights 57 may include data indicative of which of the weight values were selected for quantizing and/or coding in addition to quantized data indicative of the weight values. In some examples, the data indicative of which of the weight values were selected for quantizing and/or coding may include one or more indices from a set of indices that correspond to the code vectors in the weighted sum of code vectors. In such examples, for each of the weights that were selected for coding and/or quantization, an index value of the code vector that corresponds to the weight value in the weighted sum of code vectors may be included in the bitstream.

In some examples, each of the reduced foreground V[k] vectors 55 may be represented based on the following expression:

$$V_{FG} \approx \sum_{j=1}^{25} \omega_j \Omega_j \tag{1}$$

where $\Omega_1$ represents the jth code vector in a set of code vectors ($\{\Omega_j\}$), $\omega_j$ represents the jth weight in a set of weights ($\{\omega_j\}$), and $V_{FG}$ corresponds to the v-vector that is being represented, decomposed, and/or coded by the v-vector coding unit 52. The right hand side of expression (1) may represent a weighted sum of code vectors that includes a set of weights ($\{\omega_j\}$) and a set of code vectors ($\{\Omega_j\}$).

In some examples, the v-vector coding unit 52 may determine the weight values based on the following equation:

$$\omega_k = V_{FG}\Omega_k^T \tag{2}$$

where $\Omega_k^T$ represents a transpose of the kth code vector in a set of code vectors ($\{\Omega_k\}$), $V_{FG}$ corresponds to the v-vector that is being represented, decomposed, and/or coded by the v-vector coding unit 52, and $\omega_k$ represents the jth weight in a set of weights ($\{\omega_k\}$).

In examples where the set of code vectors ($\{\Omega_j\}$) is orthonormal, the following expression may apply:

$$\Omega_j\Omega_k^T = \begin{cases} 1 & \text{for } j = k \\ 0 & \text{for } j \neq k \end{cases} \tag{3}$$

In such examples, the right-hand side of equation (2) may simplify as follows:

$$V_{FG}\Omega_k^T \approx \left(\sum_{j=1}^{25} \omega_j \Omega_j\right)\Omega_k^T = \omega_k \tag{4}$$

where $\omega_k$ corresponds to the kth weight in the weighted sum of code vectors.

For the example weighted sum of code vectors used in equation (1), the v-vector coding unit 52 may calculate the weight values for each of the weights in the weighted sum of code vectors using equation (2) and the resulting weights may be represented as:

$$\{\omega_k\}_{k-1,\ldots,25} \tag{5}$$

Consider an example where the v-vector coding unit 52 selects the five maxima weight values (i.e., weights with greatest values or absolute values). The subset of the weight values to be quantized may be represented as:

$$\{\overline{\omega}_k\}_{k-1,\ldots,5} \tag{6}$$

The subset of the weight values together with their corresponding code vectors may be used to form a weighted sum of code vectors that estimates the v-vector, as shown in the following expression:

$$\overline{V}_{FG} \approx \sum_{j=1}^{5} \overline{\omega}_j \Omega_j \tag{7}$$

where $\Omega_j$ represents the jth code vector in a subset of the code vectors ($\{\Omega_j\}$), represents the jth weight in a subset of weights ($\{\overline{\omega}_j\}$), and $\overline{V}_{FG}$, corresponds to an estimated v-vector that corresponds to the v-vector being decomposed and/or coded by the v-vector coding unit 52. The right hand side of expression (1) may represent a weighted sum of code vectors that includes a set of weights ($\{\overline{\omega}_j\}$) and a set of code vectors ($\{\Omega_j\}$).

The v-vector coding unit 52 may quantize the subset of the weight values to generate quantized weight values that may be represented as:

$$\{\hat{\omega}_k\}_{k-1,\ldots,5} \tag{8}$$

The quantized weight values together with their corresponding code vectors may be used to form a weighted sum of code vectors that represents a quantized version of the estimated v-vector, as shown in the following expression:

$$\hat{V}_{FG} \approx \sum_{j=1}^{5} \hat{\omega}_j \Omega_j \tag{9}$$

where $\Omega_j$ represents the jth code vector in a subset of the code vectors ($\{\Omega_j\}$), $\hat{\omega}_j$ represents the jth weight in a subset of weights ($\{\hat{\omega}_j\}$), and $\hat{V}_{FG}$ corresponds to an estimated v-vector that corresponds to the v-vector being decomposed and/or coded by the v-vector coding unit 52. The right hand side of expression (1) may represent a weighted sum of a subset of the code vectors that includes a set of weights ($\{\hat{\omega}_j\}$) and a set of code vectors ($\{\Omega_j\}$).

An alternative restatement of the foregoing (which is largely equivalent to that described above) may be as follows. The V-vectors may be coded based on a predefined set of code vectors. To code the V-vectors, each V-vector is decomposed into a weighted sum of code vectors. The weighted sum of code vectors consists of k pairs of predefined code vectors and associated weights:

$$V \approx \sum_{j=0}^{k} \omega_j \Omega_j$$

where $\Omega_j$ represents the jth code vector in a set of predefined code vectors ($\{\Omega_j\}$), co, represents the jth real-valued weight in a set of predefined weights ($\{\omega_j\}$), k corresponds to the index of addends, which can be up to 7, and V corresponds to the V-vector that is being coded. The choice of k depends on the encoder. If the encoder chooses a weighted sum of two or more code vectors, the total number of predefined code vectors the encoder can chose of is $(N+1)^2$, where predefined code vectors are derived as HOA expansion coefficients from, in some examples, the tables F.2 to F.11. Reference to tables denoted by F followed by a period and a number refer to tables specified in Annex F of the MPEG-H 3D Audio Standard, entitled "Information Technology—High efficiency coding and media delivery in heterogeneous environments—Part 3: 3D Audio," ISO/IEC JTC1/SC 29, dated 2015 Feb. 20 (Feb. 20, 2015), ISO/IEC 23008-3:2015(E), ISO/IEC JTC 1/SC 29/WG 11 (filename: ISO_IEC_23008-3(E)-Word_document_v33.doc).

When N is 4, the table in Annex F.6 with 32 predefined directions is used. In all cases the absolute values of the weights $\omega$ are vector-quantized with respect to the predefined weighting values $\hat{\omega}$ found in the first k+1 columns of the table in table F.12 shown below and signaled with the associated row number index.

The number signs of the weights $\omega$ are separately coded as $$s_j = \begin{cases} 1, & \omega_j \geq 0 \\ 0, & \omega_j < 0. \end{cases} \tag{12}$$

In other words, after signaling the value k, a V-vector is encoded with k+1 indices that point to the k+1 predefined code vectors $\{\Omega_j\}$, one index that points to the k quantized weights $\{\omega_k\}$ in the predefined weighting codebook, and k+1 number sign values $s_j$:

$$\hat{V} = \sum_{j=0}^{k} (2s_j - 1)\hat{\omega}_j \Omega_j. \tag{13}$$

If the encoder selects a weighted sum of one code vector, a codebook derived from table F.8 is used in combination with the absolute weighting values $\hat{\omega}$ in the table of table F.11, where both of these tables are shown below. Also, the number sign of the weighting value $\omega$ may be separately coded.

In this respect, the techniques may enable the audio encoding device 20 to select one of a plurality of codebooks to use when performing vector quantization with respect to a spatial component of a soundfield, the spatial component obtained through application of a vector-based synthesis to a plurality of higher order ambisonic coefficients.

Moreover, the techniques may enable the audio encoding device 20 to select between a plurality of paired codebooks to be used when performing vector quantization with respect to a spatial component of a soundfield, the spatial component obtained through application of a vector-based synthesis to a plurality of higher order ambisonic coefficients.

In some examples, the V-vector coding unit 52 may determine, based on a set of code vectors, one or more weight values that represent a vector that is included in a decomposed version of a plurality of higher order ambisonic (HOA) coefficients. Each of the weight values may correspond to a respective one of a plurality of weights included in a weighted sum of the code vectors that represents the vector.

In such examples, the V-vector coding unit 52 may, in some examples, quantize the data indicative of the weight values. In such examples, to quantize the data indicative of the weight values the V-vector coding unit 52 may, in some examples, select a subset of the weight values to quantize, and quantize data indicative of the selected subset of the weight values. In such examples, the V-vector coding unit 52 may, in some examples, not quantize data indicative of weight values that are not included in the selected subset of the weight values.

In some examples, the V-vector coding unit 52 may determine a set of N weight values. In such examples, the V-vector coding unit 52 may select the M greatest weight values from the set of N weight values to form the subset of the weight values where M is less than N.

To quantize the data indicative of the weight values, the V-vector coding unit 52 may perform at least one of scalar quantization, vector quantization, and matrix quantization with respect to the data indicative of the weight values. Other quantization techniques in addition to or lieu of the above-mentioned quantization techniques may also be performed.

To determine the weight values, the V-vector coding unit 52 may, for each of the weight values, determine the respective weight value based on a respective one of the code vectors 63. For example, the V-vector coding unit 52 may multiply the vector by a respective one of the code vectors 63 to determine the respective weight value. In some cases, the V-vector coding unit 52 may involve multiply the vector by a transpose of the respective one of the code vectors 63 to determine the respective weight value.

In some examples, the decomposed version of the HOA coefficients may be a singular value decomposed version of the HOA coefficients. In further examples, the decomposed version of the HOA coefficients may be at least one of a principal component analyzed (PCA) version of the HOA coefficients, a Karhunen-Loeve transformed version of the HOA coefficients, a Hotelling transformed version of the HOA coefficients, a proper orthogonal decomposed (POD) version of the HOA coefficients, and an eigenvalue decomposed (EVD) version of the HOA coefficients.

In further examples, the set of code vectors 63 may include at least one of a set of directional vectors, a set of orthogonal directional vectors, a set of orthonormal directional vectors, a set of pseudo-orthonormal directional vectors, a set of pseudo-orthogonal directional vectors, a set of directional basis vectors, a set of orthogonal vectors, a set of orthonormal vectors, a set of pseudo-orthonormal vectors, a set of pseudo-orthogonal vectors, a set of spherical harmonic basis vectors, a set of normalized vectors, and a set of basis vectors.

In some examples, the V-vector coding unit 52 may use a decomposition codebook to determine the weights that are used to represent a V-vector (e.g., a reduced foreground V[k] vector). For example, the V-vector coding unit 52 may select a decomposition codebook from a set of candidate decomposition codebooks, and determine the weights that represent the V-vector based on the selected decomposition codebook.

In some examples, each of the candidate decomposition codebooks may correspond to a set of code vectors 63 that may be used to decompose a V-vector and/or to determine the weights that correspond to the V-vector. In other words, each different decomposition codebook corresponds to a different set of code vectors 63 that may be used to decompose a V-vector. Each entry in the decomposition codebook corresponds to one of the vectors in the set of code vectors.

The set of code vectors in a decomposition codebook may correspond to all code vectors included in a weighted sum of code vectors that is used to decompose a V-vector. For example, the set of code vectors may correspond to the set of code vectors 63 ($\{\Omega_j\}$) included in the weighted sum of code vectors shown on the right-hand side of expression (1). In this example, each one of the code vectors 63 (i.e., $\Omega_j$) may correspond to an entry in the decomposition codebook.

Different decomposition codebooks may have a same number of code vectors 63 in some examples. In further examples, different decomposition codebooks may have a different number of code vectors 63.

For example, at least two of the candidate decomposition codebooks may have a different number of entries (i.e., code vectors 63 in this example). As another example, all of the candidate decomposition codebooks may have a different number of entries 63. As a further example, at least two of the candidate decomposition codebooks may have a same number of entries 63. As an additional example, all of the candidate decomposition codebooks may have the same number of entries 63.

The V-vector coding unit 52 may select a decomposition codebook from the set of candidate decomposition codebooks based on one or more various criteria. For example, the V-vector coding unit 52 may select a decomposition codebook based on the weights corresponding to each decomposition codebook. For instance, the V-vector coding unit 52 may perform an analysis of the weights corresponding to each decomposition codebook (from the corresponding weighted sum that represents the V-vector) to determine how many weights are required to represent the V-vector within some margin of accuracy (as defined for example by a threshold error). The V-vector coding unit 52 may select the decomposition codebook which requires the least number of weights. In additional examples, the V-vector coding unit 52 may select a decomposition codebook based on the characteristics of the underlying soundfield (e.g., artificially created, naturally recorded, highly diffuse, etc.).

To determine the weights (i.e., weight values) based on a selected codebook, the V-vector coding unit 52 may, for each of the weights, select a codebook entry (i.e., code vector) that corresponds to the respective weight (as identified for example by the "WeightIdx" syntax element), and determine the weight value for the respective weight based on the selected codebook entry. To determine the weight value based on the selected codebook entry, the V-vector coding unit 52 may, in some examples, multiply the V-vector by the code vector 63 that is specified by the selected codebook entry to generate the weight value. For example, the V-vector coding unit 52 may multiply the V-vector by the transpose of the code vector 63 that is specified by the selected codebook entry to generate a scalar weight value. As another example, equation (2) may be used to determine the weight values.

In some examples, each of the decomposition codebooks may correspond to a respective one of a plurality of quantization codebooks. In such examples, when the V-vector coding unit 52 selects a decomposition codebook, the V-vector coding unit 52 may also select a quantization codebook that corresponds to the decomposition codebook.

The V-vector coding unit 52 may provide to the bitstream generation unit 42 data indicative of which decomposition codebook was selected (e.g., the CodebkIdx syntax element) for coding one or more of the reduced foreground V[k]

vectors 55 so that the bitstream generation unit 42 may include such data in the resulting bitstream. In some examples, the V-vector coding unit 52 may select a decomposition codebook to use for each frame of HOA coefficients to be coded. In such examples, the V-vector coding unit 52 may provide data indicative of which decomposition codebook was selected for coding each frame (e.g., the CodebkIdx syntax element) to the bitstream generation unit 42. In some examples, the data indicative of which decomposition codebook was selected may be a codebook index and/or an identification value that corresponds to the selected codebook.

In some examples, the V-vector coding unit 52 may select a number indicative of how many weights are to be used to estimate a V-vector (e.g., a reduced foreground V[k] vector). The number indicative of how many weights are to be used to estimate a V-vector may also be indicative of the number of weights to be quantized and/or coded by the V-vector coding unit 52 and/or the audio encoding device 20. The number indicative of how many weights are to be used to estimate a V-vector may also be referred to as the number of weights to be quantized and/or coded. This number indicative of how many weights may alternatively be represented as the number of code vectors 63 to which these weights correspond. This number may therefore also be denoted as the number of code vectors 63 used to dequantize a vector-quantized V-vector, and may be denoted by a NumVecIndices syntax element.

In some examples, the V-vector coding unit 52 may select the number of weights to be quantized and/or coded for a particular V-vector based on the weight values that were determined for that particular V-vector. In additional examples, the V-vector coding unit 52 may select the number of weights to be quantized and/or coded for a particular V-vector based on an error associated with estimating the V-vector using one or more particular numbers of weights.

For example, the V-vector coding unit 52 may determine a maximum error threshold for an error associated with estimating a V-vector, and may determine how many weights are needed to make the error between an estimated V-vector that is estimated with that number of weights and the V-vector less than or equal to the maximum error threshold. The estimated vector may correspond to weighted sum of code vectors where less than all of the code vectors from the codebook are used in the weighted sum.

Figure 20:
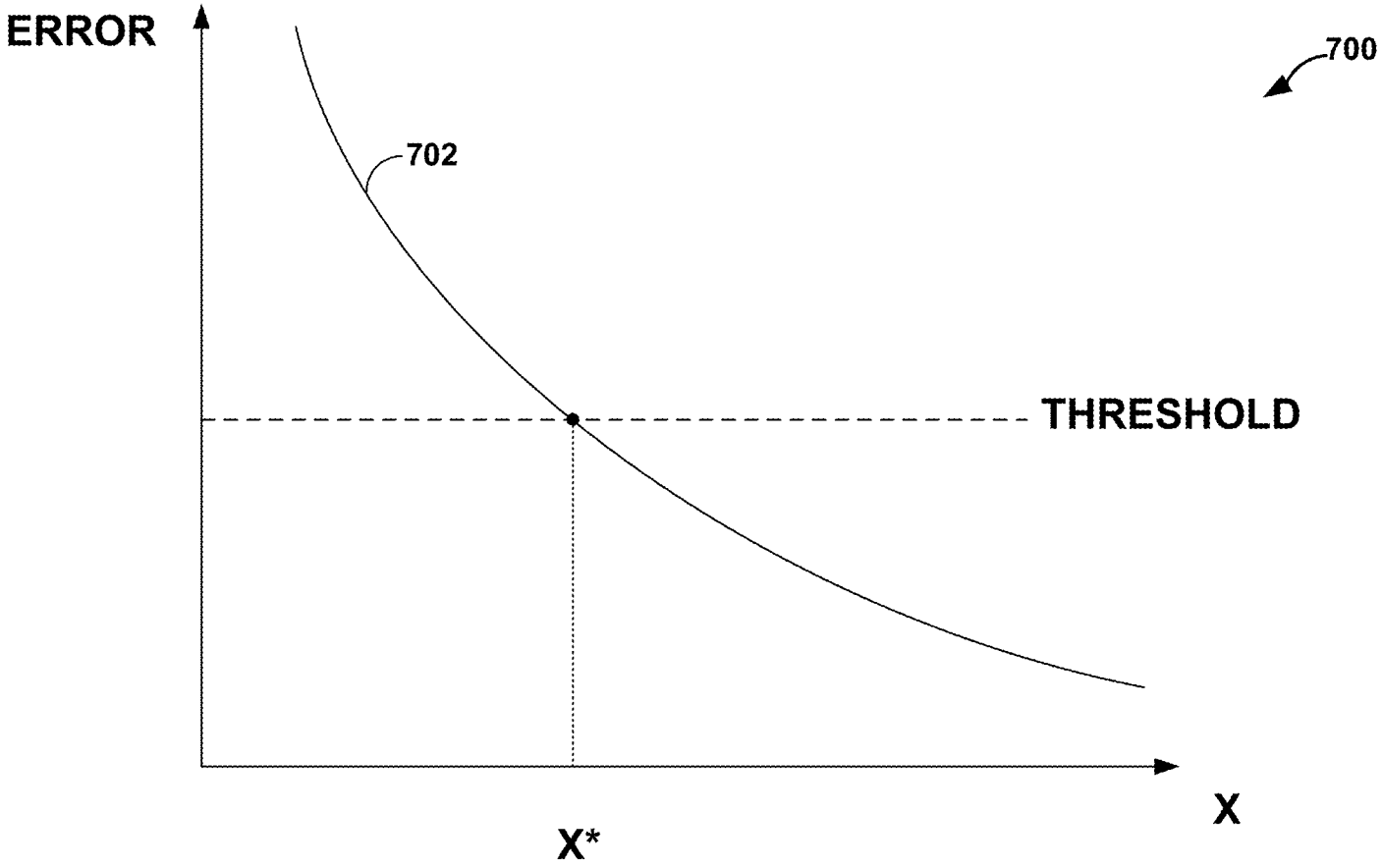
FIG. 20 is a diagram illustrating an example graph showing a threshold error used to select X* number of code vectors in accordance with various aspects of the techniques described in this disclosure.

In some examples, the V-vector coding unit 52 may determine how many weights are needed to make the error below a threshold based on the following equation:

$$\text{error} = \left| V_{FG} - \sum_{i=1}^{X} (\omega_i * \Omega_i) \right|^{\alpha} \tag{14}$$

where $\Omega_i$ represents the ith code vector, $\omega_i$ represents the ith weight, $V_{FG}$ corresponds to the V-vector that is being decomposed, quantized and/or coded by the V-vector coding unit 52, and $|x|^{\alpha}$ is a norm of the value x, where $\alpha$ is a value indicative of which type of norm is used. For example, $\alpha=1$ represents an L1 norm and $\alpha=2$ represents an L2 norm. FIG. 20 is a diagram illustrating an example graph 700 showing a threshold error used to select X* number of code vectors in accordance with various aspects of the techniques described in this disclosure. The graph 700 includes a line 702 illustrating how the error decreases as the number of code vectors increases.

In the above-mentioned example, the indices, i, may, in some examples, index the weights in an order sequence such that larger magnitude (e.g., larger absolute value) weights occur prior to lower magnitude (e.g., lower absolute value) weights in the ordered sequence. In other words, $\omega_1$ may represent the largest weight value, $\omega_2$ may represent the next largest weight value, and so on. Similarly, $\omega_X$ may represent the lowest weight value.

The V-vector coding unit 52 may provide to the bitstream generation unit 42 data indicative of how many weights were selected for coding one or more of the reduced foreground V[k] vectors 55 so that the bitstream generation unit 42 may include such data in the resulting bitstream. In some examples, the V-vector coding unit 52 may select a number of weights to use for coding a V-vector for each frame of HOA coefficients to be coded. In such examples, the V-vector coding unit 52 may provide to the bitstream generation unit 42 data indicative of how many weights were selected for coding selected each frame to the bitstream generation unit 42. In some examples, the data indicative of how many weights were selected may be a number indicative of how many weights were selected for coding and/or quantization.

In some examples, the V-vector coding unit 52 may use a quantization codebook to quantize the set of weights that are used to represent and/or estimate a V-vector (e.g., a reduced foreground V[k] vector). For example, the V-vector coding unit 52 may select a quantization codebook from a set of candidate quantization codebooks, and quantize the V-vector based on the selected quantization codebook.

In some examples, each of the candidate quantization codebooks may correspond to a set of candidate quantization vectors that may be used to quantize a set of weights. The set of weights may form a vector of weights that are to be quantized using these quantization codebooks. In other words, each different quantization codebook corresponds to a different set of quantization vectors from a which a single quantization vector may be selected to quantize the V-vector.

Each entry in the codebook may correspond to a candidate quantization vector. The number of components in each of the candidate quantization vectors may, in some examples, be equal to number of weights to be quantized.

In some examples, different quantization codebooks may have same number of candidate quantization vectors. In further examples, different quantization codebooks may have a different number of candidate quantization vectors.

For example, at least two of the candidate quantization codebooks may have a different number of candidate quantization vectors. As another example, all of the candidate quantization codebooks may have a different number of candidate quantization vectors. As a further example, at least two of the candidate quantization codebooks may have a same number of candidate quantization vectors. As an additional example, all of the candidate quantization codebooks may have the same number of candidate quantization vectors.

The V-vector coding unit 52 may select a quantization codebook from the set of candidate quantization codebooks based on one or more various criteria. For example, the V-vector coding unit 52 may select a quantization codebook for a V-vector based on a decomposition codebook that was used to determine the weights for the V-vector. As another example, the V-vector coding unit 52 may select the quantization codebook for a V-vector based on a probability distribution of the weight values to be quantized. In other examples, the V-vector coding unit 52 may select the quantization codebook for a V-vector based on a combination of the selection of the decomposition codebook that was used to determine the weights for the V-vector as well as the number of weights that were deemed necessary to represent the V-vector within some error threshold (e.g., as per Equation 14).

To quantize the weights based on the selected quantization codebook, the V-vector coding unit 52 may, in some examples, determine a quantization vector to use for quantizing the V-vector based on the selected quantization codebook. For example, the V-vector coding unit 52 may perform vector quantization (VQ) to determine the quantization vector to use for quantizing the V-vector.

In additional examples, to quantize the weights based on the selected quantization codebook, the V-vector coding unit 52 may, for each V-vector, select a quantization vector from the selected quantization codebook based on a quantization error associated with using one or more of the quantization vectors to represent the V-vector. For example, the V-vector coding unit 52 may select a candidate quantization vector from the selected quantization codebook that minimizes a quantization error (e.g., minimizes a least squares error).

In some examples, each of the quantization codebooks may correspond to a respective one of a plurality of decomposition codebooks. In such examples, the V-vector coding unit 52 may also select a quantization codebook for quantizing the set of weights associated with a V-vector based on the decomposition codebook that was used to determine the weights for the V-vector. For example, the V-vector coding unit 52 may select a quantization codebook that corresponds to the decomposition codebook that was used to determine the weights for the V-vector.

The V-vector coding unit 52 may provide to the bitstream generation unit 42 data indicative of which quantization codebook was selected for quantizing the weights corresponding to one or more of the reduced foreground V[k] vectors 55 so that the bitstream generation unit 42 may include such data in the resulting bitstream. In some examples, the V-vector coding unit 52 may select a quantization codebook to use for each frame of HOA coefficients to be coded. In such examples, the V-vector coding unit 52 may provide data indicative of which quantization codebook was selected for quantizing weights in each frame to the bitstream generation unit 42. In some examples, the data indicative of which quantization codebook was selected may be a codebook index and/or identification value that corresponds to the selected codebook.

The psychoacoustic audio coder unit 40 included within the audio encoding device 20 may represent multiple instances of a psychoacoustic audio coder, each of which is used to encode a different audio object or HOA channel of each of the energy compensated ambient HOA coefficients 47' and the interpolated nFG signals 49' to generate encoded ambient HOA coefficients 59 and encoded nFG signals 61. The psychoacoustic audio coder unit 40 may output the encoded ambient HOA coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57, the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. In this way, the bitstream generation unit 42 may thereby specify the vectors 57 in the bitstream 21 to obtain the bitstream 21. The bitstream 21 may include a primary or main bitstream and one or more side channel bitstreams.

Although not shown in the example of FIG. 3A, the audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the bitstream generation unit 42 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No. 14/594,533, entitled "TRANSITIONING OF AMBIENT HIGHER_ORDER AMBISONIC COEFFICIENTS," filed Jan. 12, 2015.

Figure 3B:
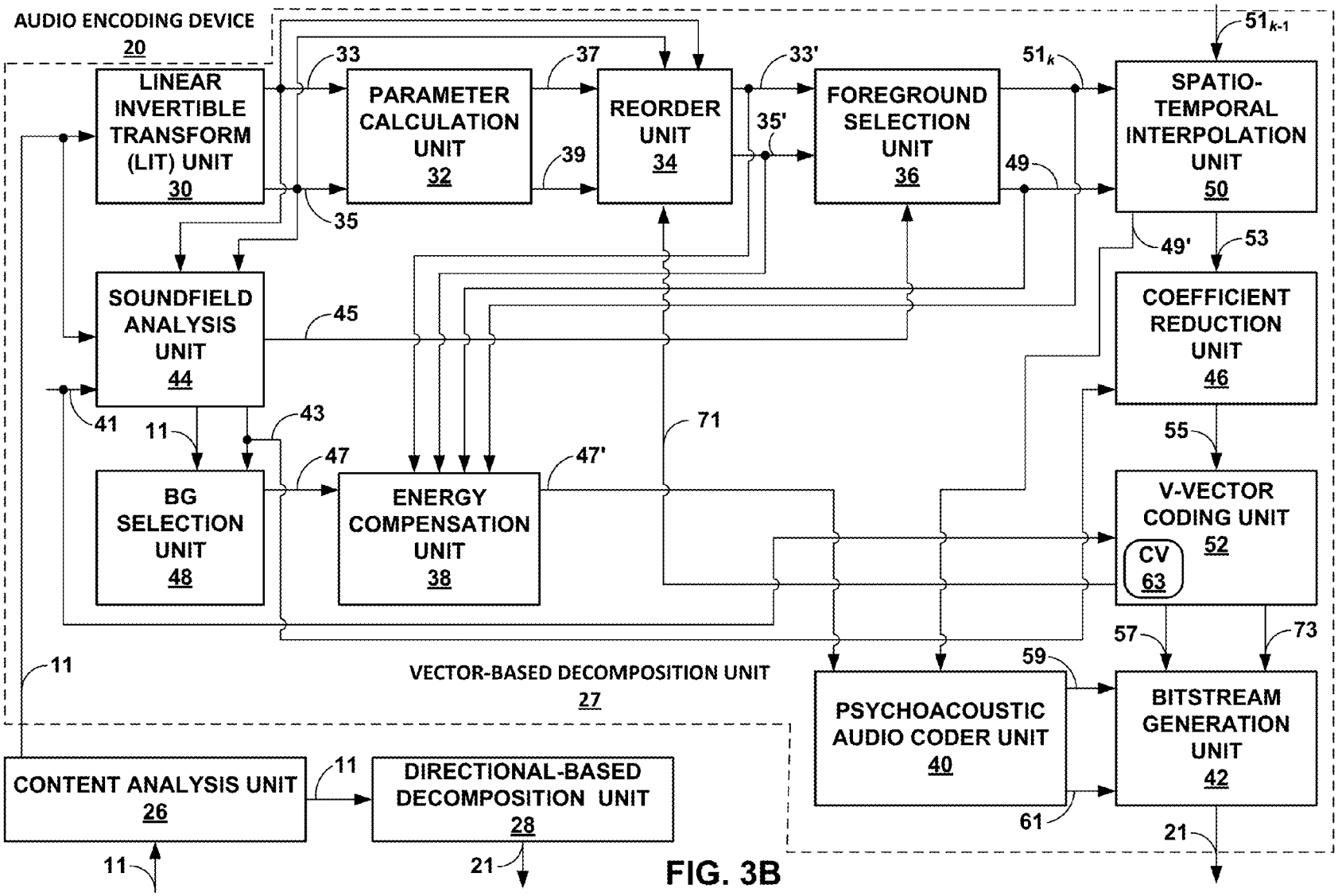

FIG. 3B is a block diagram illustrating, in more detail, another example of the audio encoding device 420 shown in the example of FIG. 3 that may perform various aspects of the techniques described in this disclosure. The audio encoding device 420 shown in FIG. 3B is similar to the audio encoding device 20 except that the v-vector coding unit 52 in the audio encoding device 420 also provides weight value information 71 to the reorder unit 34.

In some examples, the weight value information 71 may include one or more of the weight values calculated by the v-vector coding unit 52. In further examples, the weight value information 71 may include information indicative of which weights were selected for quantization and/or coding by the v-vector coding unit 52. In additional examples, the weight value information 71 may include information indicative of which weights were not selected for quantization and/or coding by the v-vector coding unit 52. The weight value information 71 may include any combination of any of the above-mentioned information items as well as other items in addition to or in lieu of the above-mentioned information items.

In some examples, the reorder unit 34 may reorder the vectors based on the weight value information 71 (e.g., based on the weight values). In examples where the v-vector coding unit 52 selects a subset of the weight values to quantize and/or code, the reorder unit 34 may, in some examples, reorder the vectors based on which of the weight values were selected for quantizing or coding (which may be indicated by the weight value information 71).

Figure 4A:
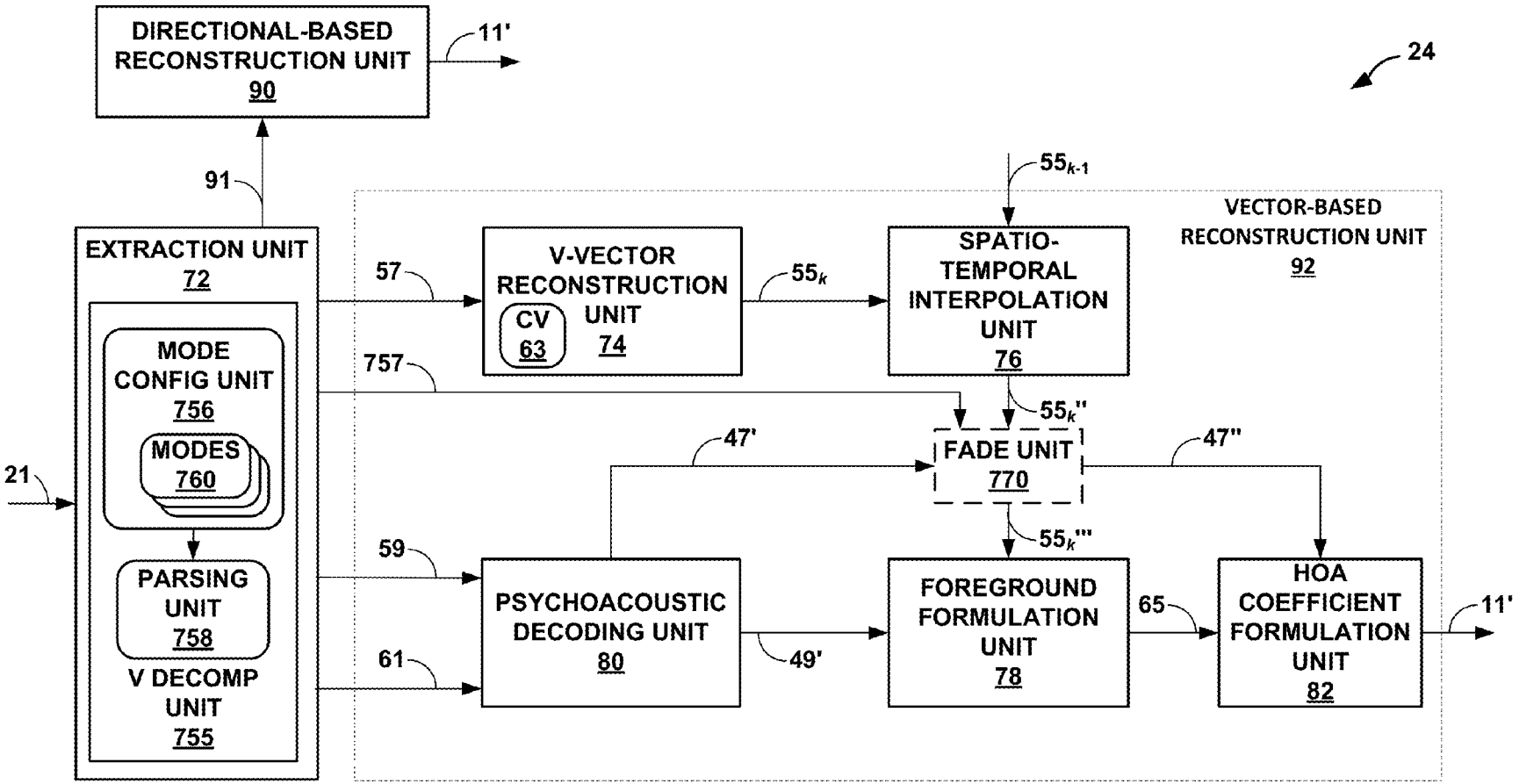
FIGS. 4A and 4B are block diagrams illustrating different versions of the audio decoding device of FIG. 2 in more detail.

FIG. 4A is a block diagram illustrating the audio decoding device 24 of FIG. 2 in more detail. As shown in the example of FIG. 4A the audio decoding device 24 may include an extraction unit 72, a directionality-based reconstruction unit 90 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May 2014.

The extraction unit 72 may represent a unit configured to receive the bitstream 21 and extract the various encoded versions (e.g., a directional-based encoded version or a vector-based encoded version) of the HOA coefficients 11. The extraction unit 72 may determine from the above noted syntax element indicative of whether the HOA coefficients 11 were encoded via the various direction-based or vector-based versions. When a directional-based encoding was performed, the extraction unit 72 may extract the directional-based version of the HOA coefficients 11 and the syntax elements associated with the encoded version (which is denoted as directional-based information 91 in the example of FIG. 4A), passing the directional based information 91 to the directional-based reconstruction unit 90. The directional-based reconstruction unit 90 may represent a unit configured to reconstruct the HOA coefficients in the form of HOA coefficients 11' based on the directional-based information 91.

When the syntax element indicates that the HOA coefficients 11 were encoded using a vector-based synthesis, the extraction unit 72 may extract the coded foreground V[k] vectors (which may include coded weights 57 and/or indices 73), the encoded ambient HOA coefficients 59 and the encoded nFG signals 59. The extraction unit 72 may pass the coded weights 57 to the quantization unit 74 and the encoded ambient HOA coefficients 59 along with the encoded nFG signals 61 to the psychoacoustic decoding unit 80.

To extract the coded weights 57, the encoded ambient HOA coefficients 59 and the encoded nFG signals 59, the extraction unit 72 may obtain an HOADecoderConfig container that includes, which includes the syntax element denoted CodedVVecLength. The extraction unit 72 may parse the CodedVVecLength from the HOADecoderConfig container. The extraction unit 72 may be configured to operate in any one of the above described configuration modes based on the CodedVVecLength syntax element.

In some examples, the extraction unit 72 may operate in accordance with the switch statement presented in the following pseudo-code with the syntax presented in the following syntax table (where strikethorughs indicate removal of the struckthrough subject matter and underlines indicate addition of the underlined subject matter relative to previous versions of the syntax table) for VVectorData as understood in view of the accompanying semantics:

```
switch CodedVVecLength{
    case 0:
        VVecLength = NumOfHoaCoeffs;
        for (m=0; m<VVecLength; ++m){
            VVecCoeffId[m] = m;
        }
        break;
    case 1:
        VVecLength = NumOfHoaCoeffs -
        MinNumOfCoeffsForAmbHOA -
NumOfContAddHoaChans;
        CoeffIdx = MinNumOfCoeffsForAmbHOA+1;
        for (m=0; m<VVecLength; ++m){
            bIsInArray = isMemberOf(CoeffIdx, ContAddHoaCoeff,
NumOfContAddHoaChans);
            while(bIsInArray){
                CoeffIdx++;
                bIsInArray = isMemberOf(CoeffIdx,
                ContAddHoaCoeff,
NumOfContAddHoaChans);
            }
            VVecCoeffId[m] = CoeffIdx-1;
        }
        break;
    case 2:
        VVecLength = NumOfHoaCoeffs -
        MinNumOfCoeffsForAmbHOA;
        for (m=0; m< VVecLength; ++m){
            VVecCoeffId[m] = m + MinNumOfCoeffsForAmbHOA;
        }
    }
```

| Syntax | No. of bits | Mnemonic |
|---|---|---|
| VVectorData(i) | | |
| { | | |
| if (NbitsQ(k)[i] == 4){ | | |
| If CodebkIdx(k)[i] == 0 { | | |
| nbitsW = 3; | | |
| nbitsIdx = 10; | | |
| } else { | | |
| nbitsW = 8; | | |
| nbitsIdx = ceil(log2(NumOfHoaCoeffs)); | | |
| } | | |
| NumVecIndices = CodebkIdx(k)[i] +1; | | |
| WeightIdx; | nbitsW | uimsbf |
| for (j=0; j< NumVecIndiecies; ++j) { | | |
| VecIdx[j] = VecIdx + 1; | nbitsIdx | uimsbf |
| ~~WeightIdx;~~ | ~~nbitsW~~ | ~~uimsbf~~ |
| WeightVal[j] = ((SgnVal*2)−1) * WeightValCdbk[CodebkIdx(k)[i]][WeightIdx][j]; | 1 | uimsbf |
| } | | |
| } | | |
| elseif (NbitsQ(k)[i] == 5){ | | |
| for (m=0; m< VVecLength; ++m){ | | |
| aVal[i][m] = (VecVal / 128.0)− 1.0; | 8 | uimsbf |
| } | | |
| elseif(NbitsQ(k)[i] >= 6){ | | |
| for (m=0; m< VVecLength; ++m){ | | |
| huffIdx = huffSelect(VVecCoeffId[m], PFlag[i], CbFlag[i]); | | |
| cid = huffDecode(NbitsQ[i], huffIdx, huffVal); | dynamic | huffDecode |
| aVal[i][m] = 0.0; | | |
| if ( cid > 0 ) { | | |
| aVal[i][m] = sgn = (sgnVal * 2) − 1; | 1 | bslbf |
| if (cid > 1) { | | |
| aVal[i][m] = sgn * (2.0^(cid −1 ) + intAddVal); | cid − 1 | uimsbf |
| } | | |
| } | | |
| } | | |
| } | | |
| } | | |

NOTE:
See section 11.4.1.9.1 for computation of VVecLength

VVectorData(VecSigChannelIds(i))
This structure contains the coded V-Vector data used for the vector-based signal synthesis.

| | |
|---|---|
| VVec(k)[i] | This is the V-Vector for the k-th HOAframe( ) for the i-th channel. |
| VVecLength | This variable indicates the number of vector elements to read out. |
| VVecCoeffID | This vector contains the indices of the transmitted V-Vector coefficients. |
| VecVal | An integer value between 0 and 255. |
| aVal | A temporary variable used during decoding of the VVectorData. |
| huffVal | A Huffman code word, to be Huffman-decoded. |
| sgnVal | This is the coded sign value used during decoding. |
| intAddVal | This is additional integer value used during decoding. |
| NumVecIndices | The number of vectors used to dequantise a vector-quantised V-vector. |
| WeightIdx | The index in WeightValCdbk used to dequantise a vector-quantised V-vector. |
| nbitsW | Field size for reading WeightIdx to decode a vector-quantised V-vector. |
| WeightValCdbk | Codebook which contains a vector of positive real-valued weighting coefficients. If NumVecIndices is set to 1, the WeightValCdbk with 16 entries is used, otherwise the WeightValCdbk with 256 entries is used. |
| VvecIdx | An index for VecDict, used to dequantise a vector-quantised V-vector. |
| nbitsIdx | Field size for reading individual VvecIdxs to decode a vector-quantised V-vector. |
| WeightVal | A real-valued weighting coefficient to decode a vector-quantised V-vector. |

In the foregoing syntax table, the first switch statement with the four cases (case 0-3) provides for a way by which to determine the $V^T_{DIST}$ vector length in terms of the number (VVecLength) and indices of coefficients (VVecCoeffId). The first case, case 0, indicates that all of the coefficients for the $V^T_{DIST}$ vectors (NumOfHoaCoeffs) are specified. The second case, case 1, indicates that only those coefficients of the $V^T_{DIST}$ vector corresponding to the number greater than a MinNumOfCoeffsForAmbHOA are specified, which may denote what is referred to as $(N_{DIST}+1)^2-(N_{BG}+1)^2$ above. Further those NumOfContAddAmbHoaChan coefficients identified in ContAddAmbHoaChan are subtracted. The list ContAddAmbHoaChan specifies additional channels (where "channels" refer to a particular coefficient corresponding to a certain order, sub-order combination) corresponding to an order that exceeds the order MinAmbHoaOrder. The third case, case 2, indicates that those coefficients of the $V^T_{DIST}$ vector corresponding to the number greater than a MinNumOfCoeffsForAmbHOA are specified, which may denote what is referred to as $(N_{DIST}+1)^2-(N_{BG}+1)^2$ above. Both the VVecLength as well as the VVecCoeffId list is valid for all VVectors within on HOAFrame.

After this switch statement, the decision of whether to perform vector quantization, or uniform scalar dequantization may be controlled by NbitsQ (or, as denoted above, nbits). Previously, only scalar quantization was proposed to quantize the Vvectors (e.g., when NbitsQ equals 4). While scalar quantization is still provided when NBitsQ equals 5, a vector quantization may be performed in accordance with the techniques described in this disclosure when, as one example, NbitsQ equals 4.

In other words, an HOA signal that has strong directionality is represented by a foreground audio signal and the corresponding spatial information, i.e., a V-vector in the examples of this disclosure. In the V-vector coding techniques described in this disclosure, each V-vector is represented by a weighted summation of pre-defined directional vectors as given by the following equation:

$$V \approx \sum_{i=1}^{I} \omega_i \Omega_i$$

where $\omega_i$ and $\Omega_i$ are an i-th weighting value and the corresponding directional vector, respectively.

Figure 16:
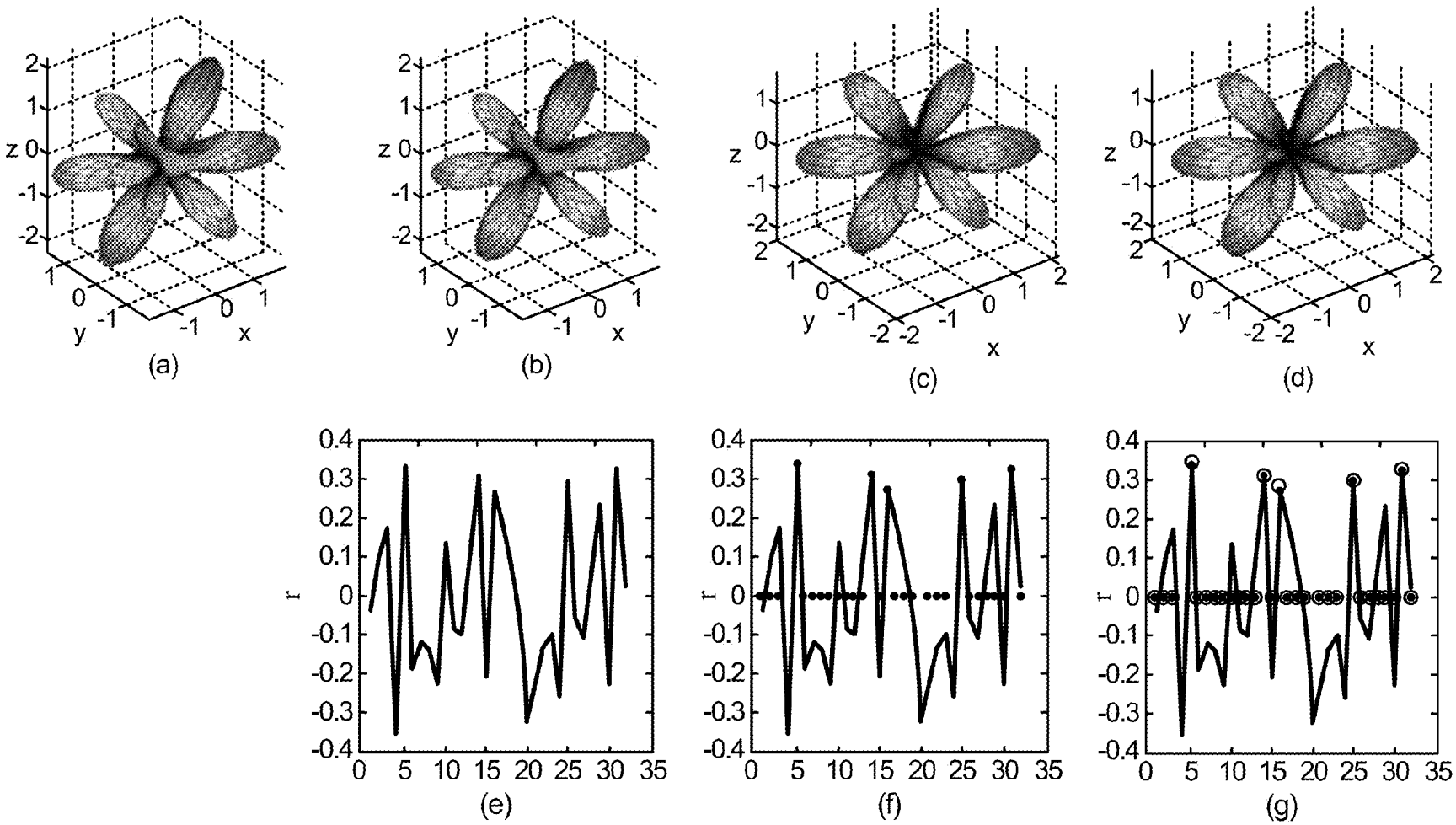
FIG. 16 is a number of diagrams showing an example of the V-vector coding when performed in accordance with the techniques described in this disclosure.

An example of the V-vector coding is illustrated in FIG. 16. As shown in FIG. 16 (*a*), an original V-vector may be represented by a mixture of the several directional vectors. The original V-vector may then be estimated by a weighted sum as shown in FIG. 16 (*b*) where a weighting vector is shown in FIG. 16 (*e*). FIG. 16 (*c*) and (*f*) illustrate the cases that only $I_S$ ($I_S \leq I$) highest weighting values are selected. Vector quantization (VQ) may then be performed for the selected weighting values and the result is illustrated in FIG. 16 (*d*) and (*g*).

The computational complexity of this v-vector coding scheme may be determined as follows:

0.06*MOPS*(HOA order=6)/0.05*MOPS*(HOA order=5); and 0.03*MOPS*(HOA order=4)/0.02*MOPS*(HOA order=3).

The ROM complexity may be determined as 16.29 kbytes (for HOA orders 3, 4, 5 and 6), while the algorithmic delay is determined to be 0 samples.

The required modification to the current version of the 3D audio coding standard referenced above may be denoted within the VVectorData syntax table shown above by the use of underlines. That is, in the CD of the above referenced MPEG-H 3D Audio proposed standard, V-vector coding was performed with scalar quantization (SQ) or SQ followed by the Huffman coding. Required bits of the proposed vector quantization (VQ) method may be lower than the conventional SQ coding methods. For the 12 reference test items, the required bits in average are as follows:

SQ+Huffman: 16.25 kbps

Proposed VQ: 5.25 kbps

The saved bits may be repurposed for use for perceptual audio coding.

The v-vector reconstruction unit 74 may, in other words, operate in accordance with the following pseudocode to reconstruct the V-vectors:

```
for (m=0; m< VVecLength; ++m){
    if (NbitsQ(k)[i] == 4){
        idx = VVecCoeffID[m];
        v^(i)_VVecCoeffId[m](k) = 0.0;
        if (NumVvecIndicies == 1){
            cdbLen = 900;
        } else {
            cdbLen = 0;
            if (N==4)
                cdbLen = 32;
        }
        for (j=0; j< NumVvecIndecies; ++j){
            v^(i)_VVecCoeffId[m](k) += (N+1) * WeightVal[j] *
VecDict[cdbLen].[VecIdx[j]][idx];
        }
    }
    elseif (NbitsQ(k)[i] == 5){
```

-continued

```
        v^(i)_VVecCoeffId[m](k) = (N+1)*aVal[i][m];
    }
    elseif (NbitsQ(k)[i] >= 6){
        v^(i)_VVecCoeffId[m](k) = (N+1)*(2^(16 -
        NbitsQ(k)[i])*aVal[i][m])/2^15;
        if (PFlag(k)[i] == 1) {
            v^(i)_VVecCoeffId[m](k) += v^(i)_VVecCoeffId[m](k - 1);
        }
    }
}
```

According to the foregoing psuedocode (with strikethroughs indicating removal of the struckthrough subject matter), the v-vector reconstruction unit 74 may determine VVecLength per the pseudocode for the switch statement based on the value of CodedVVecLength. Based on this VVecLength, the v-vector reconstruction unit 74 may iterate through the subsequent if/elseif statements, which consider the NbitsQ value. When the $i^{th}$ NbitsQ value for the $k^{th}$ frame equals 4, the v-vector reconstruction unit 74 determines that vector dequantization is to be performed.

The cdbLen syntax element indicates the number of entries in the dictionary or codebook of code vectors (where this dictionary is denoted as "VecDict" in the foregoing psuedocode and represents a codebook with cdbLen codebook entries containing vectors of HOA expansion coefficients, used to decode a vector quantized V-vector), which is derived based on the NumVveclndicies and the HOA order. When the value of NumVveclndicies is equal to one, the Vector codebook HOA expansion coefficients derived from the above table F.8 in conjunction with a codebook of 8×1 weighting values shown in the above table F.11. When the value of NumVveclndicies is larger than one, the Vector codebook with 0 vector is used in combination with 256×8 weighting values shown in the above table F.12.

Figure 19B:
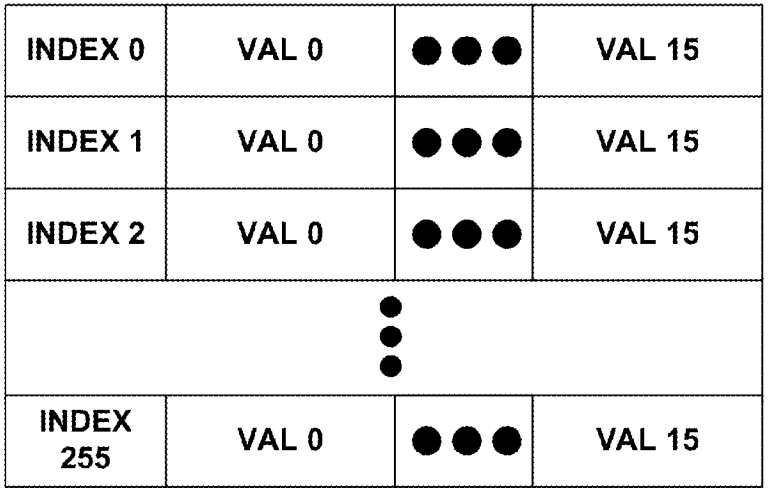
FIGS. 19A and 19B are diagrams illustrating codebooks with 256 rows with each row having 10 values and 16 values respectively that may be used in accordance with various aspects of the techniques described in this disclosure.
Figure 19A:
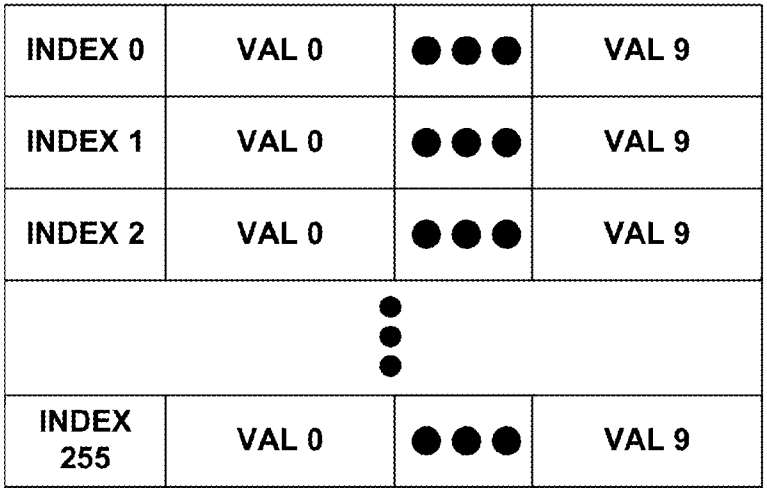

Although described above as using a codebook of size 256×8, different codebooks may be used having different numbers of values. That is, instead of val0-val7, a codebook with 256 rows may be used with each row being indexed by a different index value (index 0-index 255) and having a different number of values, such as val 0-val 9 (for a total of ten values) or val 0-val 15 (for a total of 16 values). FIGS. 19A and 19B are diagrams illustrating codebooks with 256 rows with each row having 10 values and 16 values respectively that may be used in accordance with various aspects of the techniques described in this disclosure.

The v-vector reconstruction unit 74 may derive the weight value for each corresponding code vector used to reconstruct the V-vector based on a weight value codebook (denoted as "WeightValCdbk," which may represent a multidimensional table indexed based on one or more of a codebook index (denoted "CodebkIdx" in the foregoing VVectorData(i) syntax table) and a weight index (denoted "WeightIdx" in the foregoing VVectorData(i) syntax table)). This CodebkIdx syntax element may be defined in a portion of the side channel information, as shown in the following ChannelSideInfoData(i) syntax table.

TABLE

Syntax of ChannelSideInfoData(i)

| Syntax | No. of bits | Mnemonic |
|---|---|---|
| ChannelSideInfoData(i) | | |
| { | | |
| ChannelType[i] | 2 | uimsbf |
| switch ChannelType[i] | | |
| { | | |
| case 0: | | |
| ActiveDirsIds[i]; | 10 | uimsbf |
| break; | | |
| case 1: | | |
| if(hoaIndependencyFlag){ | | |
| NbitsQ(k)[i] | 4 | uimsbf |
| if (NbitsQ(k)[i]==4) { | | |
| CodebkIdx(k)[i]; | 3 | uimsbf |
| } | | |
| elseif (NbitsQ(k)[i] >= 6) { | | |
| PFlag(k)[i] = 0; | | |
| CbFlag(k)[i]; | 1 | bslbf |
| } | | |
| } | | |
| else{ | | |
| bA; | 1 | bslbf |
| bB; | 1 | bslbf |
| if ((bA + bB) == 0) { | | |
| NbitsQ(k)[i] = NbitsQ(k−1)[i]; | | |
| PFlag(k)[i] = PFlag(k−1)[i]; | | |
| CbFlag(k)[i] = CbFlag(k−1)[i]; | | |
| CodebkIdx(k)[i]=CodebkIdx(k−1)[i]; | | |
| } | | |
| else{ | | |
| NbitsQ(k)[i] = (8*bA)+(4*bB)+uintC; | 2 | uimsbf |
| if (NbitsQ(k)[i]==4) { | | |
| CodebkIdx(k)[i]; | 3 | uimsbf |
| } | | |
| elseif (NbitsQ(k)[i] >= 6) { | | |
| PFlag(k)[i]; | 1 | bslbf |
| CbFlag(k)[i]; | 1 | bslbf |
| } | | |
| } | | |
| } | | |
| break; | | |
| case 2: | | |
| AddAmbHoaInfoChannel(i); | | |
| break; | | |
| default: | | |
| } | | |
| } | | |

NOTE:

Underlines in the foregoing table denote changes to the existing syntax table to accommodate the addition of the CodebkIdx. The semantics for the foregoing table are as follows.

This payload holds the side information for the i-th channel. The size and the data of the payload depend on the type of the channel.

| | |
|---|---|
| ChannelType[i] | This element stores the type of the i-th channel which is defined in Table 95. |
| ActiveDirsIds[i] | This element indicates the direction of the active directional signal using an index of the 900 predefined, uniformly distributed points from Annex F.7. The code word 0 is used for signaling the end of a directional signal. |
| PFlag[i] | The prediction flag used for the Huffman decoding of the scalar-quantised V-vector associated with the Vector-based signal of the i-th channel. |
| CbFlag[i] | The codebook flag used for the Huffman decoding of the scalar-quantised V-vector associated with the Vector-based signal of the i-th channel. |
| CodebkIdx[i] | Signals the specific codebook used to dequantise the vector-quantized V-vector associated with the Vector-based signal of the i-th channel. |
| NbitsQ[i] | This index determines the Huffman table used for the Huffman decoding of the data associated with the Vector-based signal of the i-th channel. The code word 5 determines the use of a uniform 8bit dequantizer. The two MSBs 00 determines reusing the NbitsQ[i], PFlag[i] and CbFlag[i] data of the previous frame (k − 1). |
| bA, bB | The msb (bA) and second msb (bB) of the NbitsQ[i] field. |
| uintC | The code word of the remaining two bits of the NbitsQ[i] field. |
| AddAmbHoaInfoChannel(i) | This payload holds the information for additional ambient HOA coefficients. |

Per the VVectorData syntax table semantics the nbitsW syntax element represents a field size for reading WeightIdx to decode a vector-quantised V-vector, while the WeightValCdbk syntax element represents a Codebook which contains a vector of positive real-valued weighting coefficients. If NumVecIndices is set to 1, the WeightValCdbk with 8 entries is used, otherwise the WeightValCdbk with 256 entries is used. Per the VVectorData syntax table, when the CodebkIdx equals zero, the v-vector reconstruction unit 74 determines that nbitsW equals 3 and the WeightIdx can have a value in the range of 0-7. In this instance, the code vector dictionary VecDict has a relatively large number of entries (e.g., 900) and is paired with a weight codebook having only 8 entries. When the CodebkIdx does not equal zero, the v-vector reconstruction unit 74 determines that nbitsW equals 8 and the WeightIdx can have a value in the range of 0-255. In this instance, the VecDict has a relatively smaller number of entries (e.g., 25 or 32 entries) and a relatively larger number of weights are required (e.g., 256) in the weight codebook to ensure an acceptable error. In this manner, the techniques may provide for paired codebooks (referring to the paired VecDict used and the weight codebooks). The weight value (denoted "WeightVal" in the foregoing VVectorData syntax table) may then be computed as follows:

$$\text{WeightVal}[j]=((\text{SgnVar2})-1)*\text{WeightValCdbk}[\text{CodebkIdx}(k)[i]][\text{WeightIdx}][j];$$

This WeightVal may then be applied per the above psuedocode to a corresponding code vector to de-vector quantize the v-vector.

In this respect, the techniques may enable an audio decoding device, e.g., the audio decoding device 24, to select one of a plurality of codebooks to use when performing vector dequantization with respect to a vector quantized spatial component of a soundfield, the vector quantized spatial component obtained through application of a vector-based synthesis to a plurality of higher order ambisonic coefficients.

Moreover, the techniques may enable the audio decoding device 24 to select between a plurality of paired codebooks to be used when performing vector dequantization with respect to a vector quantized spatial component of a soundfield, the vector quantized spatial component obtained through application of a vector-based synthesis to a plurality of higher order ambisonic coefficients.

When NbitsQ equals 5, a uniform 8 bit scalar dequantization is performed. In contrast, an NbitsQ value of greater or equals 6 may result in application of Huffman decoding. The cid value referred to above may be equal to the two least significant bits of the NbitsQ value. The prediction mode discussed above is denoted as the PFlag in the above syntax table, while the HT info bit is denoted as the CbFlag in the above syntax table. The remaining syntax specifies how the decoding occurs in a manner substantially similar to that described above.

The vector-based reconstruction unit 92 represents a unit configured to perform operations reciprocal to those described above with respect to the vector-based synthesis unit 27 so as to reconstruct the HOA coefficients 11'. The vector based reconstruction unit 92 may include a v-vector reconstruction unit 74, a spatio-temporal interpolation unit 76, a foreground formulation unit 78, a psychoacoustic decoding unit 80, a HOA coefficient formulation unit 82 and a reorder unit 84.

The v-vector reconstruction unit 74 may receive coded weights 57 and generate reduced foreground V[k] vectors $\mathbf{55}_k$. The v-vector reconstruction unit 74 may forward the reduced foreground V[k] vectors $\mathbf{55}_k$ to the reorder unit 84.

For example, the v-vector reconstruction unit 74 may obtain the coded weights 57 from the bitstream 21 via the extraction unit 72, and reconstruct the reduced foreground V[k] vectors $\mathbf{55}_k$ based on the coded weights 57 and one or more code vectors. In some examples, the coded weights 57 may include weight values corresponding to all code vectors in a set of code vectors that is used to represent the reduced foreground V[k] vectors $\mathbf{55}_k$. In such examples, the v-vector reconstruction unit 74 may reconstruct the reduced foreground V[k] vectors $\mathbf{55}_k$ based on the entire set of code vectors.

The coded weights 57 may include weight values corresponding to a subset of a set of code vectors that is used to represent the reduced foreground V[k] vectors $\mathbf{55}_k$. In such examples, the coded weights 57 may further include data indicative of which of a plurality of code vectors to use for reconstructing the reduced foreground V[k] vectors $\mathbf{55}_k$, and the v-vector reconstruction unit 74 may use a subset of the code vectors indicated by such data to reconstruct the reduced foreground V[k] vectors $\mathbf{55}_k$. In some examples, the data indicative of which of a plurality of code vectors to use for reconstructing the reduced foreground V[k] vectors $\mathbf{55}_k$ may correspond to indices 57.

In some examples, the v-vector reconstruction unit 74 may obtain from a bitstream data indicative of a plurality of weight values that represent a vector that is included in a decomposed version of a plurality of HOA coefficients, and reconstruct the vector based on the weight values and the code vectors. Each of the weight values may correspond to a respective one of a plurality of weights in a weighted sum of code vectors that represents the vector.

In some examples, to reconstruct the vector, the v-vector reconstruction unit 74 may determine a weighted sum of the code vectors where the code vectors are weighted by the weight values. In further examples, to reconstruct the vector, the v-vector reconstruction unit 74 may, for each of the weight values, multiply the weight value by a respective one of the code vectors to generate a respective weighted code vector included in a plurality of weighted code vectors, and sum the plurality of weighted code vectors to determine the vector.

In some examples, v-vector reconstruction unit 74 may obtain, from the bitstream, data indicative of which of a plurality of code vectors to use for reconstructing the vector, and reconstruct the vector based on the weight values (e.g., the WeightVal element derived from the WeightValCdbk based on the CodebkIdx and WeightIdx syntax elements), the code vectors, and the data indicative of which of a plurality of code vectors (as identified for example by the VVecIdx syntax element in addition with the NumVecIndices) to use for reconstructing the vector. In such examples, to reconstruct the vector, the v-vector reconstruction unit 74 may, in some examples, select a subset of the code vectors based on the data indicative of which of a plurality of code vectors to use for reconstructing the vector, and reconstruct the vector based on the weight values and the selected subset of the code vectors.

In such examples, to reconstruct the vector based on the weight values and the selected subset of the code vectors, the v-vector reconstruction unit 74 may, for each of the weight values, multiply the weight value by a respective one of the code vectors in the subset of code vectors to generate a respective weighted code vector, and sum the plurality of weighted code vectors to determine the vector.

The psychoacoustic decoding unit 80 may operate in a manner reciprocal to the psychoacoustic audio coding unit 40 shown in the example of FIG. 4A so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). Although shown as being separate from one another, the encoded ambient HOA coefficients 59 and the encoded nFG signals 61 may not be separate from one another and instead may be specified as encoded channels, as described below with respect to FIG. 4B. The psychoacoustic decoding unit 80 may, when the encoded ambient HOA coefficients 59 and the encoded nFG signals 61 are specified together as the encoded channels, may decode the encoded channels to obtain decoded channels and then perform a form of channel reassignment with respect to the decoded channels to obtain the energy compensated ambient HOA coefficients 47' and the interpolated nFG signals 49'.

In other words, the psychoacoustic decoding unit 80 may obtain the interpolated nFG signals 49' of all the predominant sound signals, which may be denoted as the frame $X_{ps}(k)$, the energy compensated ambient HOA coefficients 47' representative of the intermediate representation of the ambient HOA component, which may be denoted as the frame $C_{I,AMB}(k)$. The psychoacoustic decoding unit 80 may perform this channel reassignment based on syntax elements specified in the bitstream 21 or 29, which may include an assignment vector specifying, for each transport channel, the index of a possibly contained coefficient sequence of the ambient HOA component and other syntax elements indicative of a set of active V vectors. In any event, the psychoacoustic decoding unit 80 may pass the energy compensated ambient HOA coefficients 47' to HOA coefficient formulation unit 82 and the nFG signals 49' to the reorder 84.

In other words, the psychoacoustic decoding unit 80 may obtain the interpolated nFG signals 49' of all the predominant sound signals, which may be denoted as the frame $X_{ps}(k)$, the energy compensated ambient HOA coefficients 47' representative of the intermediate representation of the ambient HOA component, which may be denoted as the frame $C_{I,AMB}(k)$. The psychoacoustic decoding unit 80 may perform this channel reassignment based on syntax elements specified in the bitstream 21 or 29, which may include an assignment vector specifying, for each transport channel, the index of a possibly contained coefficient sequence of the ambient HOA component and other syntax elements indicative of a set of active V vectors. In any event, the psychoacoustic decoding unit 80 may pass the energy compensated ambient HOA coefficients 47' to HOA coefficient formulation unit 82 and the nFG signals 49' to the reorder 84.

To restate the foregoing, the HOA coefficients may be reformulated from the vector-based signals in the manner described above. Scalar dequantization may first be performed with respect to each V-vector to generate $\mathcal{M}_{VEC}(k)$, where the $i^{th}$ individual vectors of the current frame may be denoted as $v_I^{(i)}(k)$. The V-vectors may have been decomposed from the HOA coefficients using a linear invertible transform (such as a singular value decomposition, a principle component analysis, a Karhunen-Loeve transform, a Hotelling transform, proper orthogonal decomposition, or an eigenvalue decomposition), as described above. The decomposition also outputs, in the case of a singular value decomposition, S[k] and U[k] vectors, which may be combined to form US[k]. Individual vector elements in the US[k] matrix may be denoted as $X_{PS}(k,l)$.

Spatio-temporal interpolation may be performed with respect to the $\mathcal{M}_{VEC}(k)$ and $\mathcal{M}_{VEC}(k-1)$ (which denotes V-vectors from a previous frame with individual vectors of $\mathcal{M}_{VEC}(k-1)$ denoted as $v_O^{(i)}(k)$). The spatial interpolation method is, as one example, controlled by $\omega_{VEC}(l)$. Following interpolation, the $i^{th}$ interpolated V-vector $(\overline{v^{(i)}(k,l)})$ are then multiplied by the $i^{th}$ US[k] (which is denoted as $X_{PS,i}(k,l)$) to output the $i^{th}$ column of the HOA representation $(c_{VEC}^{(i)}(k,l))$. The column vectors may then be summed to formulate the HOA representation of the vector-based signals. In this way, the decomposed interpolated representation of the HOA coefficients are obtained for a frame by performing an interpolation with respect to $v_I^{(i)}(k)$ and $v_O^{(i)}(k)$, as described in further detail below.

Figure 4B:
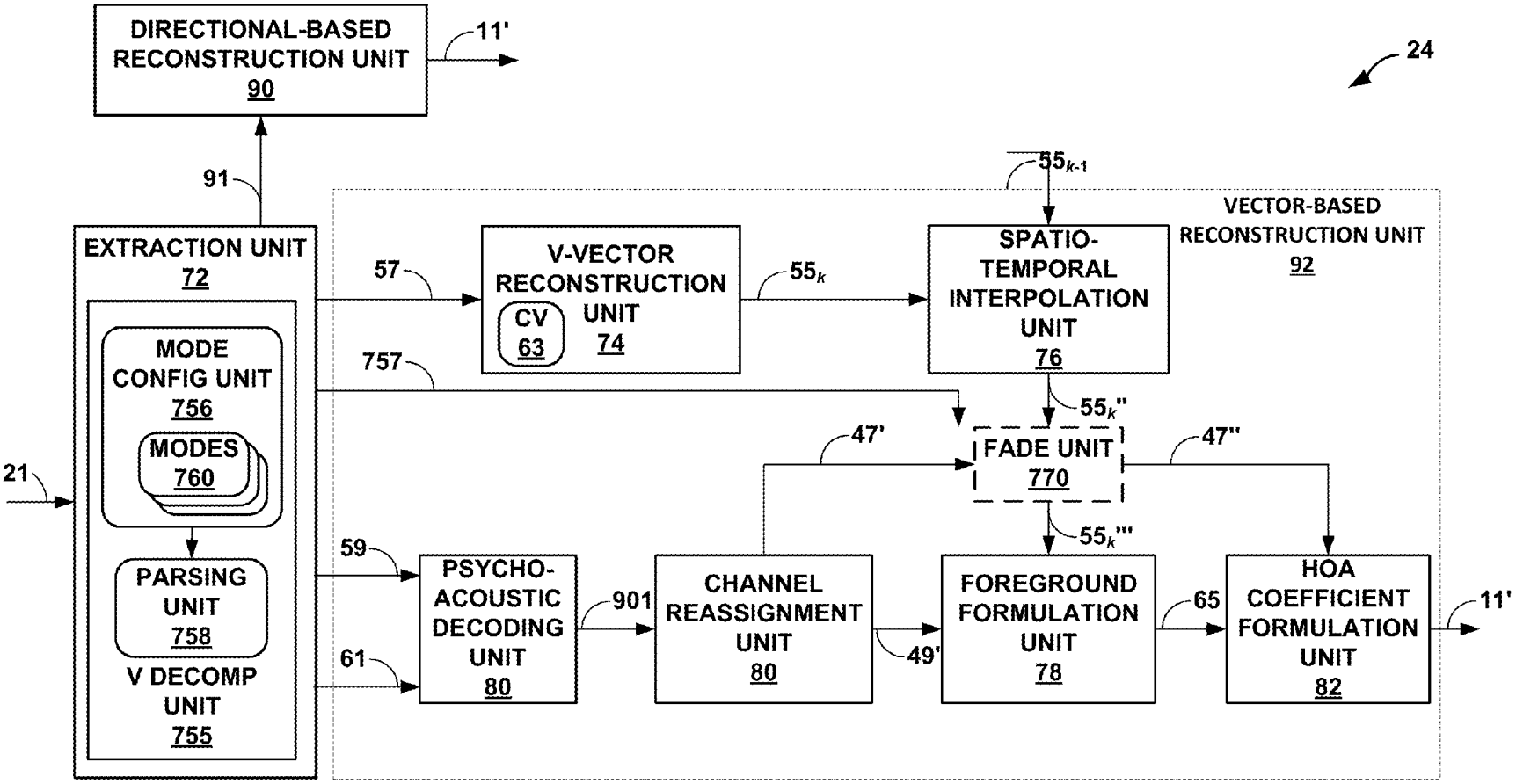

FIG. 4B is a block diagram illustrating another example of the audio decoding device 24 in more detail. The example shown in FIG. 4B of the audio decoding device 24 is denoted as the audio decoding device 24'. The audio decoding device 24' is substantially similar to the audio decoding device 24 shown in the example of FIG. 4A except that the psychoacoustic decoding unit 902 of the audio decoding device 24' does not perform the channel reassignment described above. Instead, the audio encoding device 24' includes a separate channel reassignment unit 904 that performs the channel reassignment described above. In the example of FIG. 4B, the psychoacoustic decoding unit 902 receives encoded channels 900 and performs psychoacoustic decoding with respect to the encoded channels 900 to obtain decoded channels 901. The psychoacoustic decoding unit 902 may output the decoded channel 901 to the channel reassignment unit 904. The channel reassignment unit 904 may then perform the above described channel reassignment with respect to the decoded channel 901 to obtain the energy compensated ambient HOA coefficients 47' and the interpolated nFG signals 49'.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k''$. The spatio-temporal interpolation unit 76 may forward the interpolated foreground V[k] vectors $\mathbf{55}_k''$ to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47" or "ambient HOA coefficients 47') and the elements of the interpolated foreground V[k] vectors $\mathbf{55}_k$" are to be either faded-in or faded-out. In some examples, the fade unit 770 may operate opposite with respect to each of the ambient HOA coefficients 47' and the elements of the interpolated foreground V[k] vectors $\mathbf{55}_k''$. That is, the fade unit 770 may perform a fade-in or fade-out, or both a fade-in or fade-out with respect to corresponding one of the ambient HOA coefficients 47', while performing a fade-in or fade-out or both a fade-in and a fade-out, with respect to the corresponding one of the elements of the interpolated foreground V[k] vectors $\mathbf{55}_k''$. The fade unit 770 may output adjusted ambient HOA coefficients 47" to the HOA coefficient formulation unit 82 and adjusted foreground V[k] vectors $\mathbf{55}_k'''$ to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k''$.

The foreground formulation unit 78 may represent a unit configured to perform matrix multiplication with respect to the adjusted foreground V[k] vectors $\mathbf{55}_k'''$ and the interpolated nFG signals 49' to generate the foreground HOA coefficients 65. In this respect, the foreground formulation unit 78 may combine the audio objects 49' (which is another way by which to denote the interpolated nFG signals 49') with the vectors $55_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $55_k'''$.

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

Figure 5:
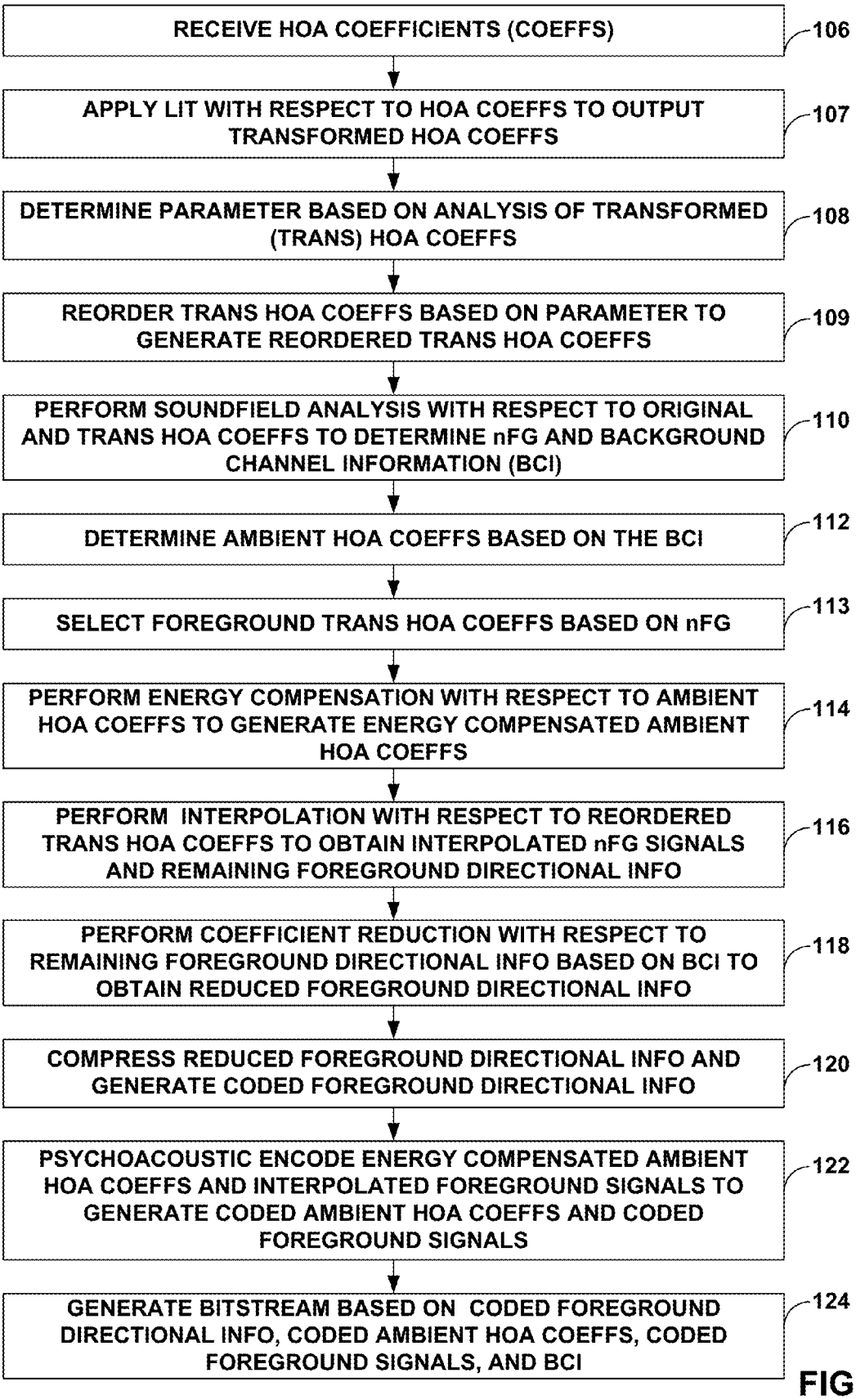
FIG. 5 is a flowchart illustrating exemplary operation of an audio encoding device in performing various aspects of the vector-based synthesis techniques described in this disclosure.

FIG. 5 is a flowchart illustrating exemplary operation of an audio encoding device, such as the audio encoding device 20 shown in the example of FIG. 3A, in performing various aspects of the vector-based synthesis techniques described in this disclosure. Initially, the audio encoding device 20 receives the HOA coefficients 11 (106). The audio encoding device 20 may invoke the LIT unit 30, which may apply a LIT with respect to the HOA coefficients to output transformed HOA coefficients (e.g., in the case of SVD, the transformed HOA coefficients may comprise the US[k] vectors 33 and the V[k] vectors 35) (107).

The audio encoding device 20 may next invoke the parameter calculation unit 32 to perform the above described analysis with respect to any combination of the US[k] vectors 33, US[k−1] vectors 33, the V[k] and/or V[k−1] vectors 35 to identify various parameters in the manner described above. That is, the parameter calculation unit 32 may determine at least one parameter based on an analysis of the transformed HOA coefficients 33/35 (108).

The audio encoding device 20 may then invoke the reorder unit 34, which may reorder the transformed HOA coefficients (which, again in the context of SVD, may refer to the US[k] vectors 33 and the V[k] vectors 35) based on the parameter to generate reordered transformed HOA coefficients 33'/35' (or, in other words, the US[k] vectors 33' and the V[k] vectors 35'), as described above (109). The audio encoding device 20 may, during any of the foregoing operations or subsequent operations, also invoke the soundfield analysis unit 44. The soundfield analysis unit 44 may, as described above, perform a soundfield analysis with respect to the HOA coefficients 11 and/or the transformed HOA coefficients 33/35 to determine the total number of foreground channels (nFG) 45, the order of the background soundfield ($N_{BG}$) and the number (nBGa) and indices (i) of additional BG HOA channels to send (which may collectively be denoted as background channel information 43 in the example of FIG. 3A) (109).

The audio encoding device 20 may also invoke the background selection unit 48. The background selection unit 48 may determine background or ambient HOA coefficients 47 based on the background channel information 43 (110). The audio encoding device 20 may further invoke the foreground selection unit 36, which may select the reordered US[k] vectors 33' and the reordered V[k] vectors 35' that represent foreground or distinct components of the soundfield based on nFG 45 (which may represent a one or more indices identifying the foreground vectors) (112).

The audio encoding device 20 may invoke the energy compensation unit 38. The energy compensation unit 38 may perform energy compensation with respect to the ambient HOA coefficients 47 to compensate for energy loss due to removal of various ones of the HOA coefficients by the background selection unit 48 (114) and thereby generate energy compensated ambient HOA coefficients 47'.

The audio encoding device 20 may also invoke the spatio-temporal interpolation unit 50. The spatio-temporal interpolation unit 50 may perform spatio-temporal interpolation with respect to the reordered transformed HOA coefficients 33'/35' to obtain the interpolated foreground signals 49' (which may also be referred to as the "interpolated nFG signals 49") and the remaining foreground directional information 53 (which may also be referred to as the "V[k] vectors 53") (116). The audio encoding device 20 may then invoke the coefficient reduction unit 46. The coefficient reduction unit 46 may perform coefficient reduction with respect to the remaining foreground V[k] vectors 53 based on the background channel information 43 to obtain reduced foreground directional information 55 (which may also be referred to as the reduced foreground V[k] vectors 55) (118).

The audio encoding device 20 may then invoke the V-vector coding unit 52 to compress, in the manner described above, the reduced foreground V[k] vectors 55 and generate coded foreground V[k] vectors 57 (120).

The audio encoding device 20 may also invoke the psychoacoustic audio coder unit 40. The psychoacoustic audio coder unit 40 may psychoacoustic code each vector of the energy compensated ambient HOA coefficients 47' and the interpolated nFG signals 49' to generate encoded ambient HOA coefficients 59 and encoded nFG signals 61. The audio encoding device may then invoke the bitstream generation unit 42. The bitstream generation unit 42 may generate the bitstream 21 based on the coded foreground directional information 57, the coded ambient HOA coefficients 59, the coded nFG signals 61 and the background channel information 43.

Figure 6:
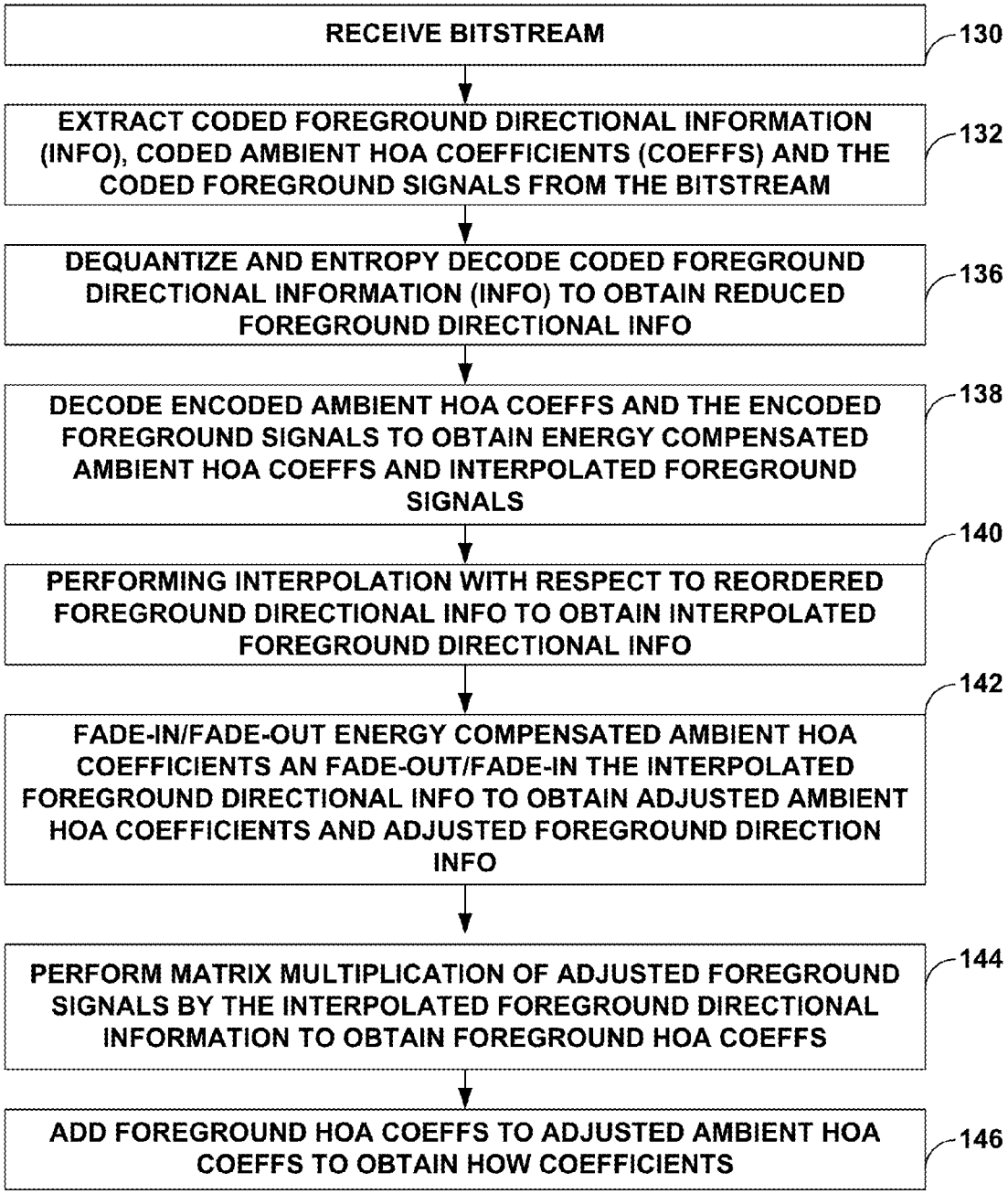
FIG. 6 is a flowchart illustrating exemplary operation of an audio decoding device in performing various aspects of the techniques described in this disclosure.

FIG. 6 is a flowchart illustrating exemplary operation of an audio decoding device, such as the audio decoding device 24 shown in FIG. 4A, in performing various aspects of the techniques described in this disclosure. Initially, the audio decoding device 24 may receive the bitstream 21 (130). Upon receiving the bitstream, the audio decoding device 24 may invoke the extraction unit 72. Assuming for purposes of discussion that the bitstream 21 indicates that vector-based reconstruction is to be performed, the extraction unit 72 may parse the bitstream to retrieve the above noted information, passing the information to the vector-based reconstruction unit 92.

In other words, the extraction unit 72 may extract the coded foreground directional information 57 (which, again, may also be referred to as the coded foreground V[k] vectors 57), the coded ambient HOA coefficients 59 and the coded foreground signals (which may also be referred to as the coded foreground nFG signals 59 or the coded foreground audio objects 59) from the bitstream 21 in the manner described above (132).

The audio decoding device 24 may further invoke the dequantization unit 74. The dequantization unit 74 may entropy decode and dequantize the coded foreground directional information 57 to obtain reduced foreground directional information $55_k$ (136). The audio decoding device 24 may also invoke the psychoacoustic decoding unit 80. The psychoacoustic audio decoding unit 80 may decode the encoded ambient HOA coefficients 59 and the encoded foreground signals 61 to obtain energy compensated ambient HOA coefficients 47' and the interpolated foreground signals 49' (138). The psychoacoustic decoding unit 80 may pass the energy compensated ambient HOA coefficients 47' to the fade unit 770 and the nFG signals 49' to the foreground formulation unit 78.

The audio decoding device 24 may next invoke the spatio-temporal interpolation unit 76. The spatio-temporal interpolation unit 76 may receive the reordered foreground directional information $\mathbf{55}_k'$ and perform the spatio-temporal interpolation with respect to the reduced foreground directional information $\mathbf{55}_k/55_{k-1}$ to generate the interpolated foreground directional information $\mathbf{55}_k''$ (140). The spatio-temporal interpolation unit 76 may forward the interpolated foreground V[k] vectors $\mathbf{55}_k''$ to the fade unit 770.

The audio decoding device 24 may invoke the fade unit 770. The fade unit 770 may receive or otherwise obtain syntax elements (e.g., from the extraction unit 72) indicative of when the energy compensated ambient HOA coefficients 47' are in transition (e.g., the AmbCoeffTransition syntax element). The fade unit 770 may, based on the transition syntax elements and the maintained transition state information, fade-in or fade-out the energy compensated ambient HOA coefficients 47' outputting adjusted ambient HOA coefficients 47" to the HOA coefficient formulation unit 82. The fade unit 770 may also, based on the syntax elements and the maintained transition state information, and fade-out or fade-in the corresponding one or more elements of the interpolated foreground V[k] vectors $\mathbf{55}_k''$ outputting the adjusted foreground V[k] vectors $\mathbf{55}_k'''$ to the foreground formulation unit 78 (142).

The audio decoding device 24 may invoke the foreground formulation unit 78. The foreground formulation unit 78 may perform matrix multiplication the nFG signals 49' by the adjusted foreground directional information $\mathbf{55}_k'''$ to obtain the foreground HOA coefficients 65 (144). The audio decoding device 24 may also invoke the HOA coefficient formulation unit 82. The HOA coefficient formulation unit 82 may add the foreground HOA coefficients 65 to adjusted ambient HOA coefficients 47" so as to obtain the HOA coefficients 11' (146).

Figure 7:
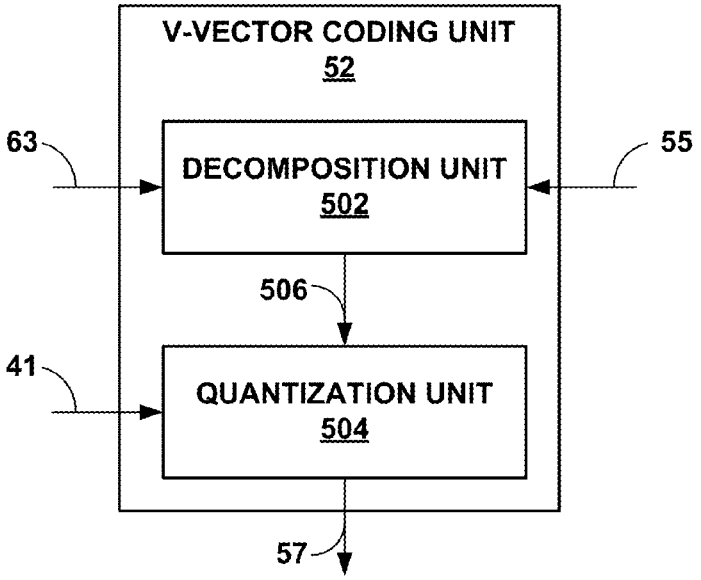
FIGS. 7 and 8 are diagrams illustrating different versions of the V-vector coding unit of the audio encoding device of FIG. 3A or FIG. 3B in more detail.

FIG. 7 is a block diagram illustrating, in more detail, an example v-vector coding unit 52 that may be used in the audio encoding device 20 of FIG. 3A. The v-vector coding unit 52 includes a decomposition unit 502 and a quantization unit 504. The decomposition unit 502 may decompose each of the reduced foreground V[k] vectors 55 into a weighted sum of code vectors based on the code vectors 63. The decomposition unit 502 may generate weights 506 and provide the weights 506 to the quantization unit 504. The quantization unit 504 may quantize the weights 506 to generate the coded weights 57.

Figure 8:
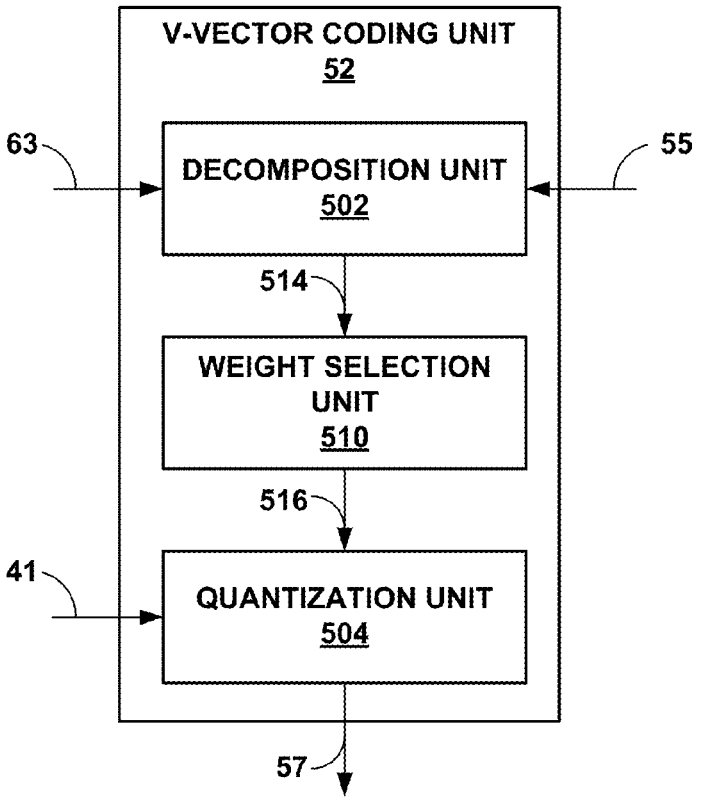

FIG. 8 is a block diagram illustrating, in more detail, an example v-vector coding unit 52 that may be used in the audio encoding device 20 of FIG. 3A. The v-vector coding unit 52 includes a decomposition unit 502, a weight selection unit 510, and a quantization unit 504. The decomposition unit 502 may decompose each of the reduced foreground V[k] vectors 55 into a weighted sum of code vectors based on the code vectors 63. The decomposition unit 502 may generate weights 514 and provide the weights 514 to the weight selection unit 510. The weight selection unit 510 may select a subset of the weights 514 to generate a selected subset of weights 516, and provide the selected subset of weights 516 to the quantization unit 504. The quantization unit 504 may quantize the selected subset of weights 516 to generate the coded weights 57.

Figure 9:
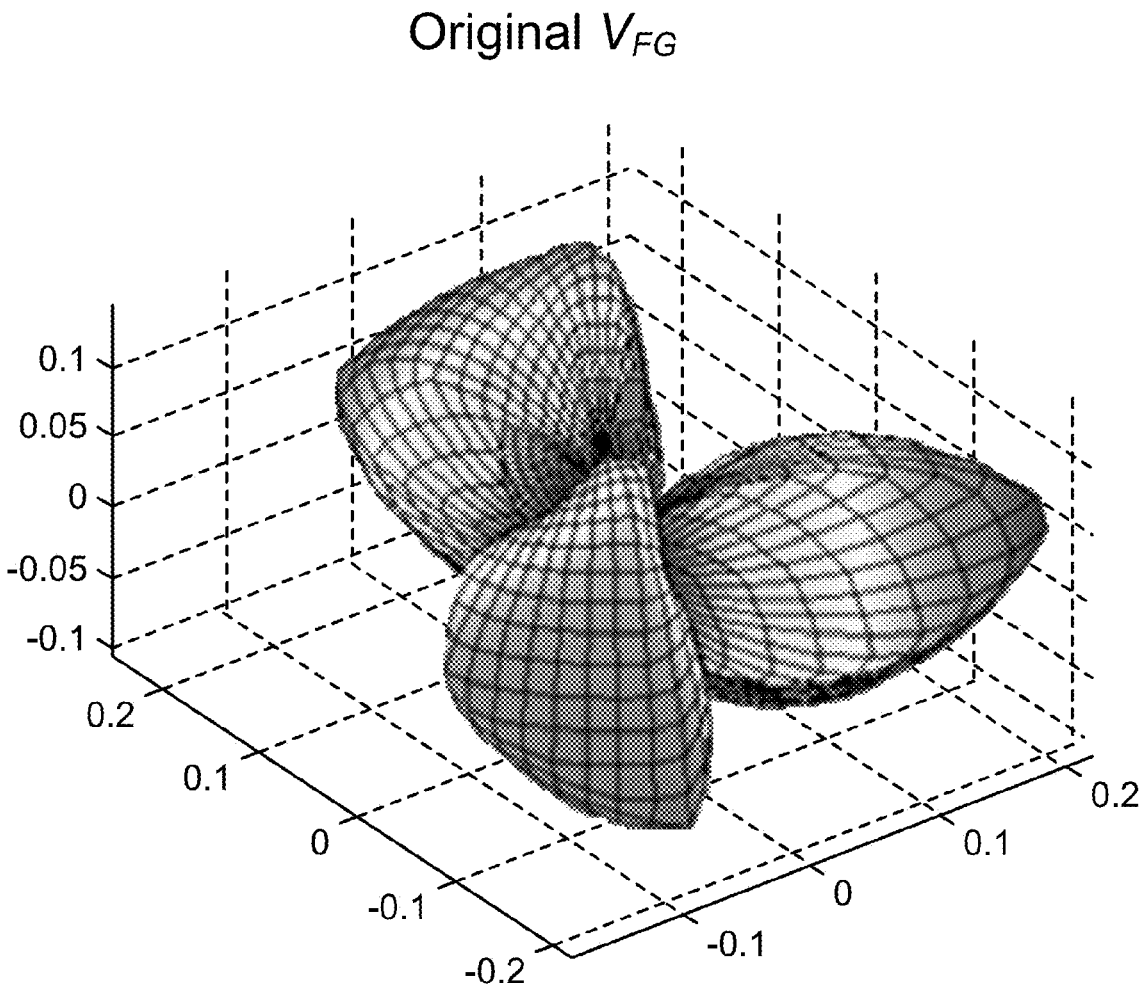
FIG. 9 is a conceptual diagram illustrating a sound field generated from a v-vector.
Figure 10:
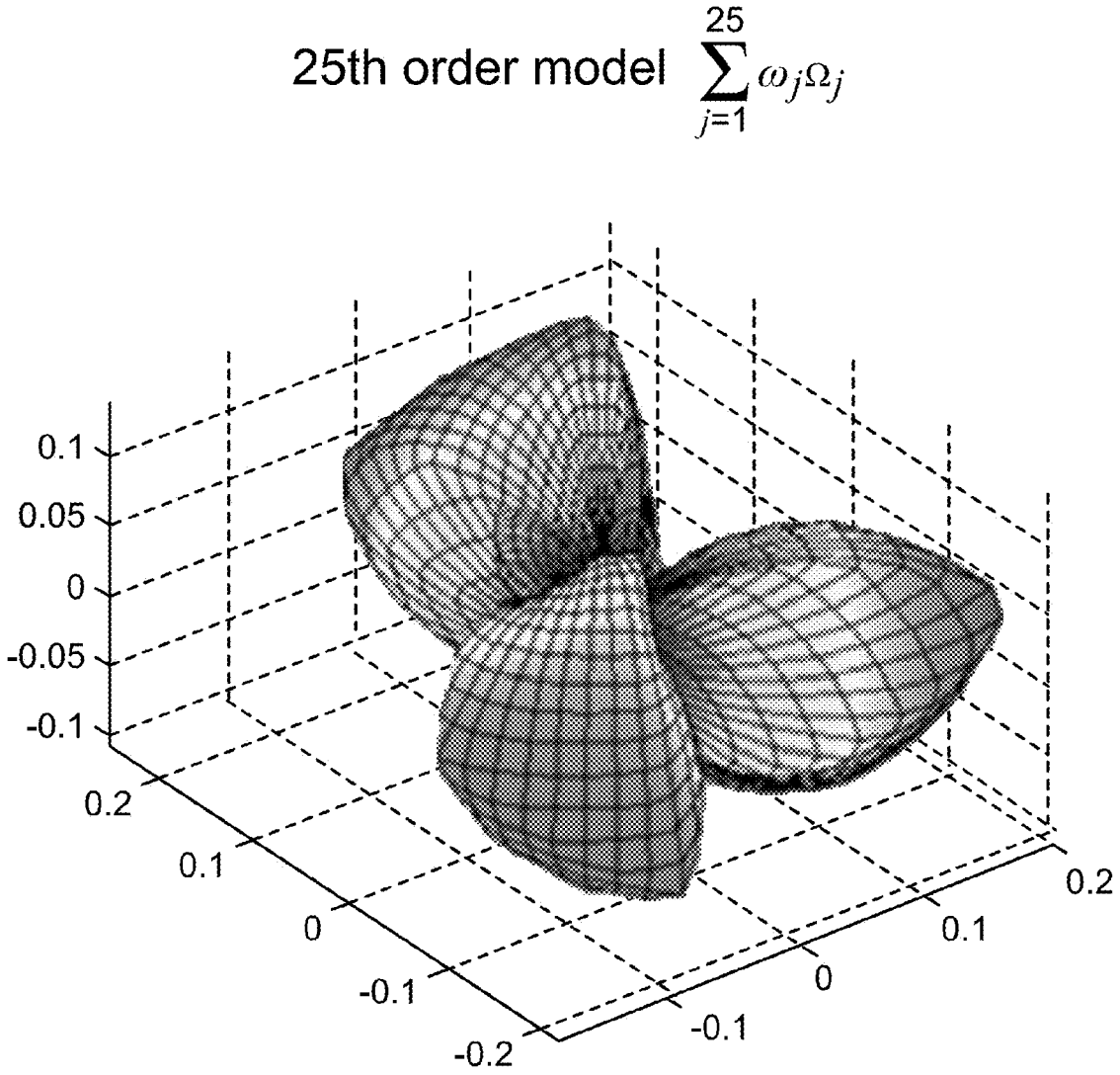
FIG. 10 is a conceptual diagram illustrating a sound field generated from a 25th order model of the v-vector.
Figure 11:
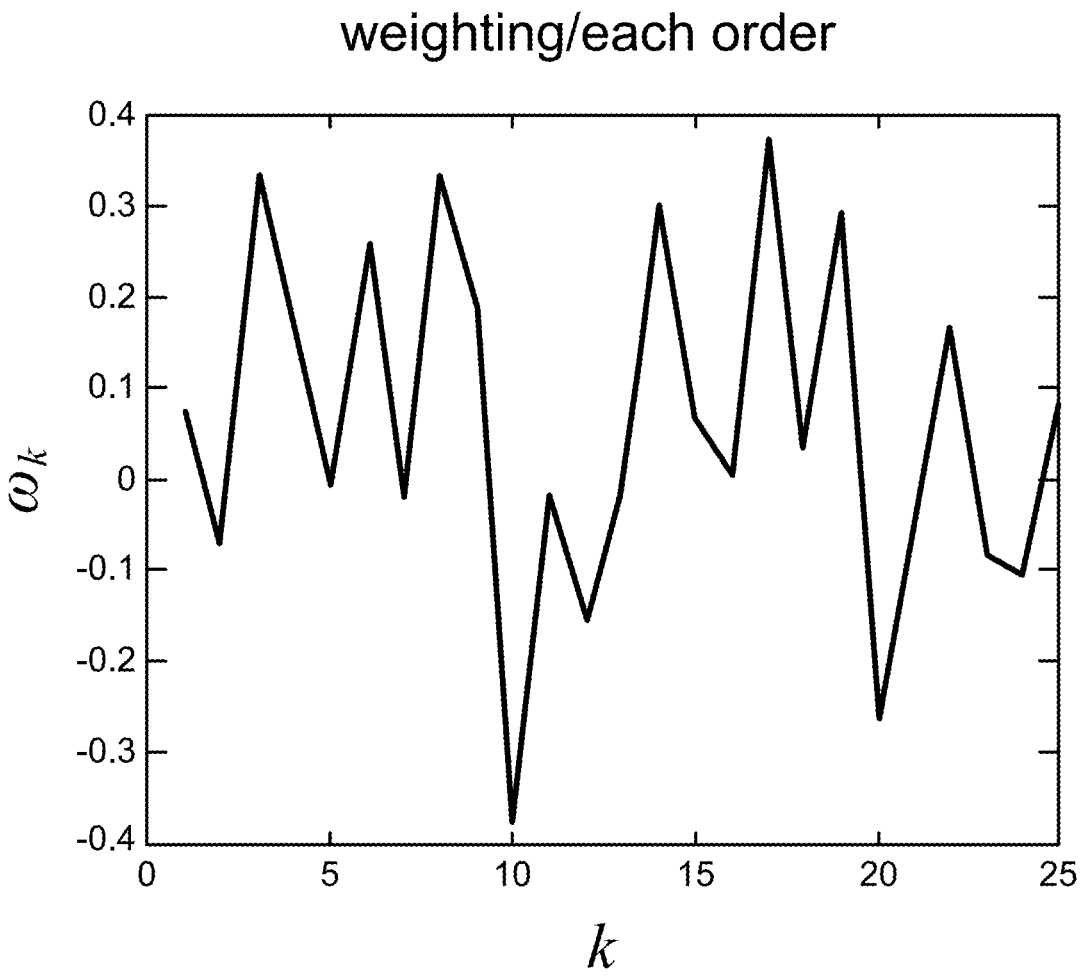
FIG. 11 is a conceptual diagram illustrating the weighting of each order for the 25th order model shown in FIG. 10.
Figure 12:
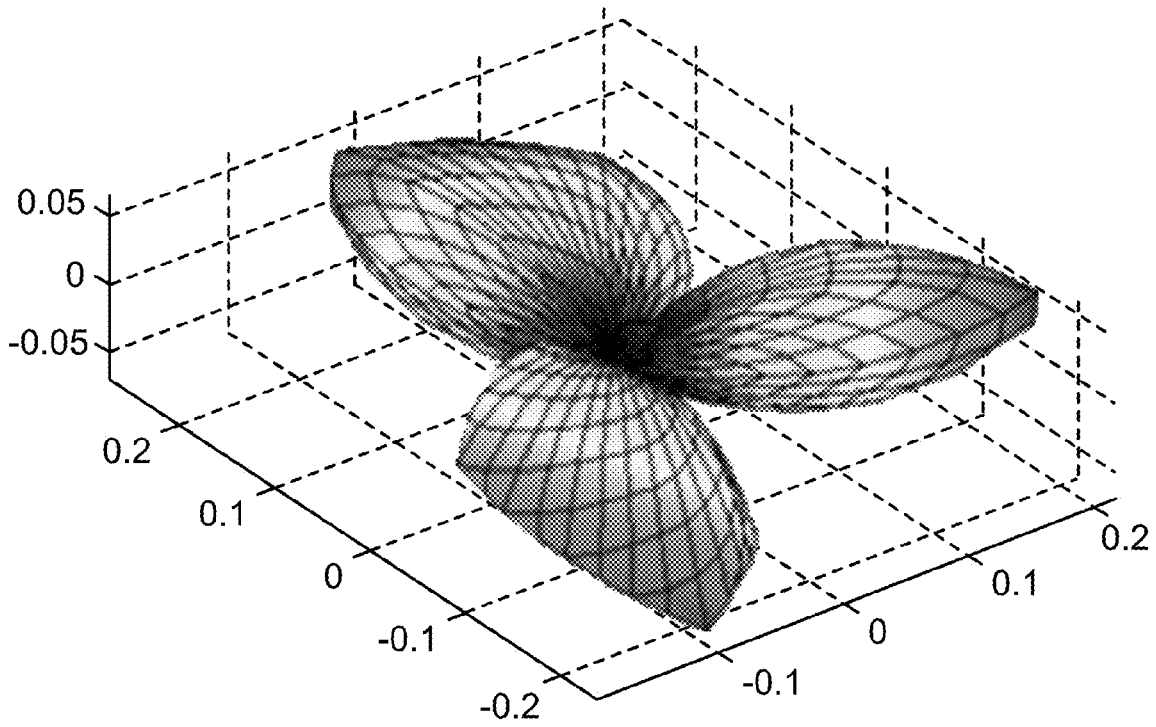
FIG. 12 is a conceptual diagram illustrating a 5th order model of the v-vector described above with respect to FIG. 9.
Figure 13:
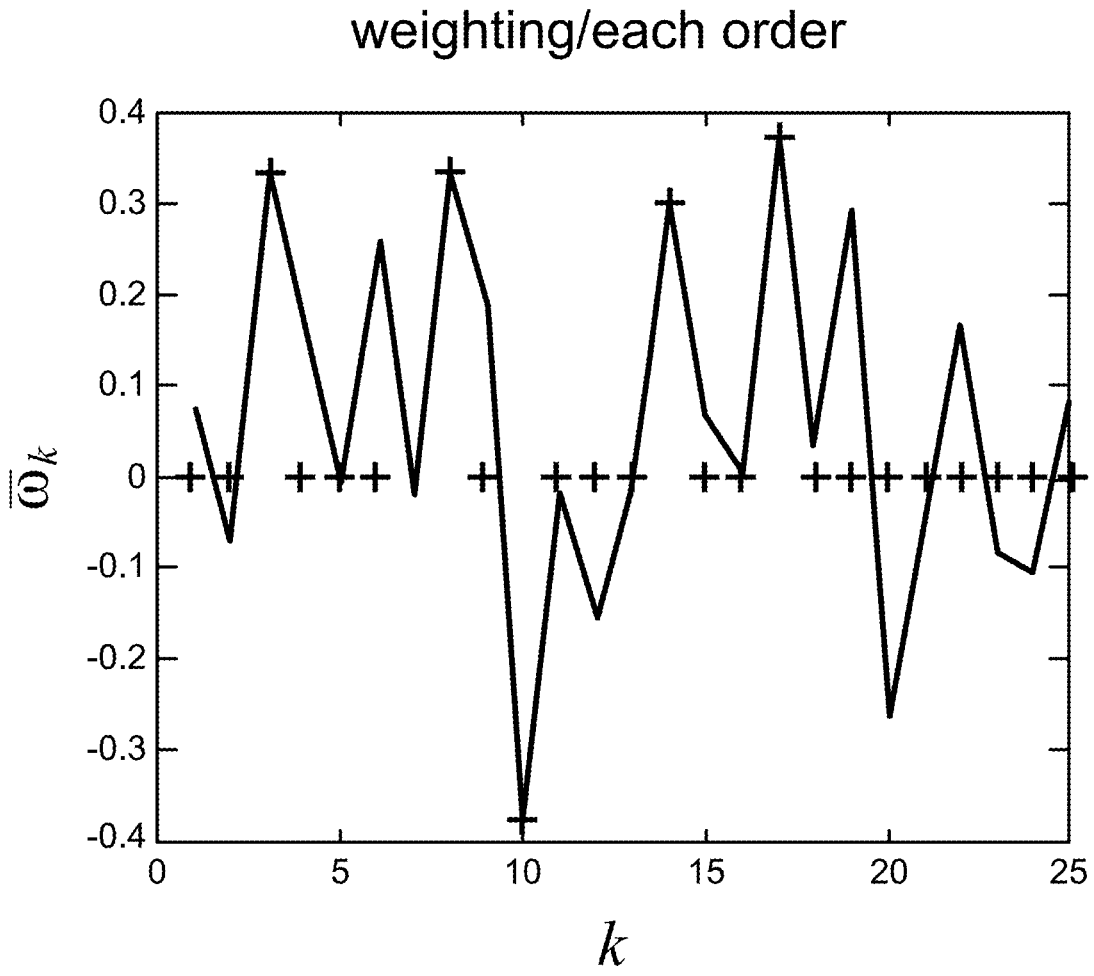
FIG. 13 is a conceptual diagram illustrating the weighting of each order for the 5th order model shown in FIG. 12.

FIG. 9 is a conceptual diagram illustrating a sound field generated from a v-vector. FIG. 10 is a conceptual diagram illustrating a sound field generated from a 25th order model of the v-vector described above with respect to FIG. 9. FIG. 11 is a conceptual diagram illustrating the weighting of each order for the 25th order model shown in FIG. 10. FIG. 12 is a conceptual diagram illustrating a 5th order model of the v-vector described above with respect to FIG. 9. FIG. 13 is a conceptual diagram illustrating the weighting of each order for the 5th order model shown in FIG. 12.

Figure 14:
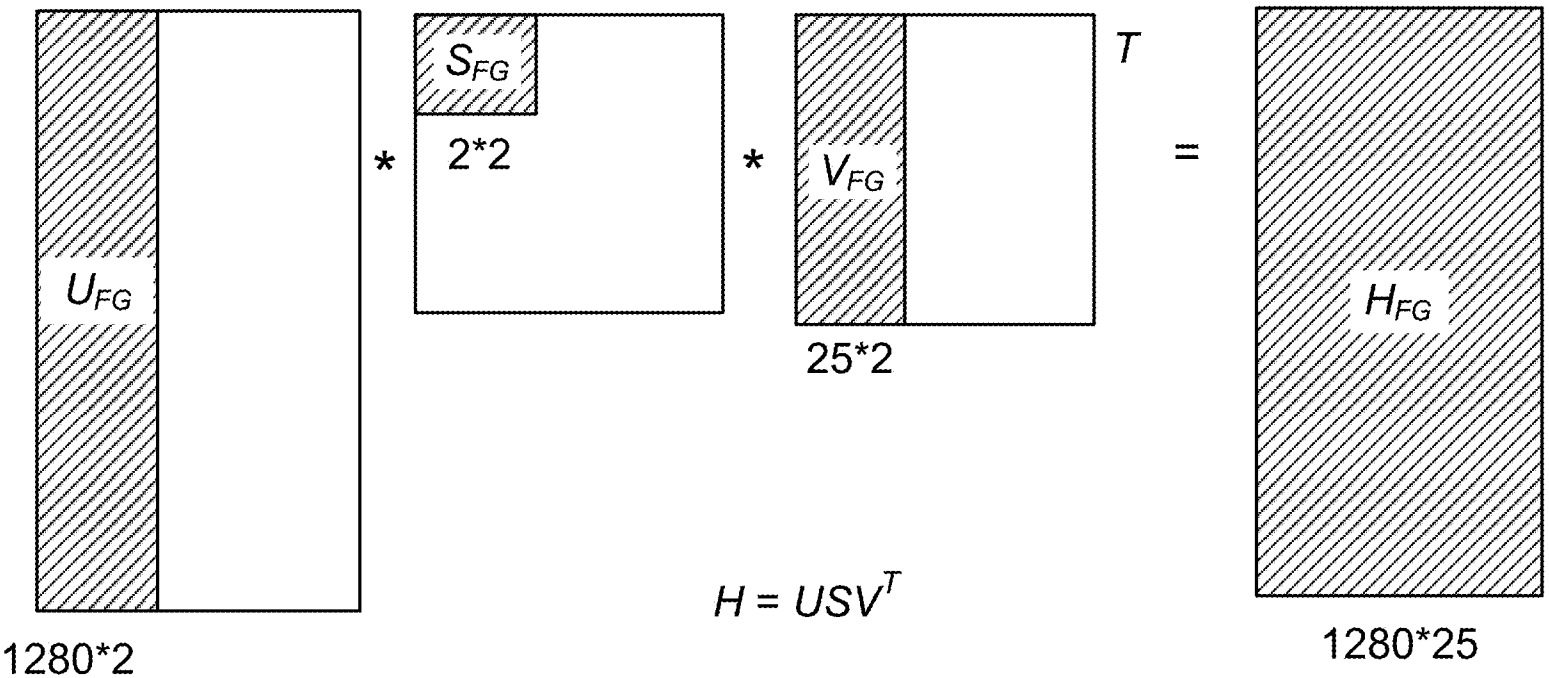
FIG. 14 is a conceptual diagram illustrating example dimensions of example matrices used to perform singular value decomposition.

FIG. 14 is a conceptual diagram illustrating example dimensions of example matrices used to perform singular value decomposition. As shown in FIG. 14, a $U_{FG}$ matrix is included in a U matrix, an $S_{FG}$ matrix is included in an S matrix, and a $V_{FG}^T$ matrix is included in a $V^T$ matrix.

In the example matrixes of FIG. 14, the $U_{FG}$ matrix has dimensions 1280 by 2 where 1280 corresponds to the number of samples, and 2 corresponds to the number of foreground vectors selected for foreground coding. The U matrix has dimensions of 1280 by 25 where 1280 corresponds to the number of samples, and 25 corresponds to the number of channels in the HOA audio signal. The number of channels may be equal to $(N+1)^2$ where N is equal to the order of the HOA audio signal.

The $S_{FG}$ matrix has dimensions 2 by 2 where each 2 corresponds to the number of foreground vectors selected for foreground coding. The S matrix has dimensions of 25 by 25 where each 25 corresponds to the number of channels in the HOA audio signal.

The $V_{FG}^T$ matrix has dimensions 25 by 2 where 25 corresponds to the number of channels in the HOA audio signal, and 2 corresponds to the number of foreground vectors selected for foreground coding. The $V^T$ matrix has dimensions of 25 by 25 where each 25 corresponds to the number of channels in the HOA audio signal.

As shown in FIG. 14, the $U_{FG}$ matrix, the $S_{FG}$ matrix, and the $V_{FG}^T$ matrix may be multiplied together to generate an $H_{FG}$ matrix. The $H_{FG}$ matrix has dimensions of 1280 by 25 where 1280 corresponds to the number of samples, and 25 corresponds to the number of channels in the HOA audio signal.

FIG. 15 is a chart illustrating example performance improvements that may be obtained by using the v-vector coding techniques of this disclosure. Each row represents a test item, and the columns indicate from left-to-right, the test item number, the test item name, the bits-per-frame associated with the test item, the bit-rate using one or more of the example v-vector coding techniques of this disclosure, and the bit-rate obtained using other v-vector coding techniques (e.g., scalar quantizing the v-vector components without decomposing the v-vector). As shown in FIG. 15, the techniques of this disclosure may, in some examples, provide significant improvements in bit-rate relative to other techniques that do not decompose v-vectors into weights and/or select a subset of the weights to quantize.

In some examples, the techniques of this disclosure may perform V-vector quantization based on a set of directional vectors. A V-vector may be represented by a weighted sum of directional vectors. In some examples, for a given set of directional vectors that are orthonormal to each other, the v-vector coding unit 52 may calculate the weighting value for each directional vector. The v-vector coding unit 52 may select the N-maxima weighting values, {w_i}, and the corresponding directional vectors, {o_i}. The v-vector coding unit 52 may transmit indices {i} to the decoder that correspond to the selected weighting values and/or directional vectors. In some examples, when calculating maxima, the v-vector coding unit 52 may use absolute values (by neglecting sign information). The v-vector coding unit 52 may quantize the N-maxima weighting values, {w_i}, to generate quantized weighting values {w^_i}. The v-vector coding unit 52 may transmit the quantization indices for {w^_i} to the decoder. At the decoder, the quantized V-vector may be synthesized as sum_i (w^_i*o_i)

In some examples, the techniques of this disclosure may provide a significant improvement in performance. For example, compared with using scalar quantization followed by Huffman coding, an approximately 85% bit-rate reduction may be obtained. For example, scalar quantization followed by Huffman coding may, in some examples, require a bit-rate of 16.26 kbps (kilo bits-per-second) while the techniques of this disclosure may, in some examples, be capable of coding at bit-rate of 2.75 kbsp.

Consider an example where X code vectors from a codebook (and X corresponding weights) are used to code a v-vector. In some examples, the bitstream generation unit 42 may generate the bitstream 21 such that each v-vector is represented by 3 categories of parameters: (1) X number of indices each pointing to a particular vector in a codebook of code vectors (e.g., a codebook of normalized directional vectors); (2) a corresponding (X) number of weights to go with the above indices; and (3) a sign bit for each of the above (X) number of weights. In some cases, the X number of weights may be further quantized using yet another vector quantization (VQ).

The decomposition codebook used for determining the weights in this example may be selected from a set of candidate codebooks. For example, the codebook may be 1 of 8 different codebooks. Each of these codebooks may have different lengths. So, for example, not only may a codebook of size 49 used to determine weights for 6th order HOA content, but the techniques of this disclosure may give the option of using any one of 8 different sized codebooks.

The quantization codebook used for the VQ of the weights may, in some examples, also have the same corresponding number of possible codebooks as the number of possible decomposition codebooks used to determine the weights. Thus, in some examples, there may be a variable number of different codebooks for determining the weights and a variable number of codebooks for quantizing the weights.

In some examples, the number of weights used to estimate a v-vector (i.e., the number of weights selected for quantization) may be variable. For example, a threshold error criterion may be set, and the number (X) of weights selected for quantization may depend on reaching the error threshold where the error threshold is defined above in equation (10).

In some examples, one or more of the above-mentioned concepts may be signaled in a bitstream. Consider an example where the maximum number of weights used to code v-vectors is set to 128 weights, and eight different quantization codebooks are used to quantize the weights. In such an example, the bitstream generation unit 42 may generate the bitstream 21 such that an Access Frame Unit in the bitstream 21 indicates the maximum number of indices that can be used on a frame-by-frame basis. In this example, the maximum number of indices is a number from 0-128, so the above-mentioned data may consume 7 bits in the Access Frame Unit.

In the above-mentioned example, on a frame-by-frame basis, the bitstream generation unit 42 may generate the bitstream 21 to include data indicative of: (1) which one of the 8 different codebooks was used to do the VQ (for every v-vector); and (2) the actual number of indices (X) used to code each v-vector. The data indicative of which one of the 8 different codebooks was used to do the VQ may consume 3 bits in this example. The data indicative of the actual number of indices (X) used to code each v-vector may be given by the maximum number of indices specified in the Access Frame Unit. This may vary from 0 bits to 7 bits in this example.

In some examples, the bitstream generation unit 42 may generate the bitstream 21 to include: (1) indices that indicate which directional vectors are selected and transmitted (according the calculated weighting values); and (2) weighting value(s) for each selected directional vector. In some examples, the this disclosure may provide techniques for the quantization of V-vectors using a decomposition on a codebook of normalized spherical harmonic code vectors.

Figure 17:
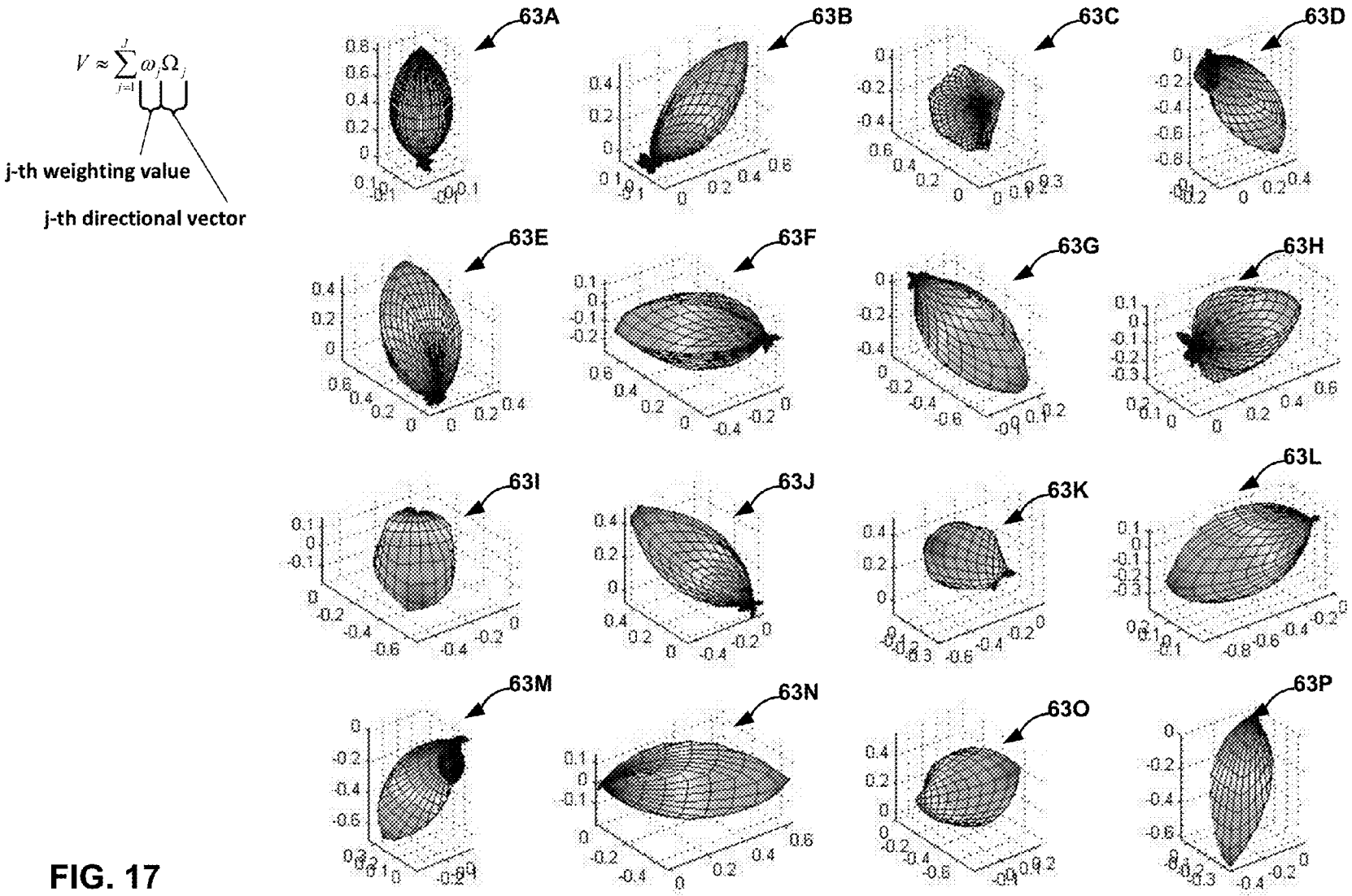
FIG. 17 is a conceptual diagram illustrating an example code vector-based decomposition of a V-vector according to this disclosure.

FIG. 17 is a diagram illustrating 16 different code vectors 63A-63P represented in a spatial domain that may be used by the V-vector coding unit 52 shown in the example of either or both of FIGS. 7 and 8. The code vectors 63A-63P may represent one or more of the code vectors 63 discussed above.

Figure 18:
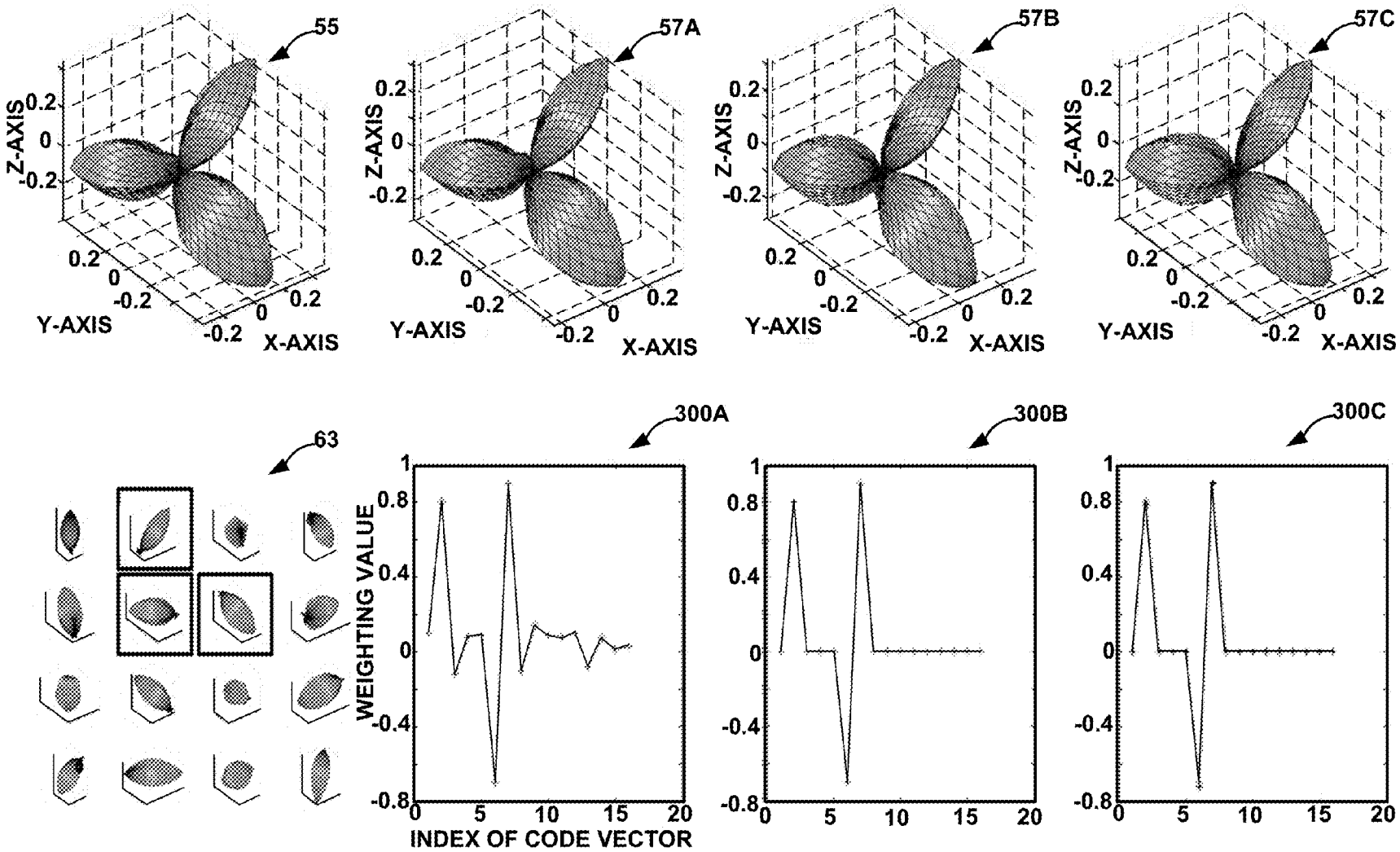
FIG. 18 is a diagram illustrating different ways by which the 16 different code vectors may be employed by the V-vector coding unit shown in the example of either or both of FIGS. 10 and 11.

FIG. 18 is a diagram illustrating different ways by which the 16 different code vectors 63A-63P may be employed by the V-vector coding unit 52 shown in the example of either or both of FIGS. 7 and 8. The V-vector coding unit 52 may receive one of reduced foreground V[k] vectors 55, which is shown after being rendered to the spatial domain and is denoted as V-vector 55. The V-vector coding unit 52 may perform the vector quantization discussed above to produce three different coded versions of the V-vector 55. The three different coded versions of the V-vector 55 are shown after being rendered to the spatial domain and are denoted coded V-vector 57A, coded V-vector 57B and coded V-vectors 57C. The V-vector coding unit 52 may select one of the coded V-vectors 57A-57C as one of the coded foreground V[k] vectors 57 corresponding to V-vector 55.

The V-vector coding unit 52 may generate each of coded V-vectors 57A-57C based on code vectors 63A-63P ("code vectors 63") shown in better detail in the example of FIG. 17. The V-vector coding unit 52 may generate the coded V-vector 57A based on all 16 of the code vectors 63 as shown in graph 300A where all 16 indexes are specified along with 16 weighting values. The V-vector coding unit 52 may generate the coded V-vector 57A based on a non-zero subset of the code vectors 63 (e.g., the code vectors 63 enclosed in the square box and associated with the indexes 2, 6 and 7 as shown in graph 300B given that the other indexes have a weighting of zero). The V-vector coding unit 52 may generate the coded V-vector 57C using the same three code vectors 63 as that used when generating the coded V-vector 57B except that the original V-vector 55 is first quantized.

Reviewing the renderings of the coded V-vectors 57A-57C in comparison to the original V-vector 55 illustrates that vector quantization may provide a substantially similar representation of the original V-vector 55 (meaning that the error between each of the coded V-vectors 57A-57C is likely small). Comparing the coded V-vectors 57A-57C to one another also reveals that there are only minor or slight differences. As such, the one of the coded V-vectors 57A-57C providing the best bit reduction is likely the one of the coded V-vectors 57A-57C that the V-vector coding unit 52 may select. Given that the coded V-vector 57C provides the smallest bit rate most likely (given that the coded V-vector 57C utilizes a quantized version of the V-vector 55 while also using only three of the code vectors 63), the V-vector coding unit 52 may select the coded V-vector 57C as the one of the coded foreground V[k] vectors 57 corresponding to V-vector 55.

Figure 21:
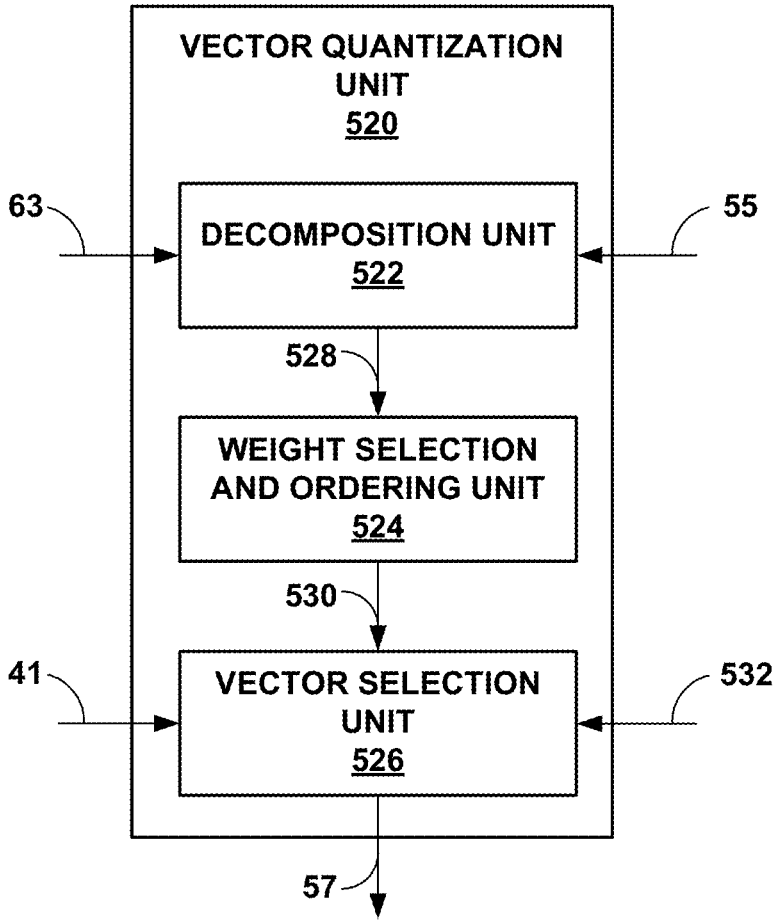
FIG. 21 is a block diagram illustrating an example vector quantization unit 520 according to this disclosure.

FIG. 21 is a block diagram illustrating an example vector quantization unit 520 according to this disclosure. In some examples, the vector quantization unit 520 may be an example of the V-vector coding unit 52 in the audio encoding device 20 of FIG. 3A or in the audio encoding device 20 of FIG. 3B. The vector quantization unit 520 includes a decomposition unit 522, a weight selection and ordering unit 524, and a vector selection unit 526. The decomposition unit 522 may decompose each of the reduced foreground V[k] vectors 55 into a weighted sum of code vectors based on the code vectors 63. The decomposition unit 522 may generate weight values 528 and provide the weight values 528 to the weight selection and ordering unit 524.

The weight selection and ordering unit 524 may select a subset of the weight values 528 to generate a selected subset of weight values. For example, the weight selection and ordering unit 524 may select the M greatest-magnitude weight values from the set of weight values 528. The weight selection and ordering unit 524 may further reorder the selected subset of weight values based on magnitudes of the weight values to generate a reordered selected subset of weight values 530, and provide the reordered selected subset of weight values 530 to the vector selection unit 526.

The vector selection unit 526 may select an M-component vector from a quantization codebook 532 to represent M weight values. In other words, the vector selection unit 526 may vector quantize M weight values. In some examples, M may correspond to the number of weight values selected by the weight selection and ordering unit 524 to represent a single V-vector. The vector selection unit 526 may generate data indicative of the M-component vector selected to represent the M weight values, and provide this data to the bitstream generation unit 42 as the coded weights 57. In some examples, the quantization codebook 532 may include a plurality of M-component vectors that are indexed, and the data indicative of the M-component vector may be an index value into the quantization codebook 532 that points to the selected vector. In such examples, the decoder may include a similarly indexed quantization codebook to decode the index value.

Figure 22:
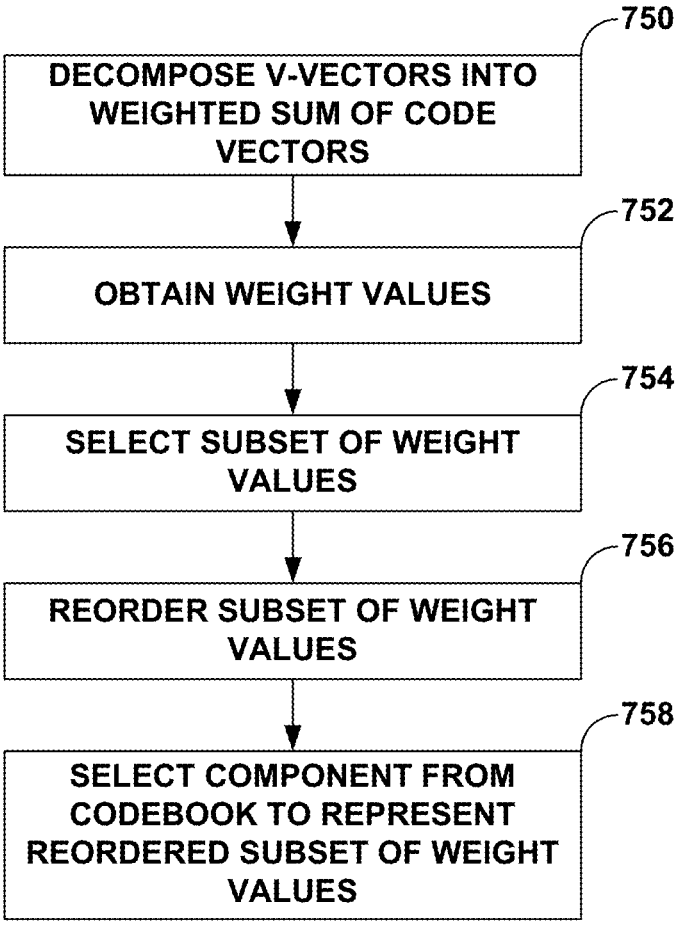
FIGS. 22, 24, and 26 are flowcharts illustrating exemplary operation of the vector quantization unit in performing various aspects of the techniques described in this disclosure.

FIG. 22 is a flowchart illustrating exemplary operation of the vector quantization unit in performing various aspects of the techniques described in this disclosure. As described above with respect to the example of FIG. 21, the vector quantization unit 520 includes a decomposition unit 522, a weight selection and ordering unit 524, and a vector selection unit 526. The decomposition unit 522 may decompose each of the reduced foreground V[k] vectors 55 into a weighted sum of code vectors based on the code vectors 63 (750). The decomposition unit 522 may obtain weight values 528 and provide the weight values 528 to the weight selection and ordering unit 524 (752).

The weight selection and ordering unit 524 may select a subset of the weight values 528 to generate a selected subset of weight values (754). For example, the weight selection and ordering unit 524 may select the M greatest-magnitude weight values from the set of weight values 528. The weight selection and ordering unit 524 may further reorder the selected subset of weight values based on magnitudes of the weight values to generate a reordered selected subset of weight values 530, and provide the reordered selected subset of weight values 530 to the vector selection unit 526 (756).

The vector selection unit 526 may select an M-component vector from a quantization codebook 532 to represent M weight values. In other words, the vector selection unit 526 may vector quantize M weight values (758). In some examples, M may correspond to the number of weight values selected by the weight selection and ordering unit 524 to represent a single V-vector. The vector selection unit 526 may generate data indicative of the M-component vector selected to represent the M weight values, and provide this data to the bitstream generation unit 42 as the coded weights 57. In some examples, the quantization codebook 532 may include a plurality of M-component vectors that are indexed, and the data indicative of the M-component vector may be an index value into the quantization codebook 532 that points to the selected vector. In such examples, the decoder may include a similarly indexed quantization codebook to decode the index value.

Figure 23:
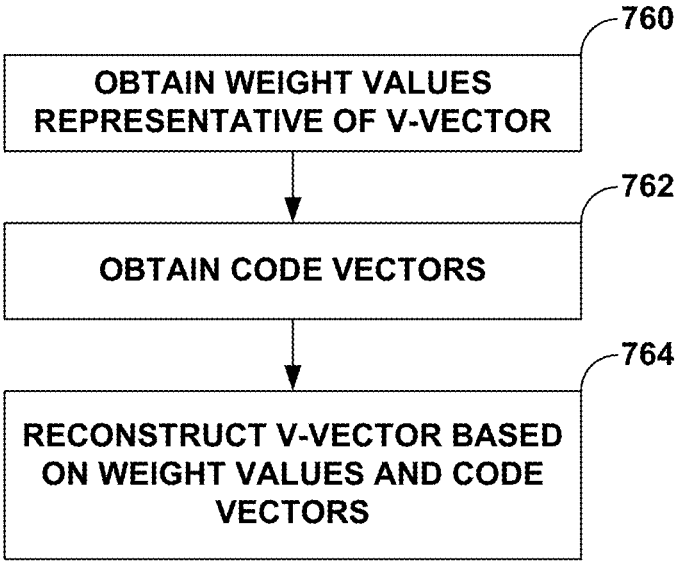
FIGS. 23, 25, and 27 are flowcharts illustrating exemplary operation of the V-vector reconstruction unit in performing various aspects of the techniques described in this disclosure.

FIG. 23 is a flowchart illustrating exemplary operation of the V-vector reconstruction unit in performing various aspects of the techniques described in this disclosure. The V-vector reconstruction unit 74 of FIG. 4A or 4B may first obtain the weight values, e.g., from extraction unit 72 after being parsed from the bitstream 21 (760). The V-vector reconstruction unit 74 may also obtain code vectors, e.g., from a codebook using an index signaled in the bitstream 21 in the manner described above (762). The V-vector reconstruction unit 74 may then reconstruct the reduced foreground V[k] vectors (which may also be referred to as the V-vectors) 55 based on the weight values and the code vectors in one or more of the various ways described above (764).

Figure 24:
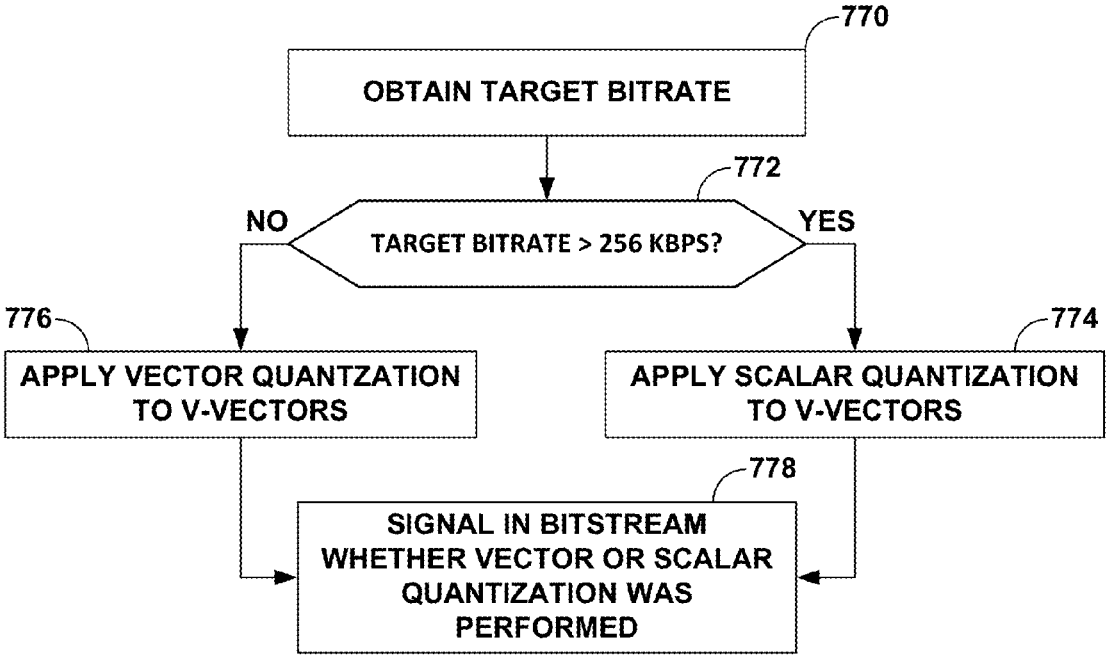

FIG. 24 is a flowchart illustrating exemplary operation of the V-vector coding unit of FIG. 3A or 3B in performing various aspects of the techniques described in this disclosure. The V-vector coding unit 52 may obtain a target bitrate (which may also be referred to as a threshold bitrate) 41 (770). When the target bitrate 41 is greater than 256 Kbps (or any other specified, configured or determined bitrate) ("NO" 772), the V-vector coding unit 52 may determine to apply and then apply scalar quantization to the V-vectors 55 (774). When the target bitrate 41 is less than or equal to 256 Kbps ("YES" 772), the V-vector reconstruction unit 52 may determine to apply and then apply vector quantization to the V-vectors 55 (776). The V-vector coding unit 52 may also signal in the bitstream 21 that scalar or vector quantization was performed with respect to the V-vectors 55 (778).

Figure 25:
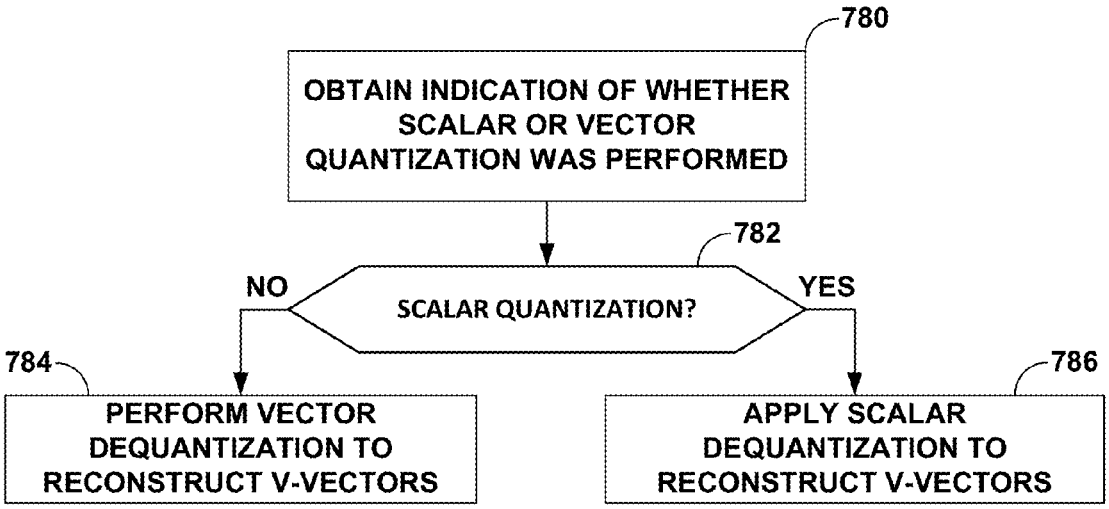

FIG. 25 is a flowchart illustrating exemplary operation of the V-vector reconstruction unit in performing various aspects of the techniques described in this disclosure. The V-vector reconstruction unit 74 of FIG. 4A or 4B may first obtain an indication (such as a syntax element) of whether scalar or vector quantization was performed with respect to the V-vectors 55 (780). When the syntax element indicates scalar quantization was not performed ("NO" 782), the V-vector reconstruction unit 74 may perform vector dequantization to reconstruct the V-vectors 55 (784). When the syntax element indicates that scalar quantization was performed ("YES" 782), the V-vector reconstruction unit 74 may perform scalar dequantization to reconstruct the V-vectors 55 (786).

Figure 26:
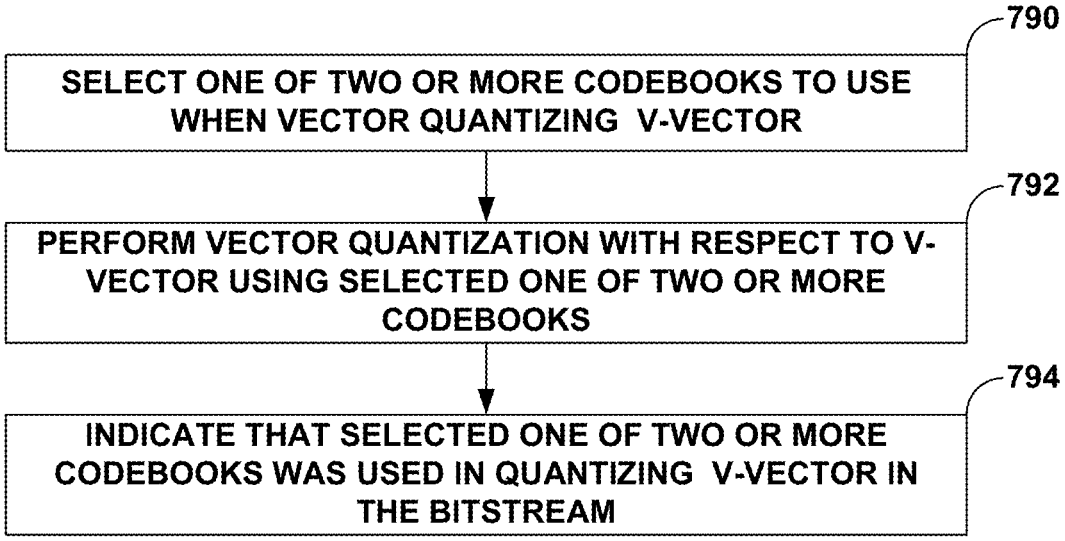

FIG. 26 is a flowchart illustrating exemplary operation of the V-vector coding unit of FIG. 3A or 3B in performing various aspects of the techniques described in this disclosure. The V-vector coding unit 52 may select one of a plurality (meaning, two or more) codebooks to use when vector quantizing the V-vectors 55 (790). The V-vector coding unit 52 may then perform vector quantization in the manner described above with respect to the V-vectors 55 using the selected one of the two or more codebooks (792). The V-vector coding unit 52 may then indicate or otherwise signal that one of the two or more codebooks was used in quantizing the V-vector 55 in the bitstream 21 (794).

Figure 27:
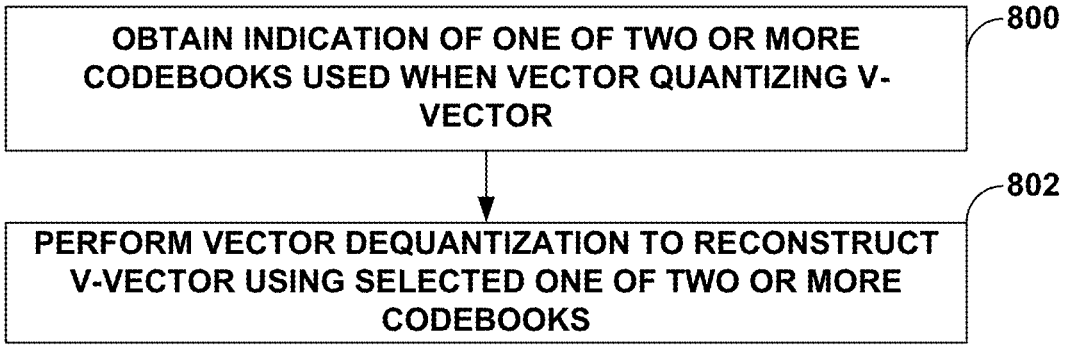

FIG. 27 is a flowchart illustrating exemplary operation of the V-vector reconstruction unit in performing various aspects of the techniques described in this disclosure. The V-vector reconstruction unit 74 of FIG. 4A or 4B may first obtain an indication (such as a syntax element) of one of two or more codebooks used when vector quantizing a V-vector 55 (800). The V-vector reconstruction unit 74 may then perform vector dequantization to reconstruct the V-vector 55 using the selected one of the two or more codebooks in the manner described above (802).

Various aspects of the techniques may enable a device set forth in the following clauses:

Clause 1. A device comprising means for storing a plurality of codebooks to use when performing vector quantization with respect to a spatial component of a soundfield, the spatial component obtained through application of a decomposition to a plurality of higher order ambisonic coefficients, and means for selecting one of the plurality of codebooks.

Clause 2. The device of clause 1, further comprising means for specifying a syntax element in a bitstream that includes the vector quantized spatial component, the syntax element identifying an index into the selected one of the plurality of codebooks having a weight value used when performing the vector quantization of the spatial component.

Clause 3. The device of clause 1, further comprising means for specifying a syntax element in a bitstream that includes the vector quantized spatial component, the syntax element identifying an index into a vector dictionary having a code vector used when performing the vector quantization of the spatial component.

Clause 4. The method of clause 1, wherein the means for selecting one of a plurality of codebooks comprises means for selecting the one of the plurality of codebooks based on a number of code vectors used when performing the vector quantization.

Various aspects of the techniques may also enable a device set forth in the following clauses:

Clause 5. An apparatus comprising means for performing a decomposition with respect to a plurality of higher order ambisonic (HOA) coefficients to generate a decomposed version of the HOA coefficients, and means for determining, based on a set of code vectors, one or more weight values that represent a vector that is included in the decomposed version of the HOA coefficients, each of the weight values corresponding to a respective one of a plurality of weights included in a weighted sum of the code vectors that represents the vector.

Clause 6. The apparatus of clause 5, further comprising means for selecting a decomposition codebook from a set of candidate decomposition codebooks, wherein the means for determining, based on the set of code vectors, the one or more weight values comprises means for determining the weight values based on the set of code vectors specified by the selected decomposition codebook.

Clause 7. The apparatus of clause 6, wherein each of the candidate decomposition codebooks includes a plurality of code vectors, and wherein at least two of the candidate decomposition codebooks have a different number of code vectors.

Clause 8. The apparatus of claim 5, further comprising means for generating a bitstream to include one or more indices that indicate which code vectors are used for determining the weights, and means for generating the bitstream to further include weighting values corresponding to each of the indices.

Any of the foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 3A.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 3A.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A method of decoding a bitstream indicative of a plurality of higher-order ambisonic (HOA) coefficients representative of a soundfield, the method comprising:

obtaining, by an audio decoding device, the bitstream, wherein the bitstream includes a syntax element identifying whether the vector quantization or the scalar quantization was performed;

performing, by the audio decoding device and based on the syntax element identifying whether the vector quantization or the scalar quantization was performed, either vector dequantization or scalar dequantization with respect to a spatial component defined in a spherical harmonic domain;

reconstructing, by the audio decoding device, the plurality of HOA coefficients based on the dequantized spatial component;

rendering, by the audio decoding device, one or more loudspeaker feeds based on the reconstructed plurality of HOA coefficients; and reproducing, by one or more loudspeakers coupled to the audio decoding device, the soundfield based on the one or more loudspeaker feeds.

2. The method of claim 1, further comprising performing the vector dequantization based on the determination.

3. The method of claim 2, wherein performing the vector dequantization comprises determining one or more weight values that represent a vector that is included in the spatial component, each of the weight values corresponding to a respective one of a plurality of weights included in a weighted sum of the code vectors that represents the vector.

4. The method of claim 3, wherein determining the weight values comprises determining a set of N weight values.

5. The method of claim 4, further comprising obtaining a bitstream that includes a syntax element indicative of which of the M greatest weight values were selected from a weight value codebook.

6. The method of claim 5, wherein the weight value codebook is one of a plurality of weight value codebooks, and wherein obtaining the bitstream comprises obtaining the bitstream that also includes a syntax element that identifies the weight value codebook of the plurality of weight value codebooks from which the M greatest weight values were selected.

7. The method of claim 3, further comprising determining which of the set of code vectors to use with a corresponding one of the weight values to represent the spatial component.

8. The method of claim 3, further comprising determining which of the set of code vectors to use with a corresponding one of the weight values to represent the decomposed version of the plurality of HOA coefficients based on a syntax element included in the bitstream indicative of a vector index.

9. The method of claim 1, wherein reconstructing the plurality of HOA coefficients includes reconstructing the plurality of HOA coefficients based on the spatial component and an audio object corresponding to the spatial component.

10. A device configured to decode a bitstream indicative of a plurality of higher-order ambisonic (HOA) coefficients representative of a soundfield, the device comprising:

a memory configured to store the bitstream that includes a syntax element that identifies whether the vector quantization or the scalar quantization was performed; and one or more processors coupled to the memory, and configured to:

perform, based on the syntax element that identifies whether the vector quantization or the scalar quantization was performed, either vector dequantization or scalar dequantization with respect to a spatial component defined in a spherical harmonic domain;

reconstruct the plurality of HOA coefficients based on the dequantized spatial component; and render one or more loudspeaker feeds based on the reconstructed plurality of HOA coefficients; and one or more loudspeakers coupled to the processor, and configured to reproduce the soundfield based on the one or more loudspeaker feeds.

11. The device of claim 10, wherein the one or more processors are further configured to perform the scalar dequantization based on the determination.

12. The device of claim 11, wherein the one or more processors are further configured to obtain a bitstream that includes a field indicating a value that expresses a quantization step size or a variable thereof used when compressing the spatial component.

13. The device of claim 10, wherein the one or more processors are further configured to perform the vector dequantization with respect to a first portion of the spatial component based on the determination, and perform the scalar dequantization with respect to a second portion of the spatial component based on the determination.

14. The device of claim 10, wherein the one or more processors are configured to determine whether to perform the vector dequantization or the scalar dequantization with respect to the spatial component based on a threshold bitrate specified by the syntax element.

15. The device of claim 14, wherein the threshold bitrate comprises 256 kilobits per second (Kbps).

16. The device of claim 14, wherein the one or more processors are configured to determine to perform the vector dequantization with respect to the spatial component when the syntax element indicates that the threshold bitrate is equal to or below 256 kilobits per second (Kpbs).

17. The device of claim 14, wherein the one or more processors are configured to determine to perform the scalar dequantization with respect to the spatial component when the syntax element indicates that the threshold bitrate above 256 kilobits per second (Kpbs).

18. The device of claim 10, wherein the one or more processors are configured to reconstruct the plurality of HOA coefficients based on the spatial component and an audio object corresponding to the spatial component.

19. A method of encoding audio data indicative of a plurality of higher-order ambisonic (HOA) coefficients representative of a soundfield, the method comprising:

capturing, by a microphone coupled to an audio encoding device, the audio data; and determining, by the audio encoding device, whether to perform vector quantization or scalar quantization with respect to a spatial component decomposed from the plurality of HOA coefficients;

performing, by the audio encoding device and so as to generate a bitstream including an encoded version of the audio data, either the vector quantization or the scalar quantization with respect to the spatial component based on the determination; and specifying, by the audio encoding device and in the bitstream, a syntax element indicating whether the vector quantization or the scalar quantization was performed.

20. The method of claim 19, further comprising performing the vector quantization based on the determination.

* * * * *